US009957024B2

(12) United States Patent
Choi et al.

(10) Patent No.: US 9,957,024 B2
(45) Date of Patent: May 1, 2018

(54) FLOATING BOAT LIFTING APPARATUS FOR RAISING OR LOWERING THE BOAT FROM OR ONTO THE WATER

(71) Applicant: KSB & SUNGPOONG CO., LTD, Haman-gun, Gyeongsangnam-do (KR)

(72) Inventors: Im Cheol Choi, Busan (KR); Gyeong Hwa Jeon, Gyeongsangnam-do (KR)

(73) Assignee: KSB & SUNGPOONG CO., LTD, Haman-gun, Gyeongsangnam-do (KR)

( * ) Notice: Subject to any disclaimer, the term of this patent is extended or adjusted under 35 U.S.C. 154(b) by 0 days. days.

(21) Appl. No.: 15/314,638

(22) PCT Filed: May 28, 2015

(86) PCT No.: PCT/KR2015/005330
§ 371 (c)(1),
(2) Date: Nov. 29, 2016

(87) PCT Pub. No.: WO2015/182997
PCT Pub. Date: Dec. 3, 2015

(65) Prior Publication Data

US 2017/0197694 A1 Jul. 13, 2017

(30) Foreign Application Priority Data

May 29, 2014 (KR) ..... 10-2014-0065224
May 30, 2014 (KR) ..... 10-2014-0065728
May 30, 2014 (KR) ..... 10-2014-0065731
Nov. 14, 2014 (KR) ..... 10-2014-0158850
Feb. 27, 2015 (KR) ..... 10-2015-0027746
Mar. 24, 2015 (KR) ..... 10-2015-0040973
(Continued)

(51) Int. Cl.
*B63C 1/02* (2006.01)
*B63C 3/06* (2006.01)
(Continued)

(52) U.S. Cl.
CPC ..... *B63C 1/02* (2013.01); *B63B 35/00* (2013.01); *B63C 3/06* (2013.01); *B63C 3/12* (2013.01)

(58) Field of Classification Search
CPC .... B63C 1/00; B63C 1/02; B63C 1/04; B63C 1/08; B63C 3/00; B63C 3/06; B63C 7/00;
(Continued)

(56) References Cited

U.S. PATENT DOCUMENTS 6,823,809 B2 11/2004 Hey
7,527,014 B2 * 5/2009 Hey ..... B63B 17/02 114/44
(Continued)

FOREIGN PATENT DOCUMENTS

KR 20-0432028 Y1 11/2006
KR 10-1140400 B1 5/2012

*Primary Examiner* — Lars A Olson
(74) *Attorney, Agent, or Firm* — Novick, Kim & Lee, PLLC; Jae Youn Kim

(57) ABSTRACT

A boat lifting device for lifting a ship, such as a motorboat, a utility boat, a prefabricated rubber boat, a shipping boat, a cruise yacht, or a dinghy yacht, above the surface or for floating the same on the surface and, more particularly, to a boat lifting device operated by a hydraulic cylinder, air, water pressure, a worm gear, or a rotor.

35 Claims, 29 Drawing Sheets

(30) Foreign Application Priority Data

Mar. 24, 2015 (KR) ..... 10-2015-0040982
Apr. 1, 2015 (KR) ..... 10-2015-0045910

(51) Int. Cl.
*B63C 3/12* (2006.01)
*B63B 35/00* (2006.01)

(58) Field of Classification Search
CPC ..... B63C 3/12; B63B 17/00; B63B 17/02; B63B 35/00
USPC ..... 114/44, 45, 48; 405/3
See application file for complete search history.

(56) References Cited

U.S. PATENT DOCUMENTS

2002/0132537 A1 9/2002 Hey
2004/0089212 A1* 5/2004 Vinnik ..... B63C 1/02 114/44
2005/0013663 A1* 1/2005 Basta ..... B63C 3/00 405/3

* cited by examiner

[Fig. 1]
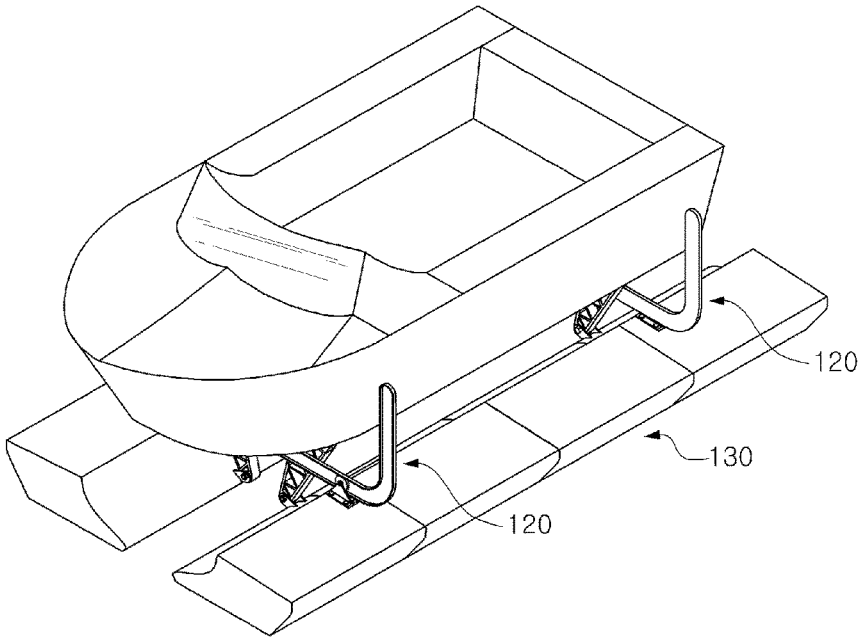
[Fig. 2]
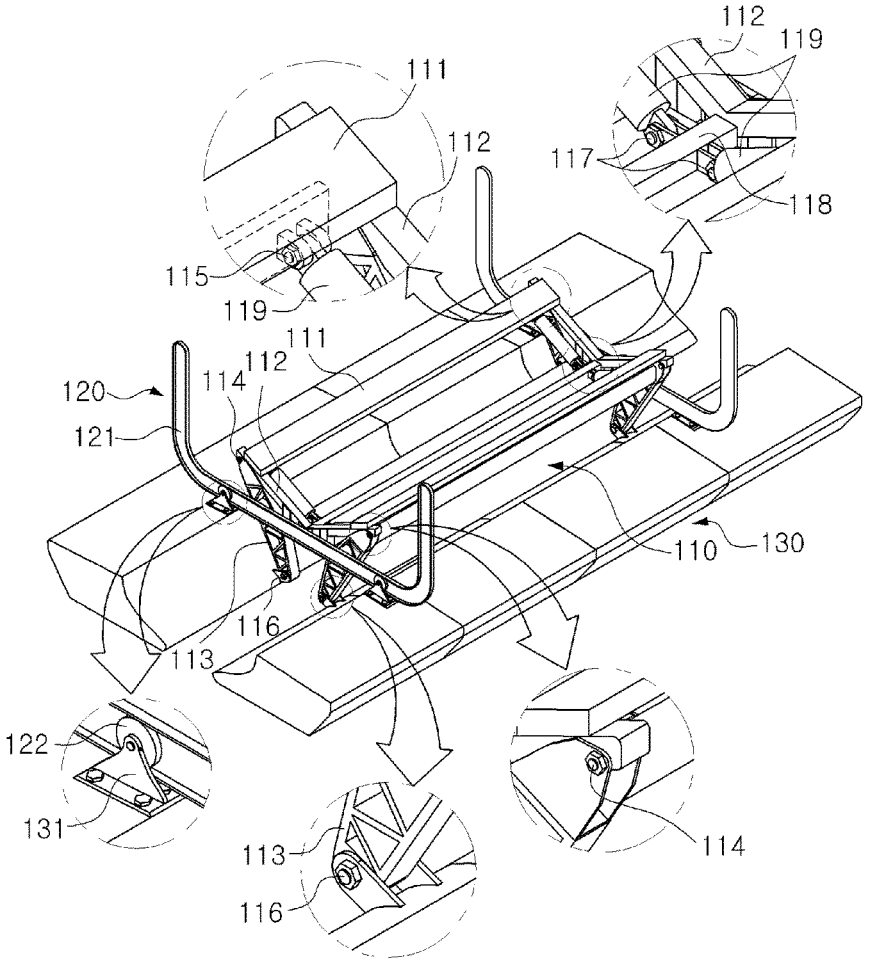

[Fig. 3]
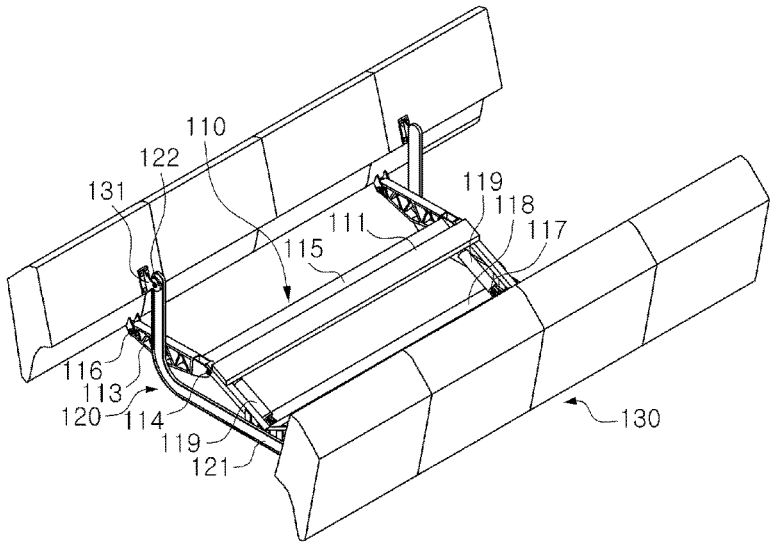
[Fig. 4]
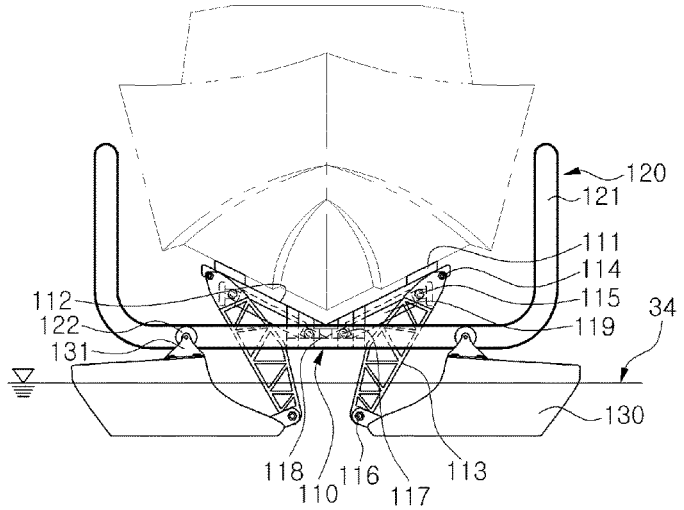
[Fig. 5]
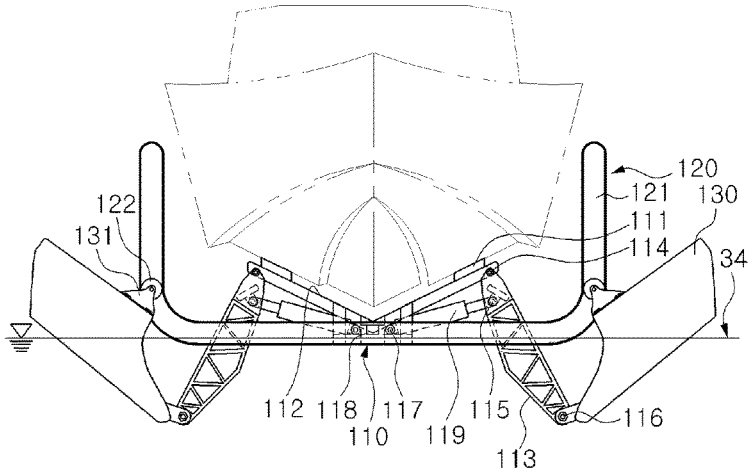

[Fig. 6]
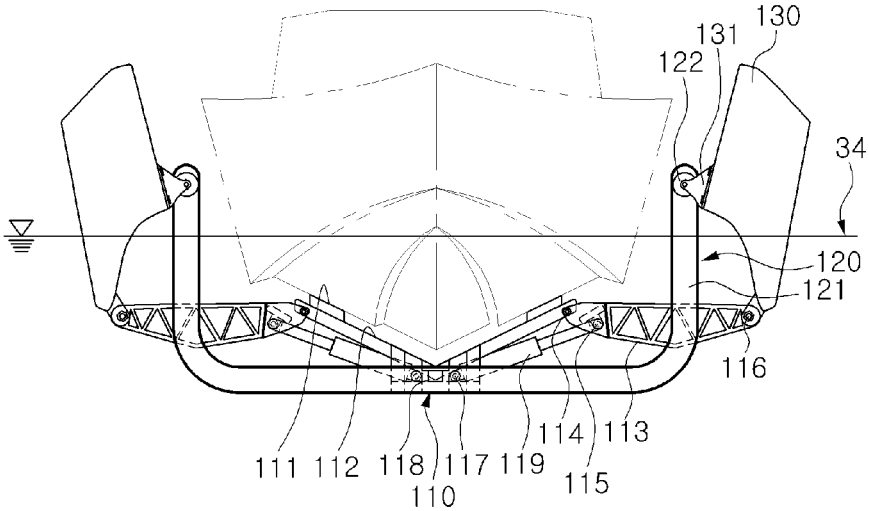
[Fig. 7]
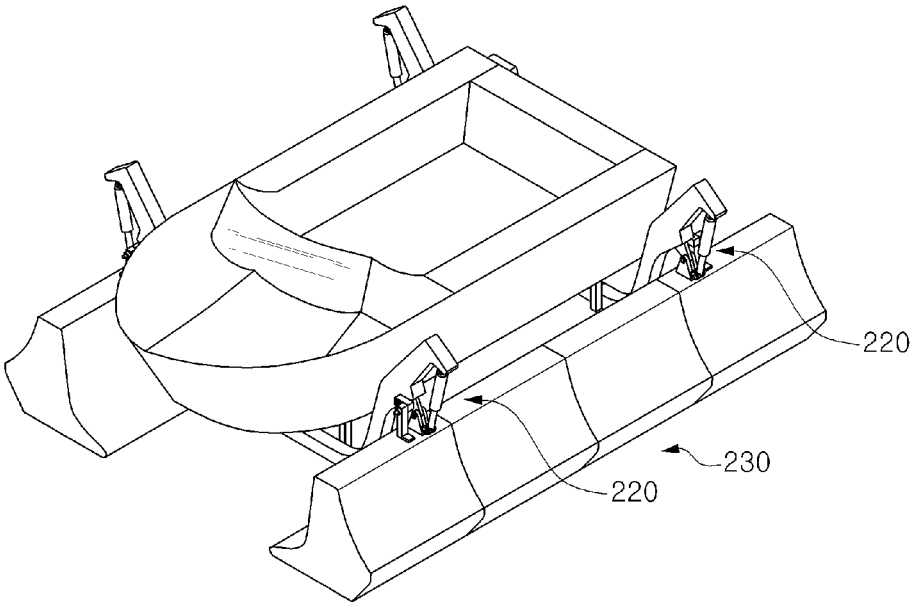

[Fig. 8]
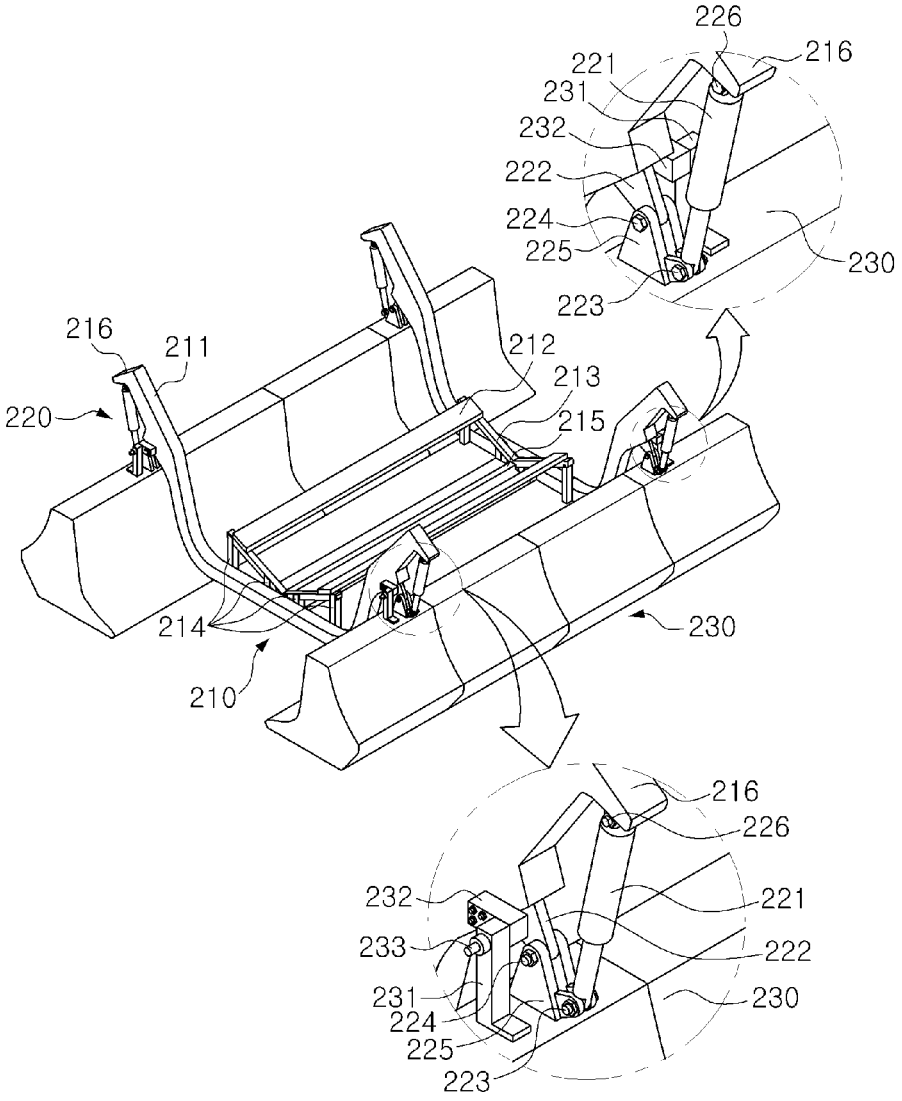

[Fig. 9]
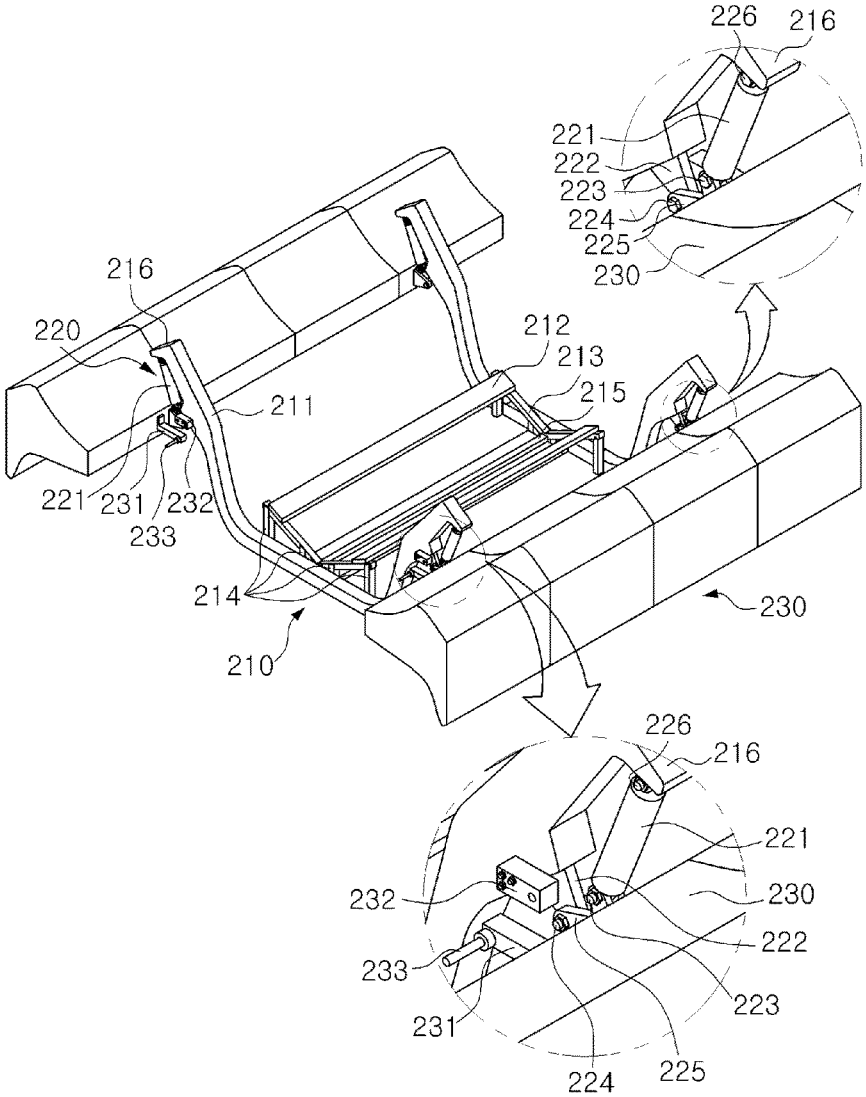
[Fig. 10]
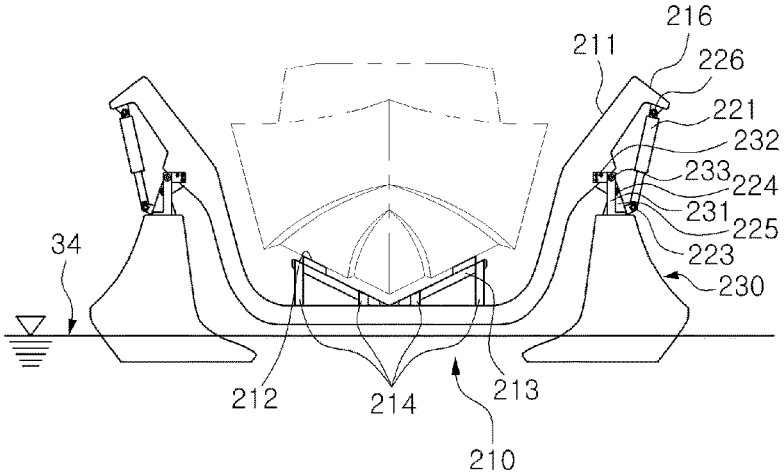

[Fig. 11]
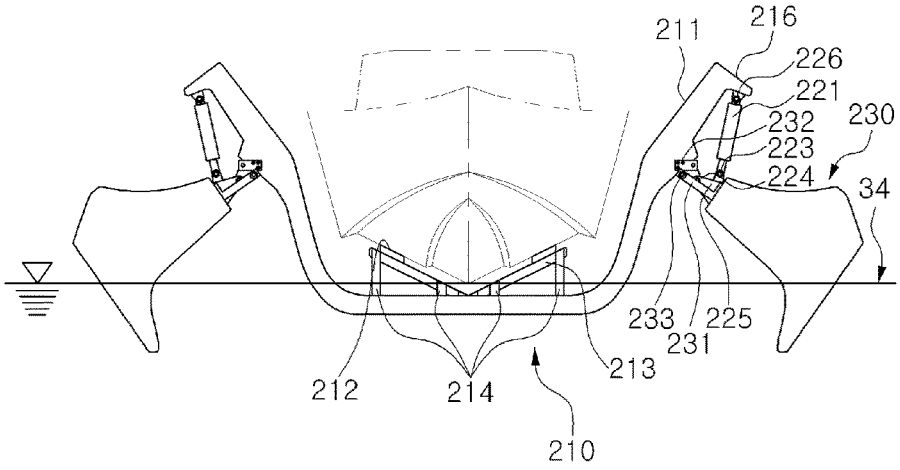
[Fig. 12]
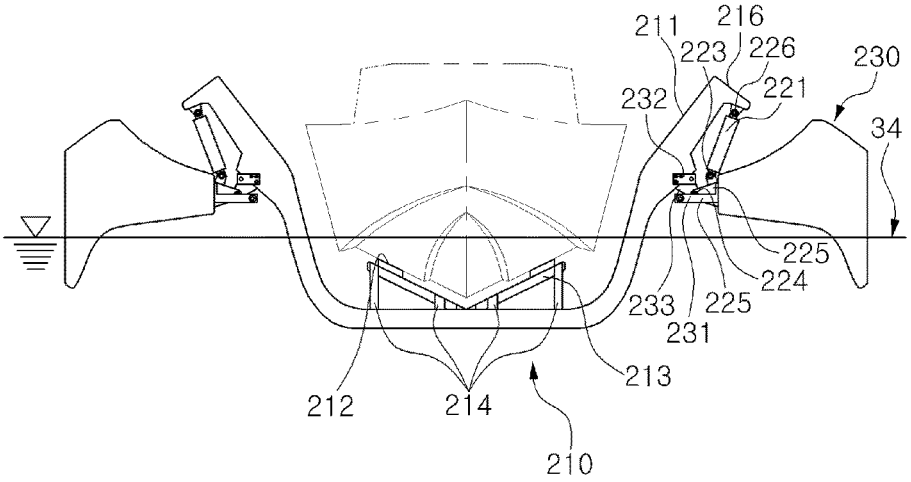
[Fig. 13]
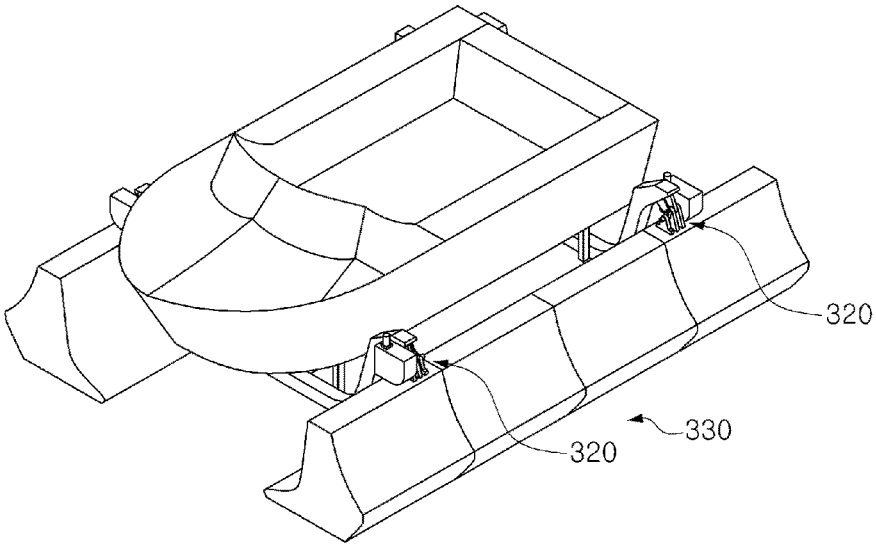

[Fig. 14]
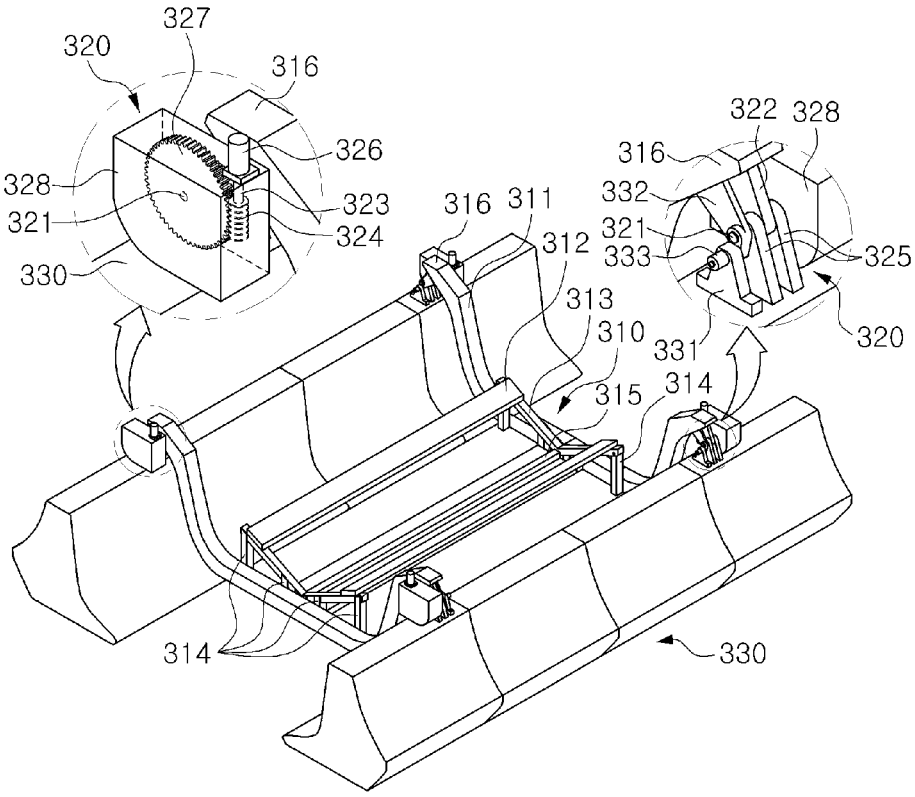
[Fig. 15]
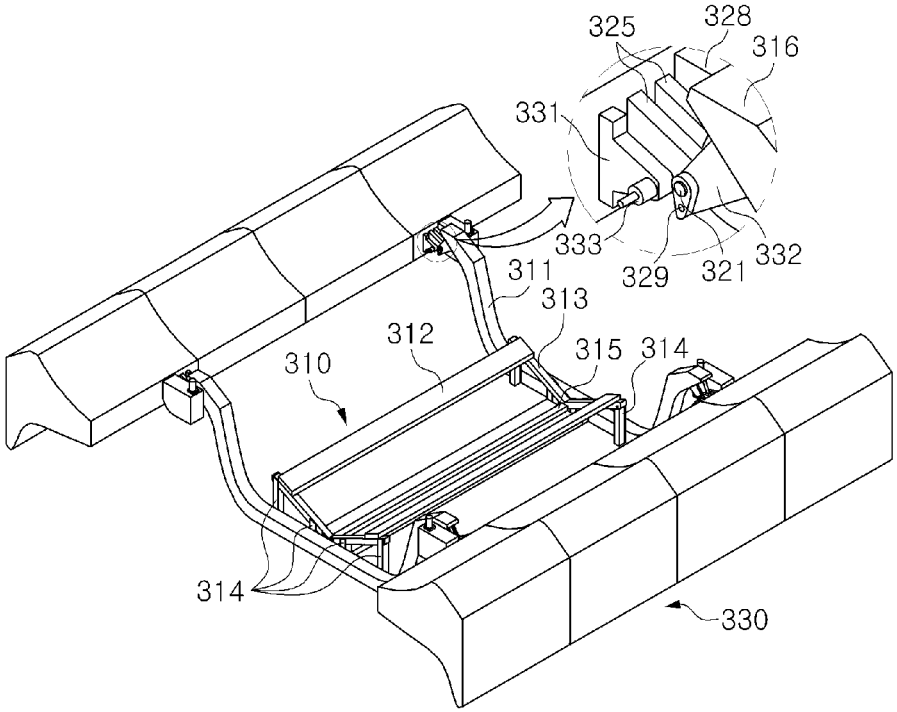

[Fig. 16]
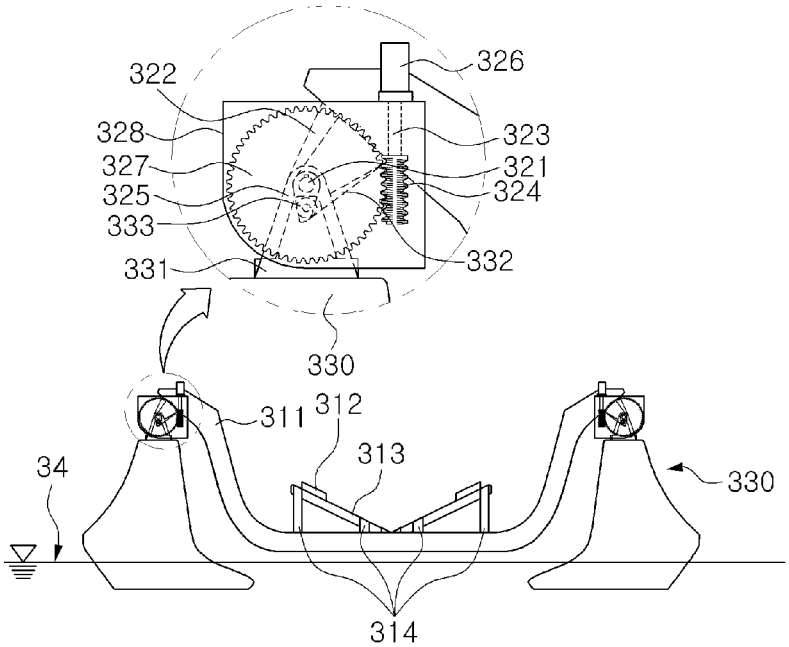
[Fig. 17]
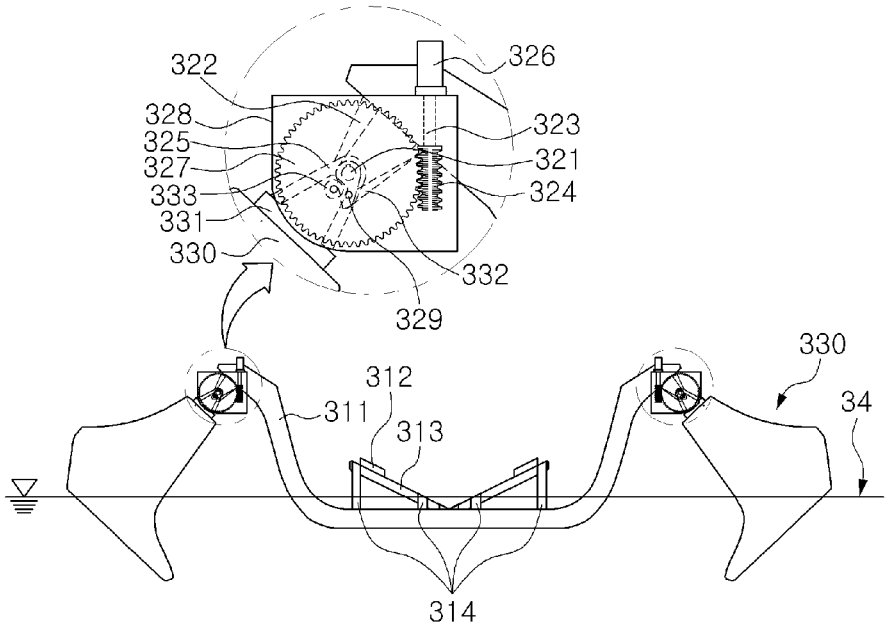

[Fig. 18]
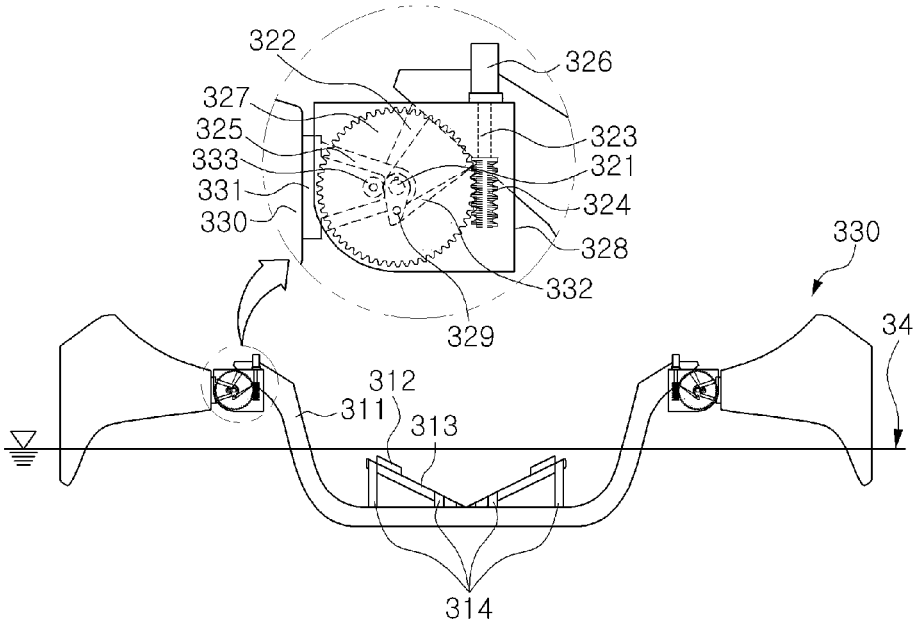
[Fig. 19]
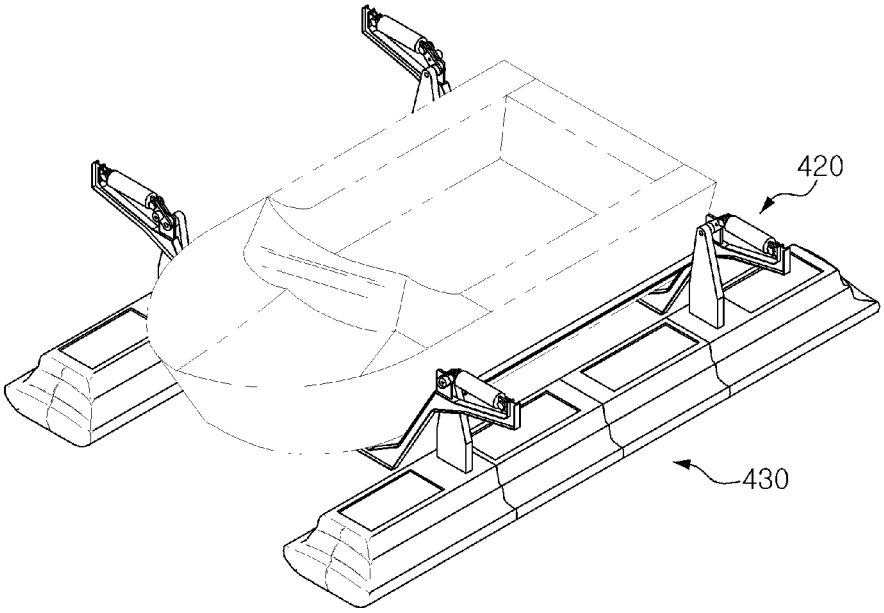

[Fig. 20]
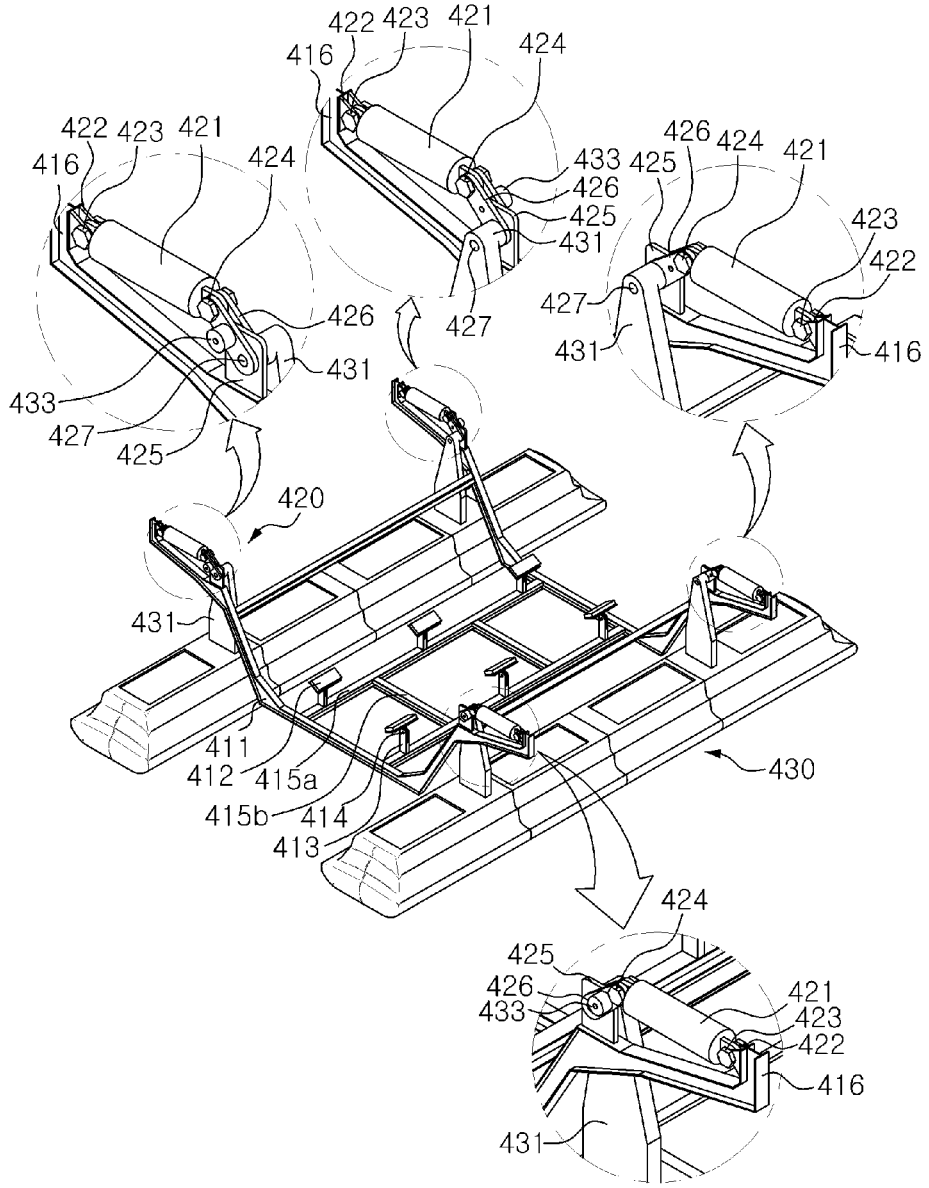

[Fig. 21]
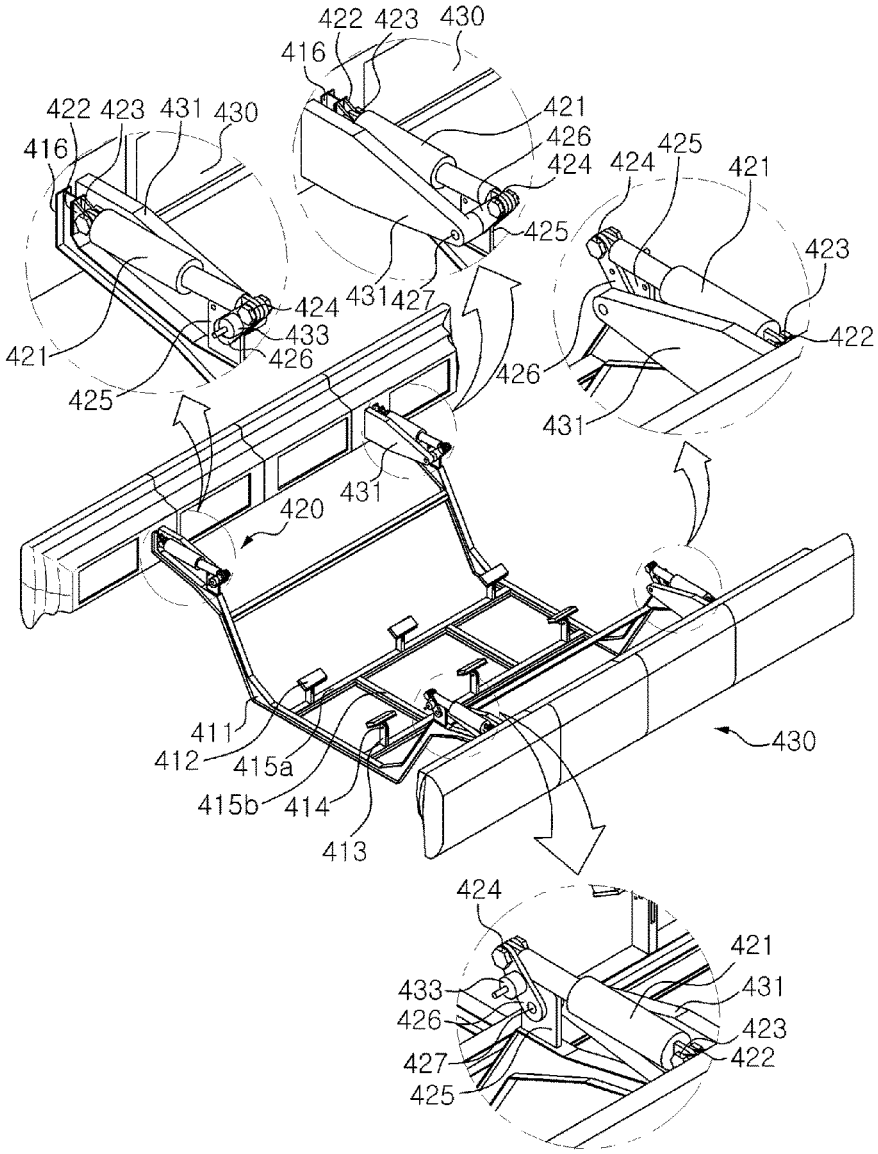
[Fig. 22]
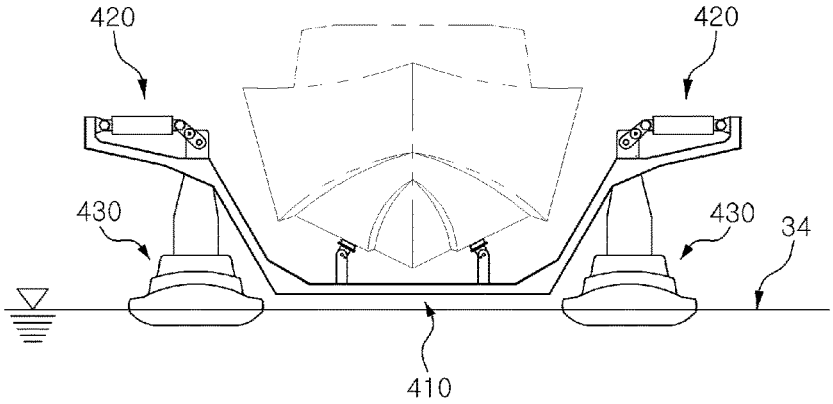

[Fig. 23]
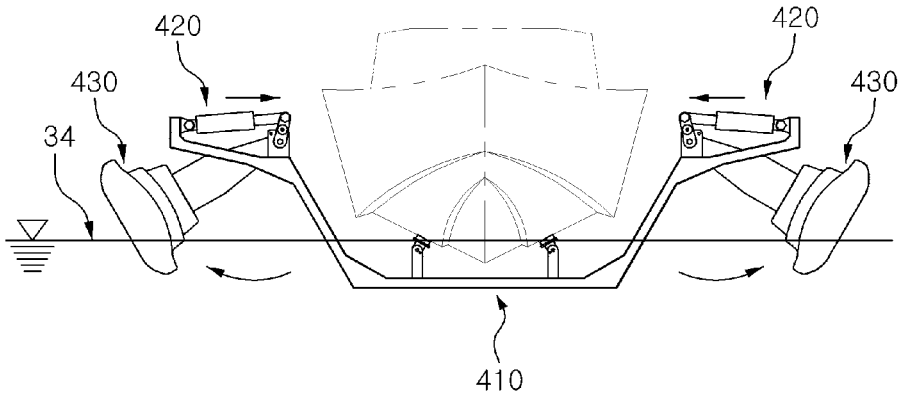
[Fig. 24]
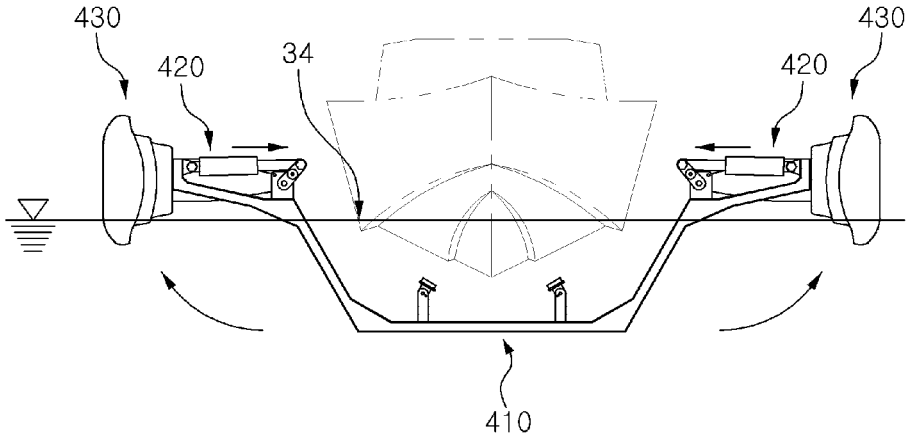
[Fig. 25]
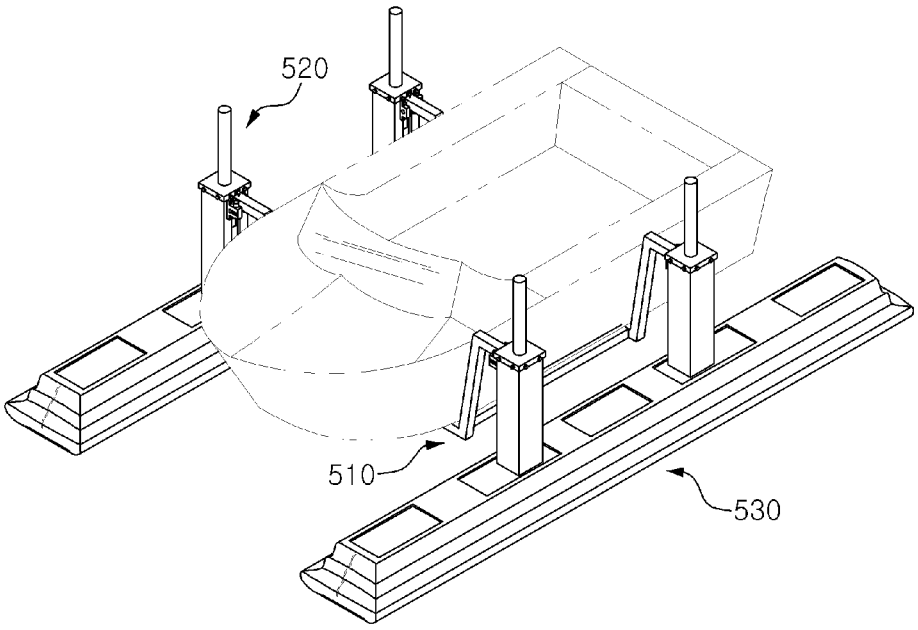

[Fig. 26]
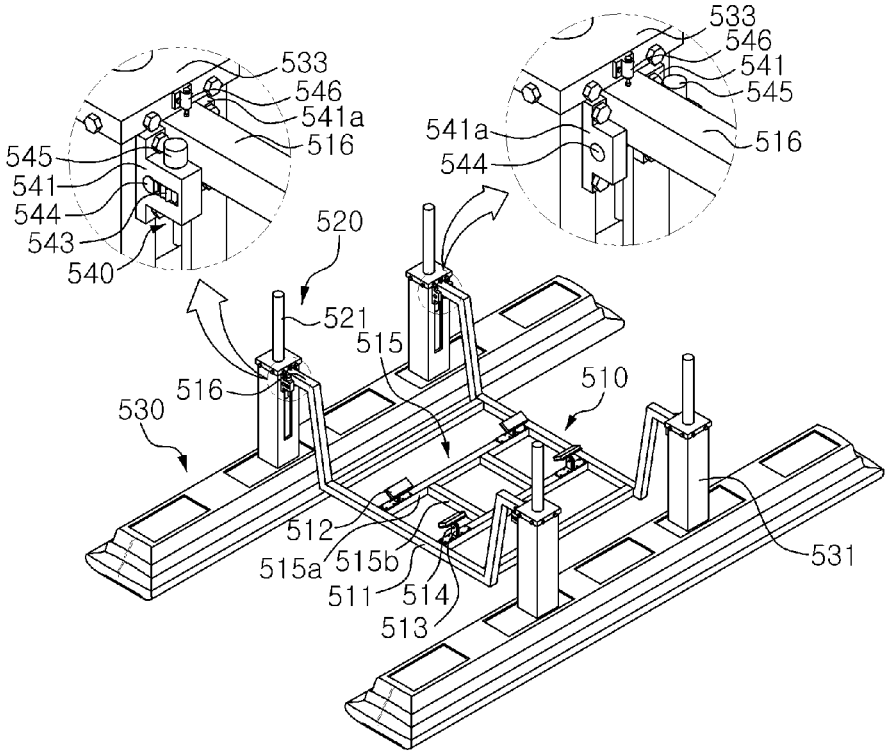
[Fig. 27]
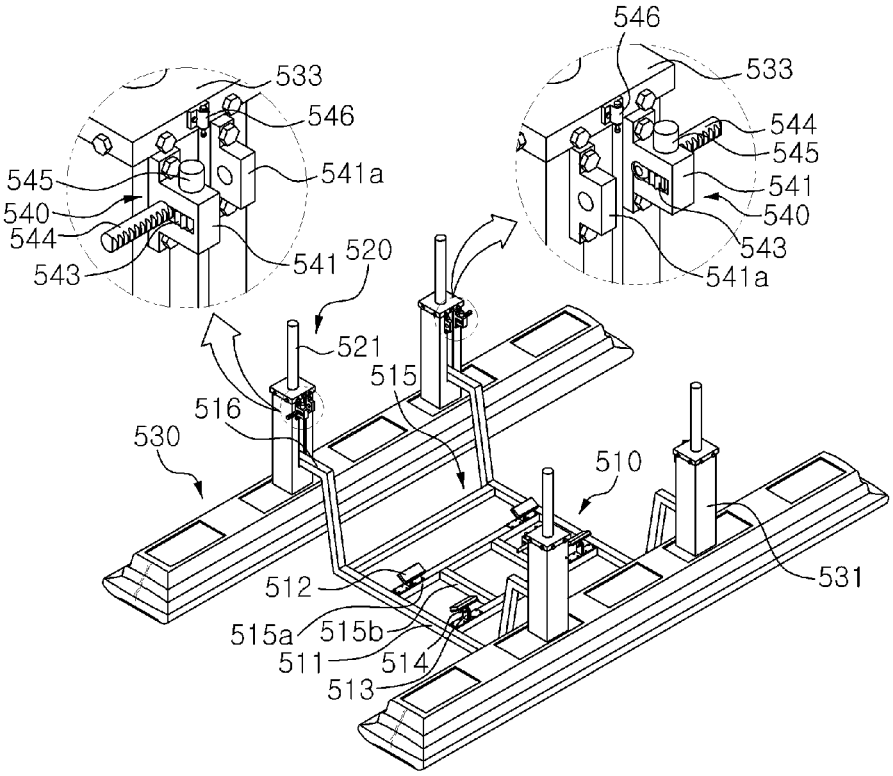

[Fig. 28]
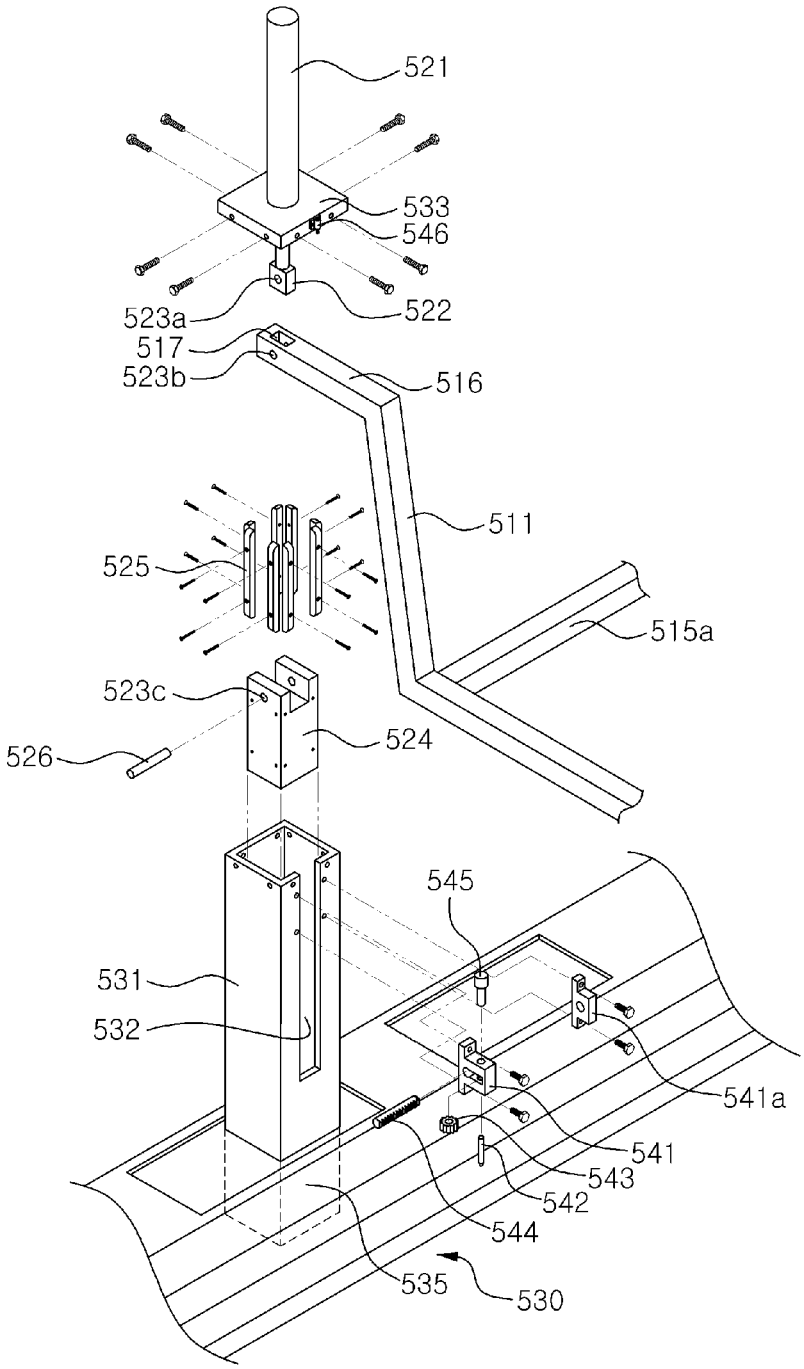

[Fig. 29]
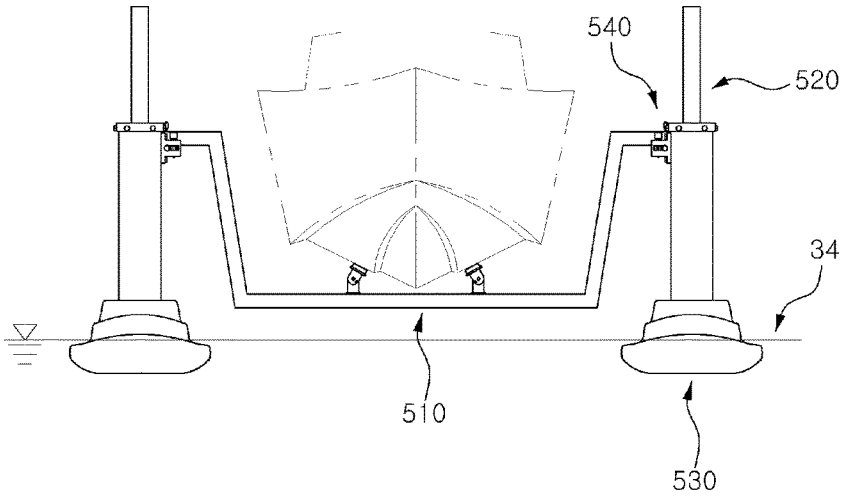
[Fig. 30]
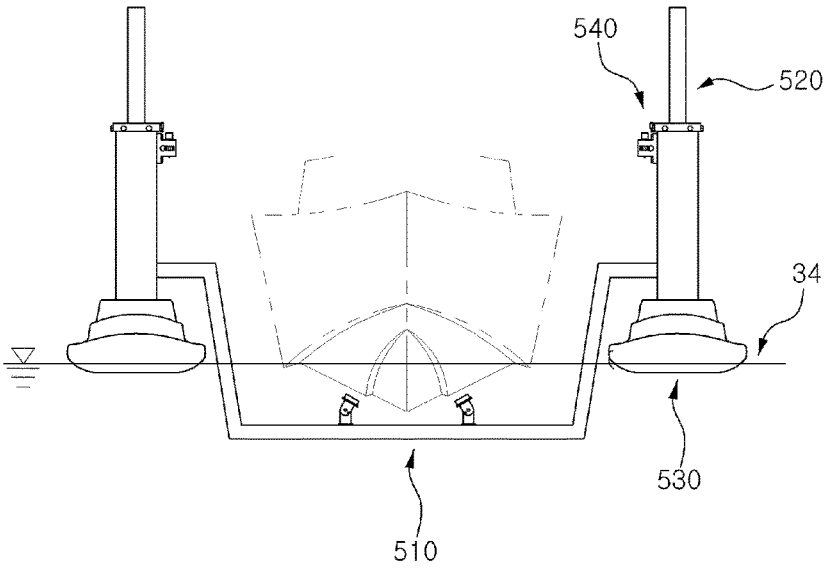
[Fig. 31]
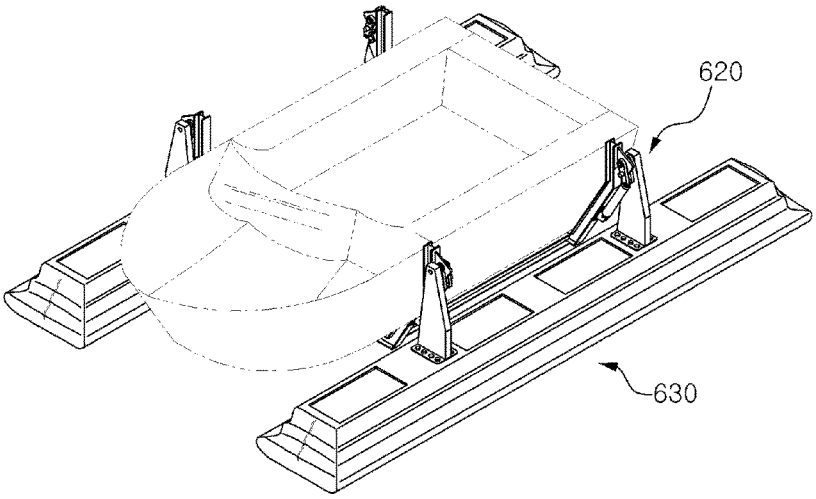

[Fig. 32]
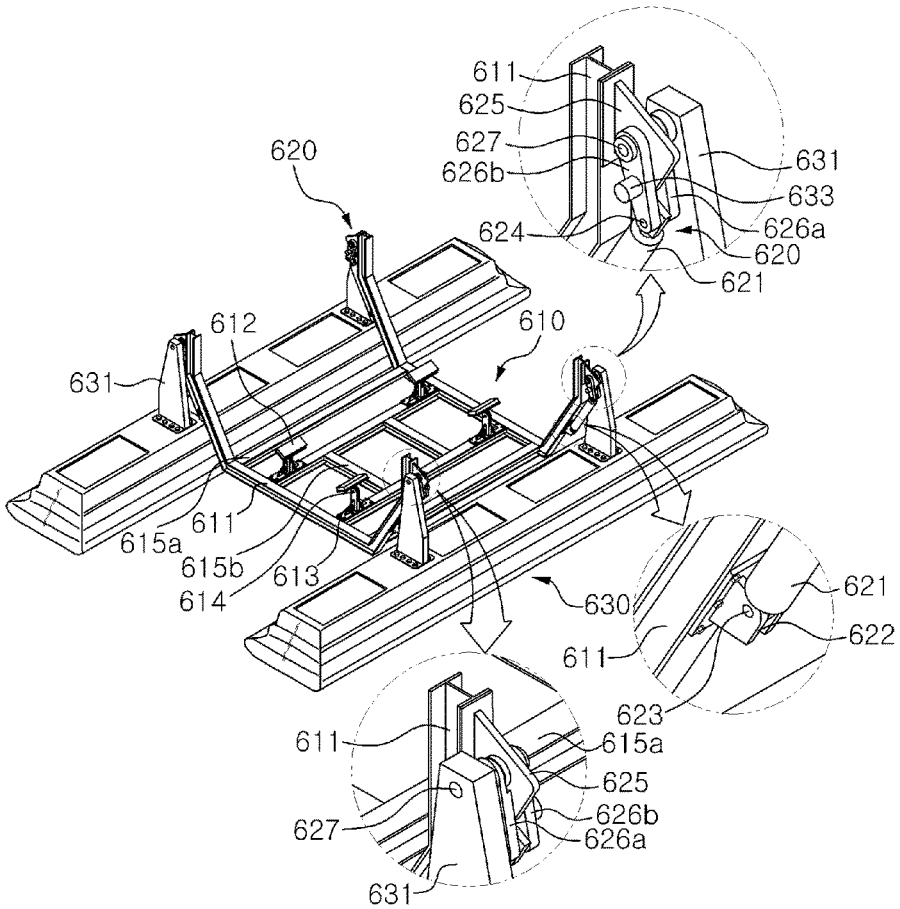
[Fig. 33]
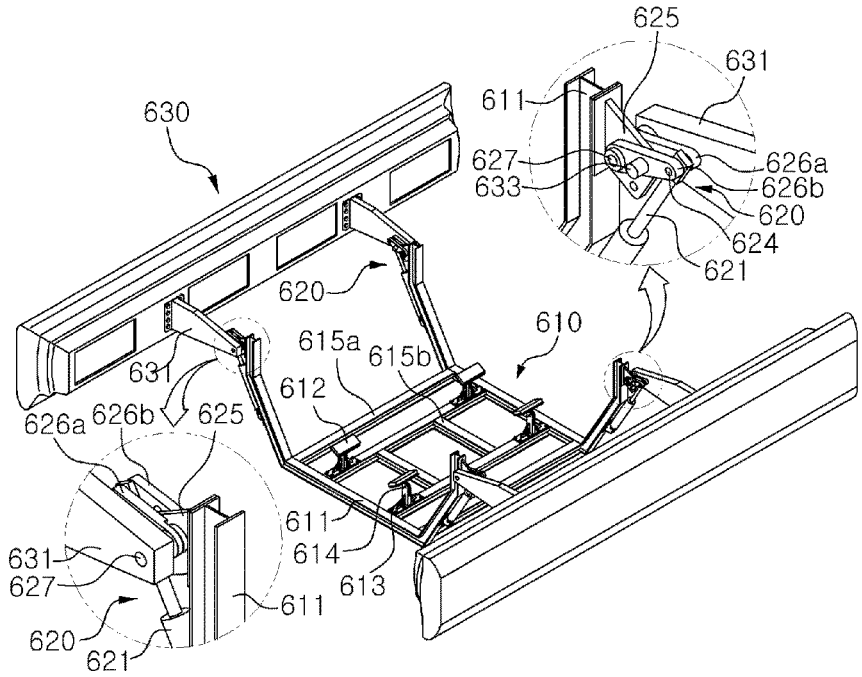

[Fig. 34]
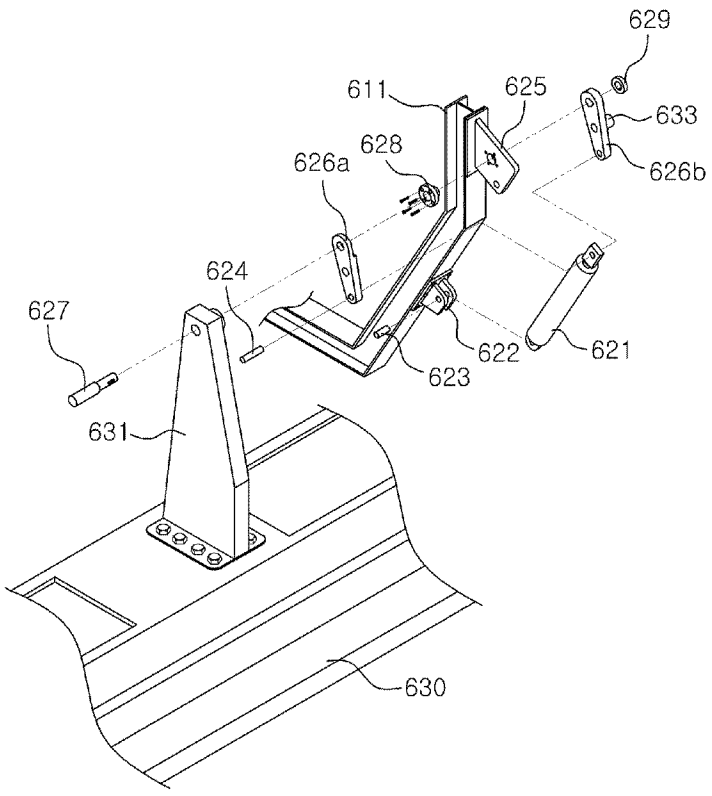
[Fig. 35]
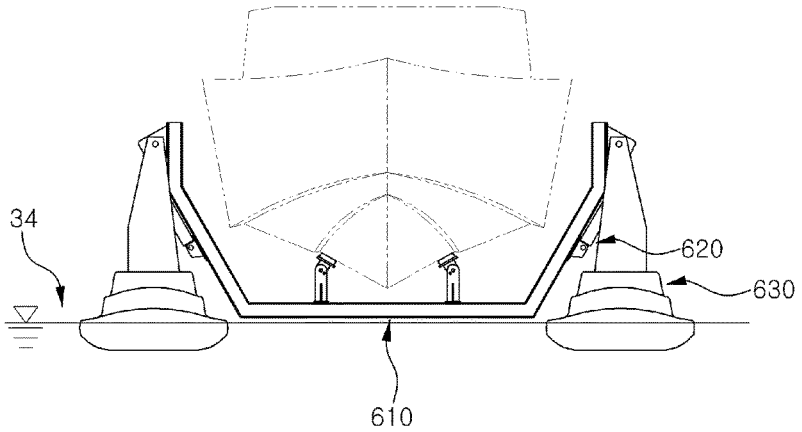
[Fig. 36]
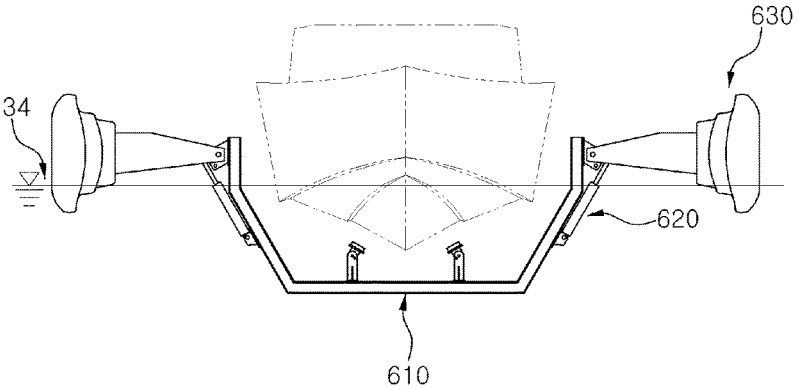

[Fig. 37]
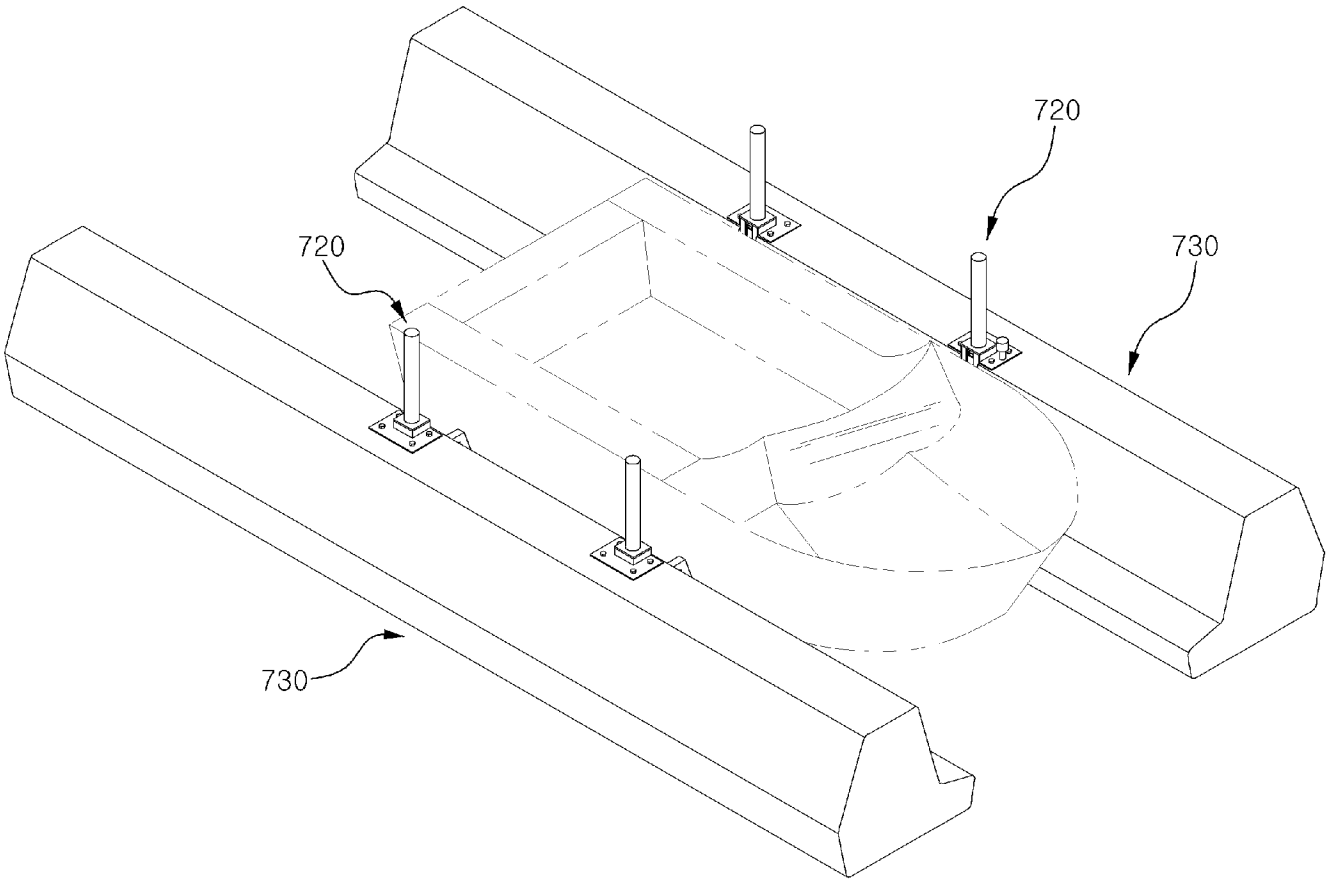

[Fig. 38]
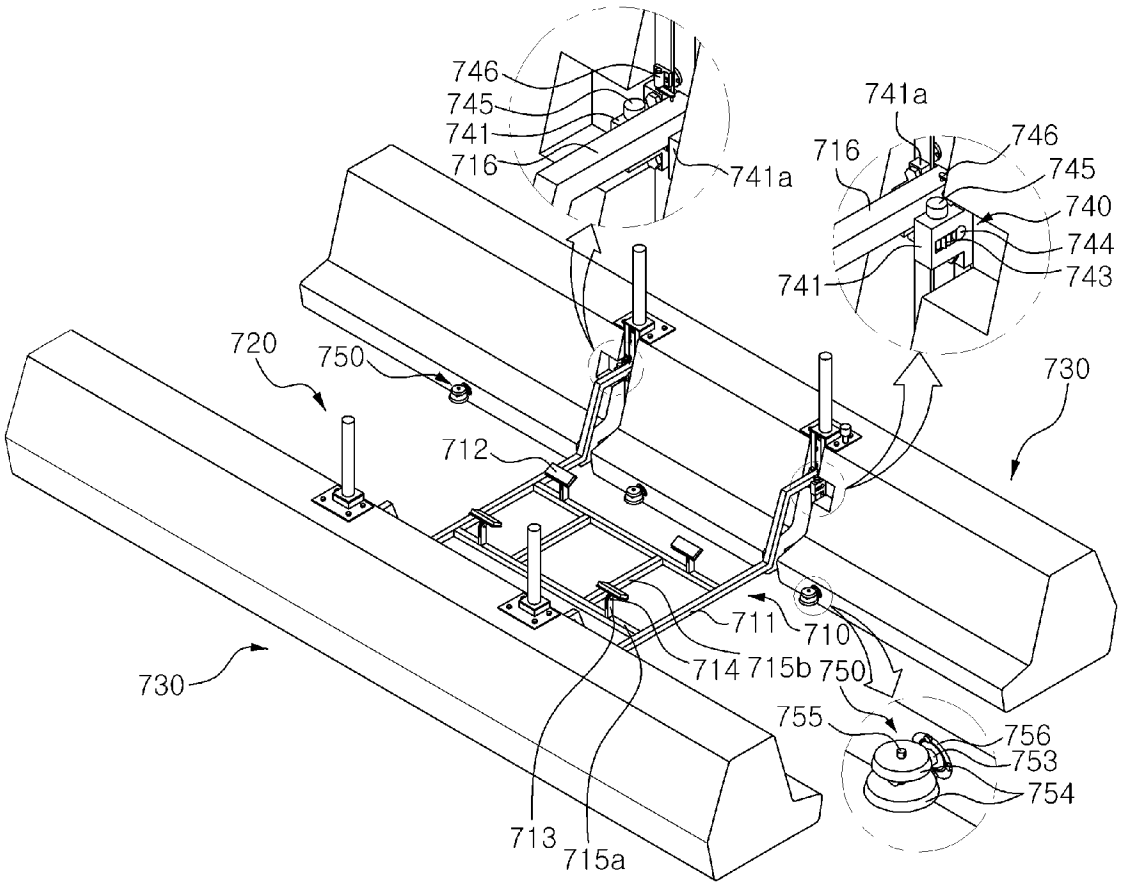

[Fig. 39]
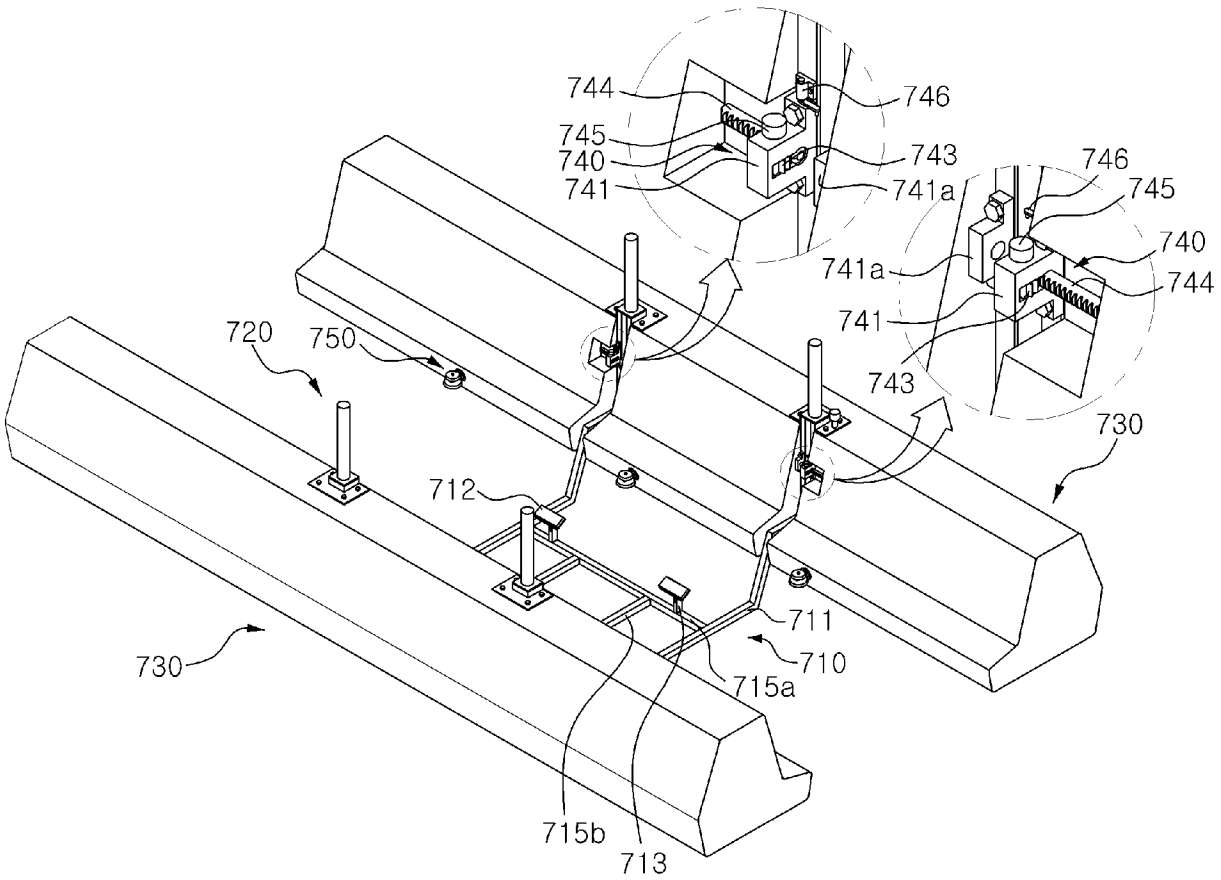

[Fig. 40]
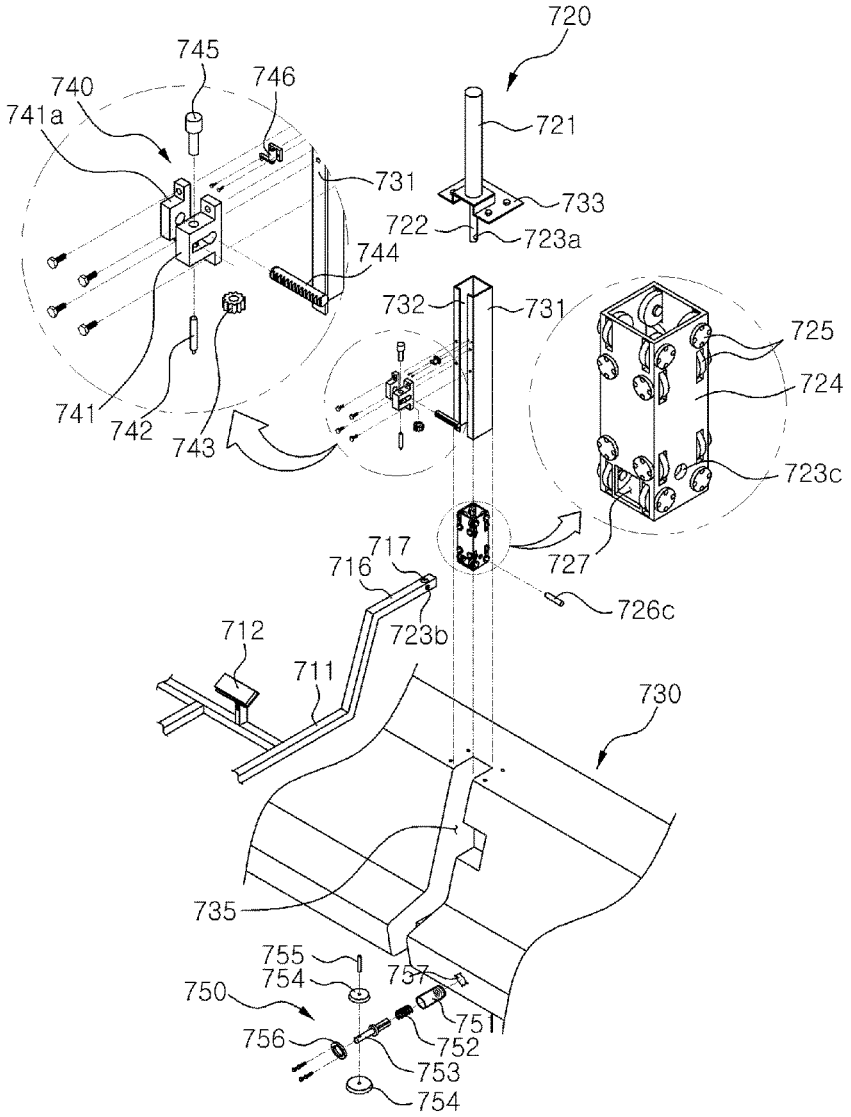
[Fig. 41]
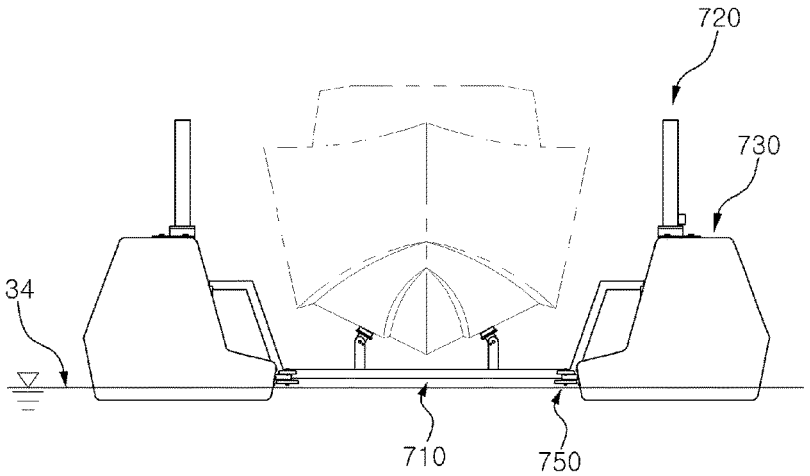

[Fig. 42]
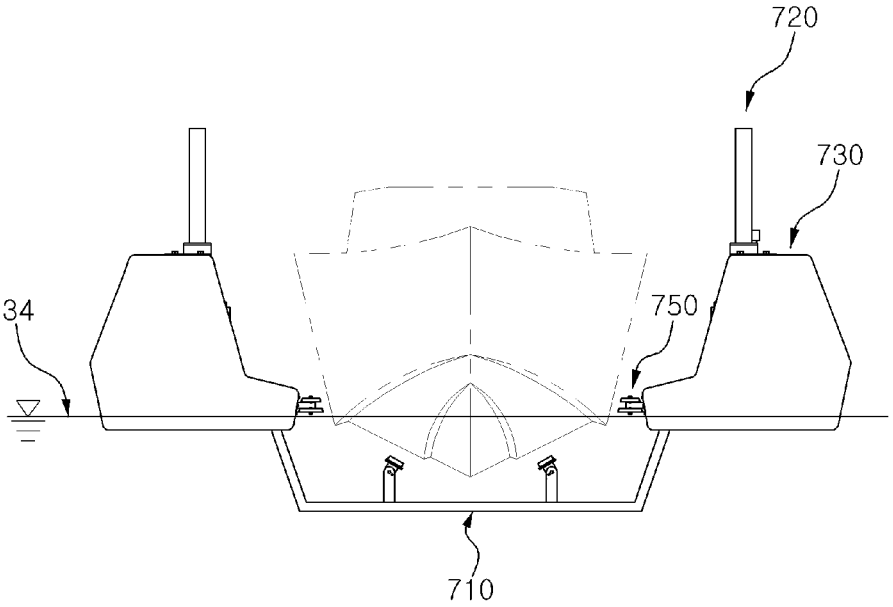

[Fig. 43]
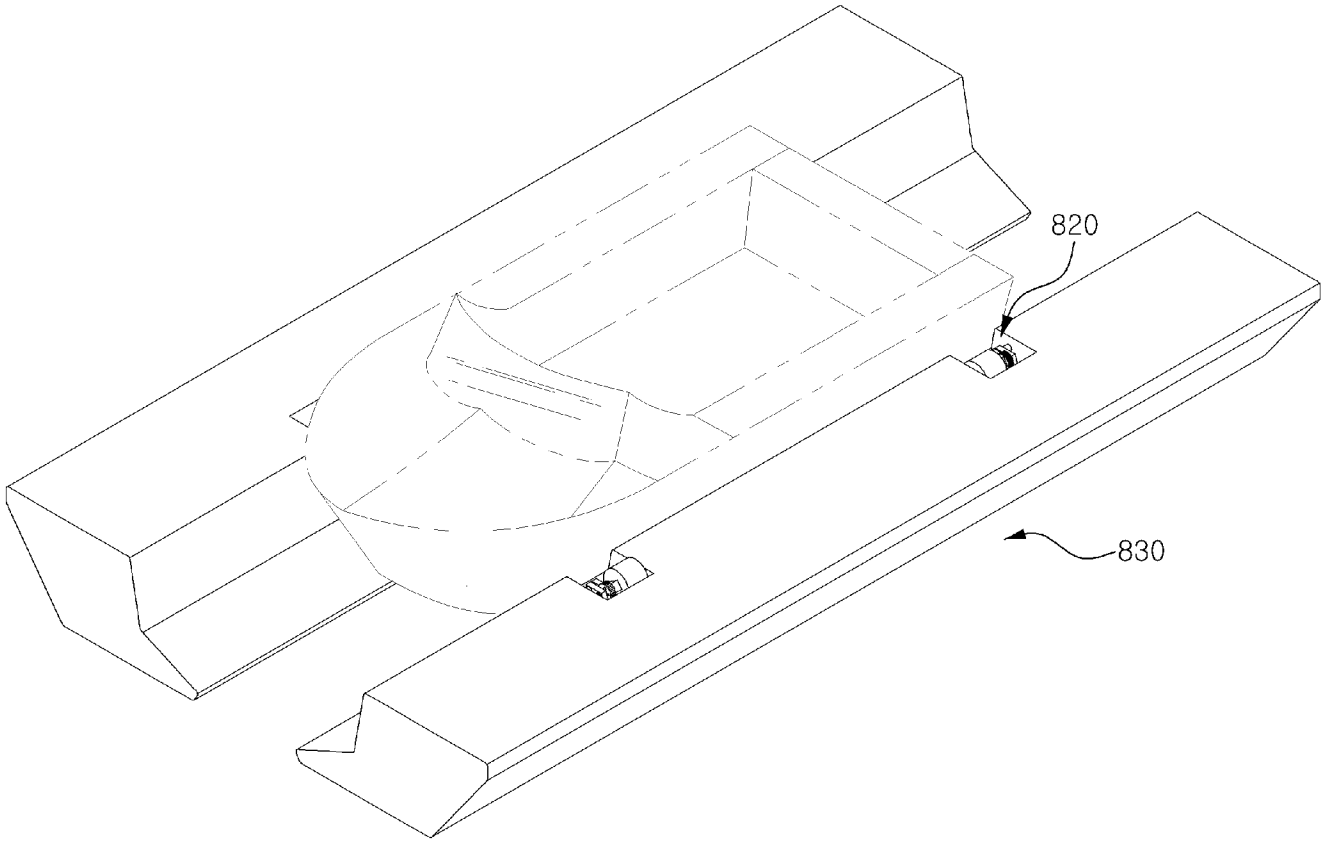

[Fig. 44]
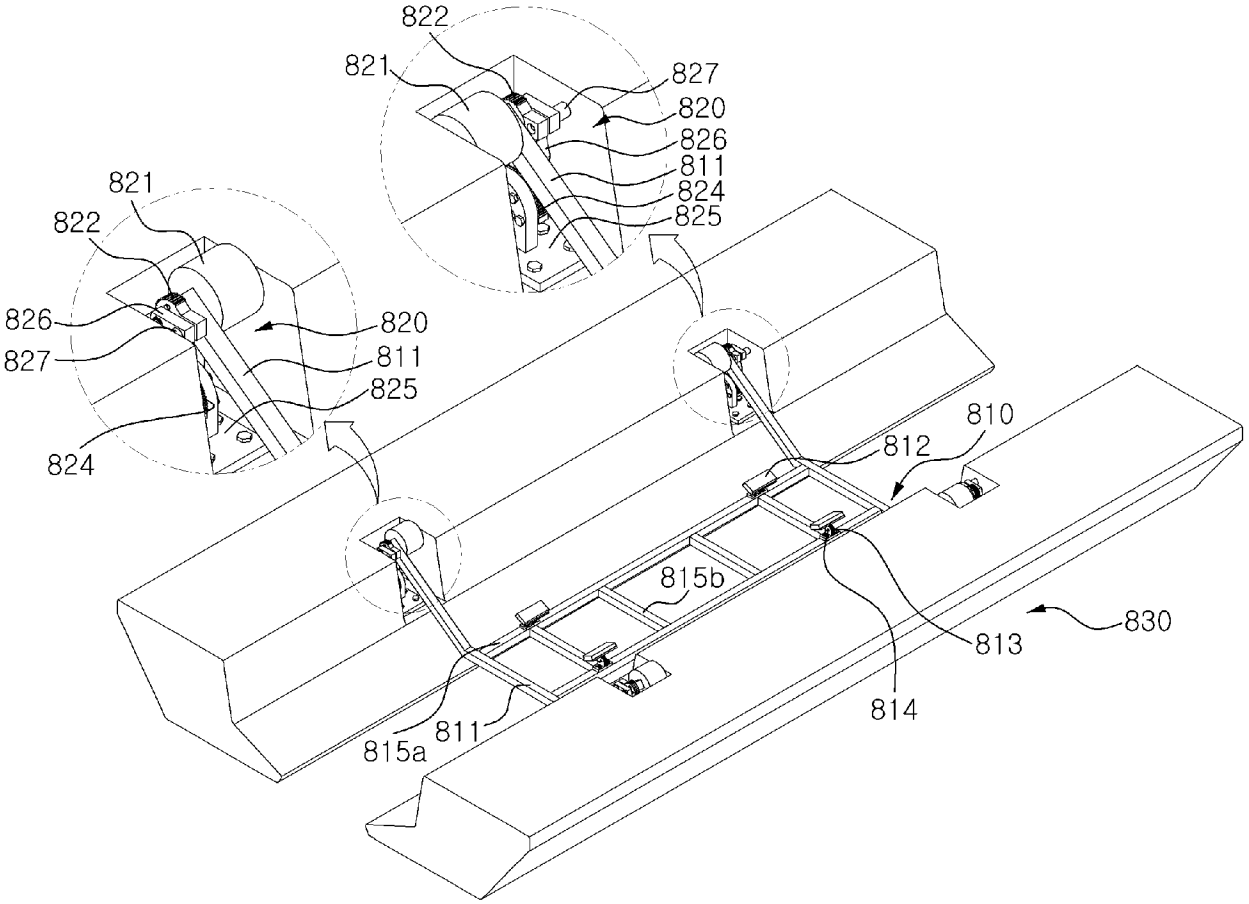

[Fig. 45]
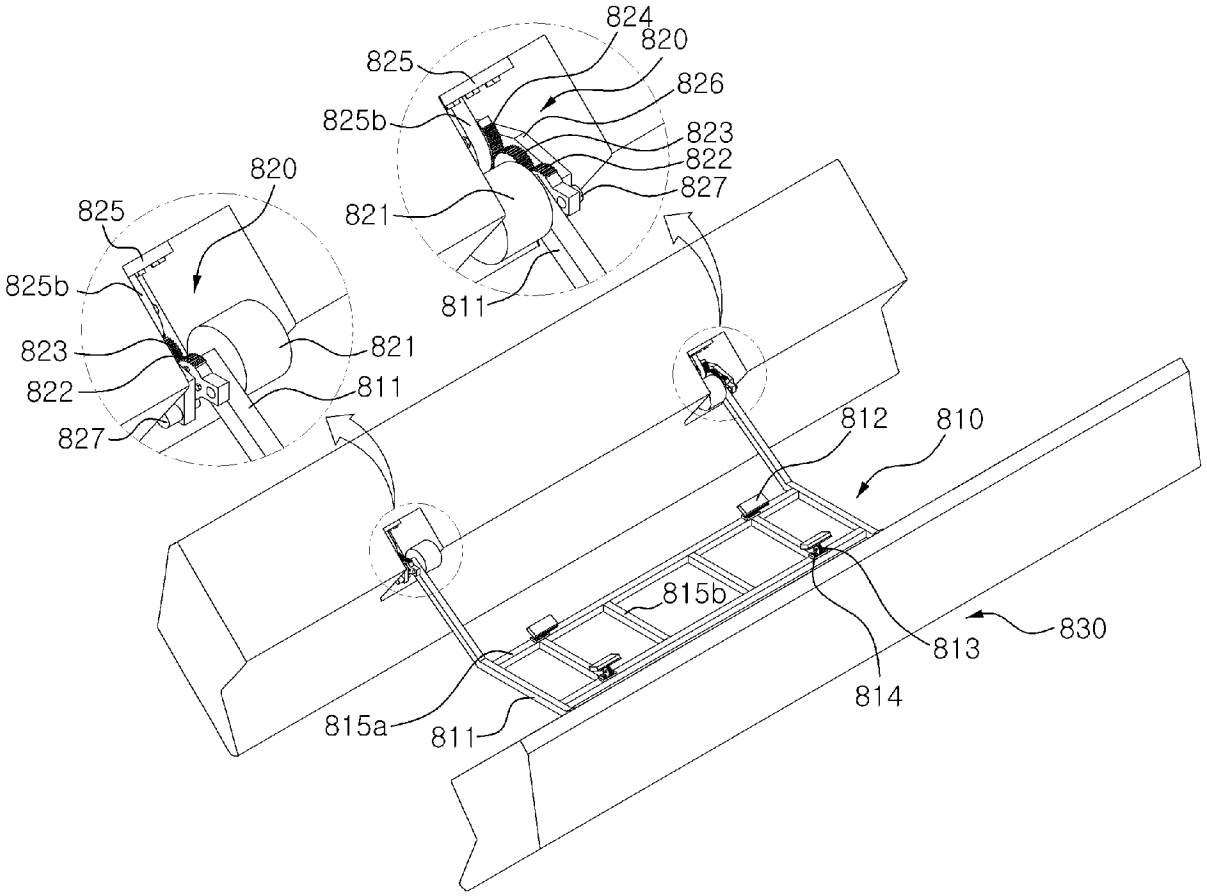

[Fig. 46]
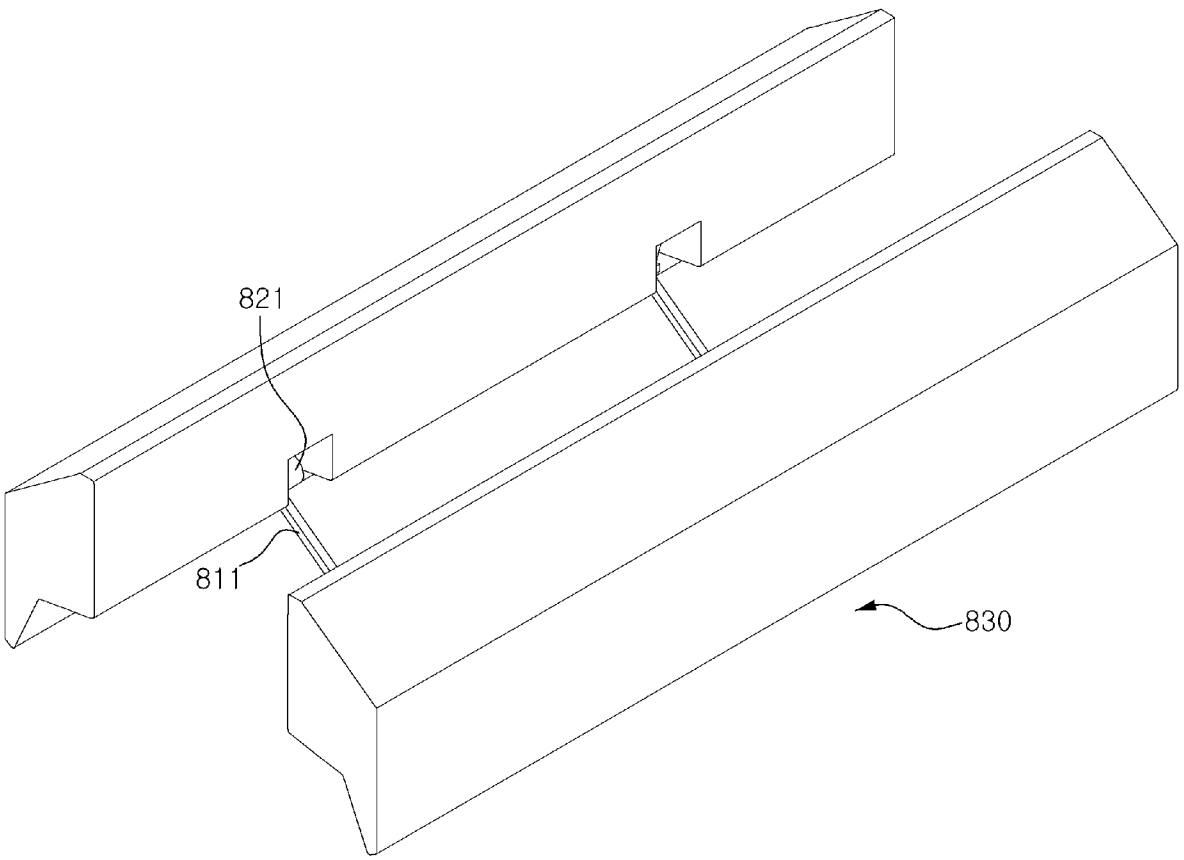

[Fig. 47]
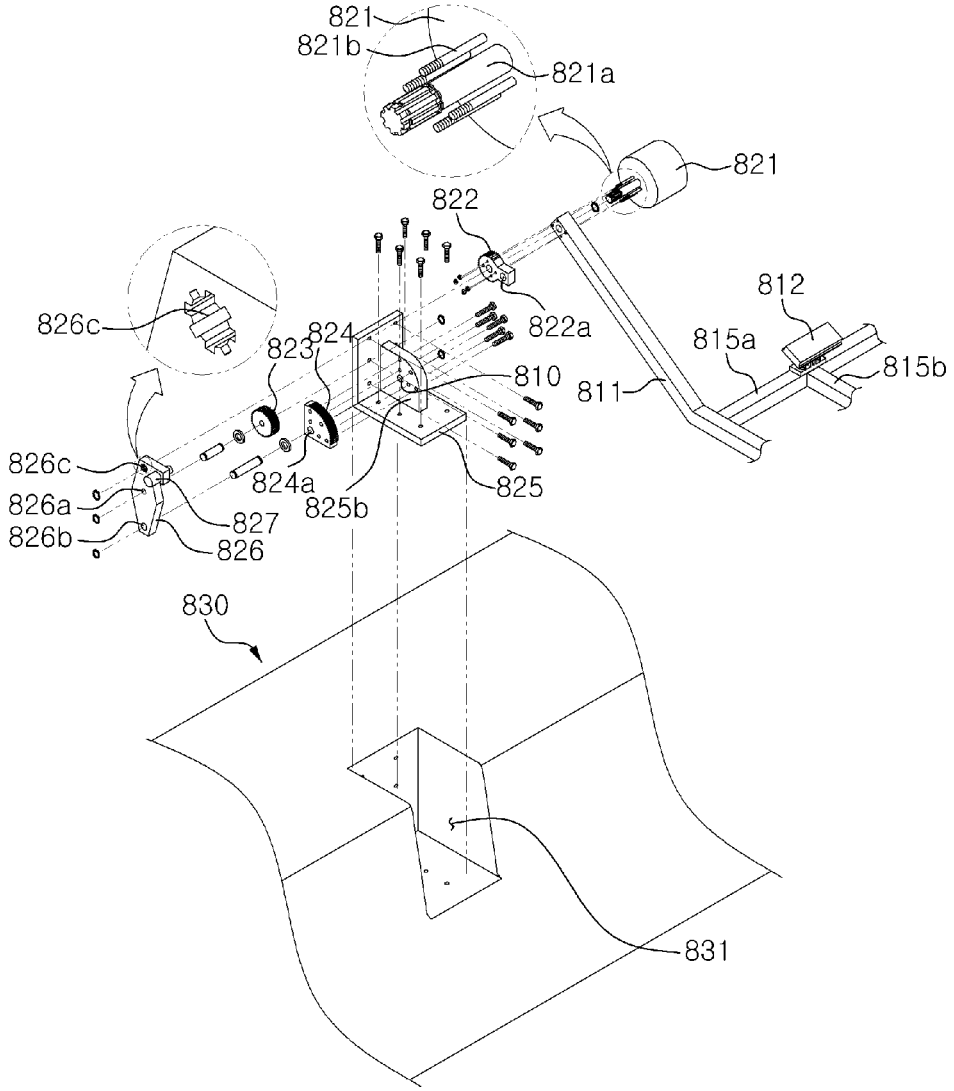

[Fig. 48]
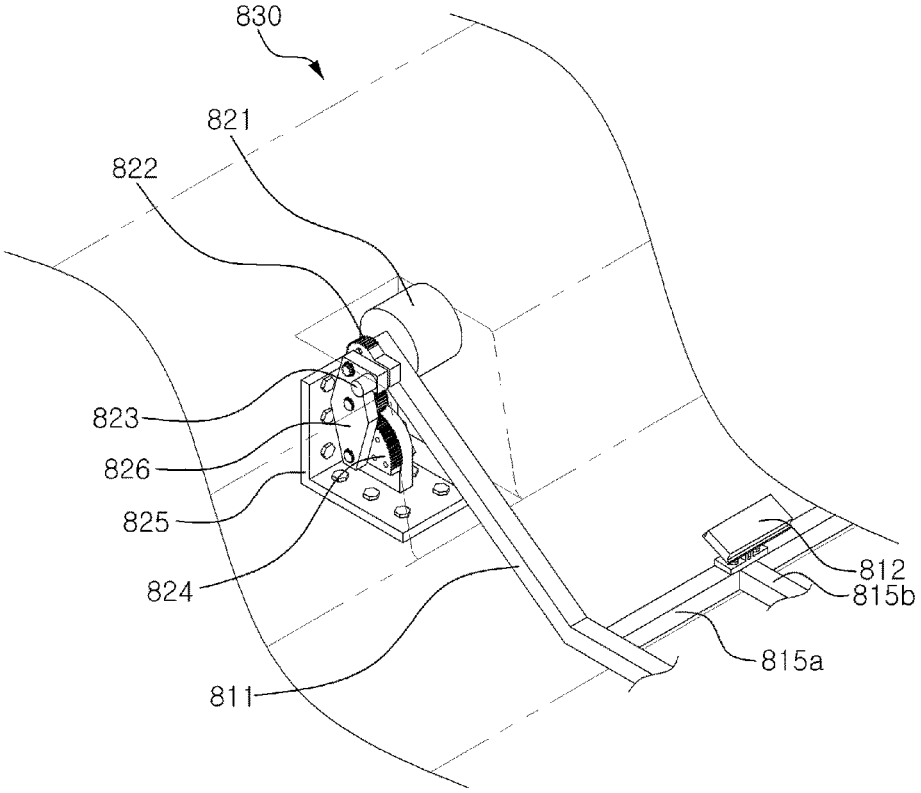
[Fig. 49]
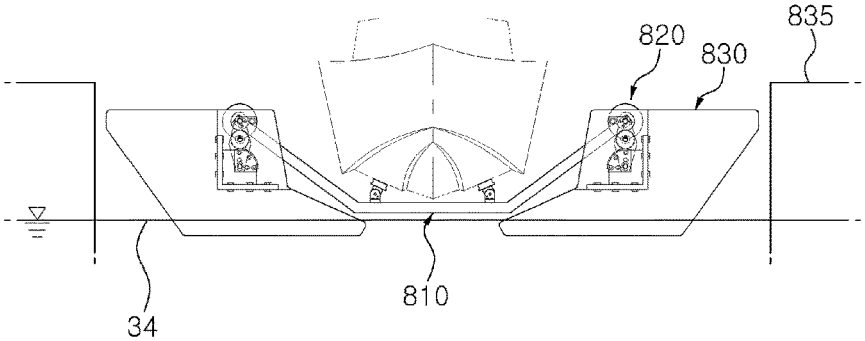
[Fig. 50]
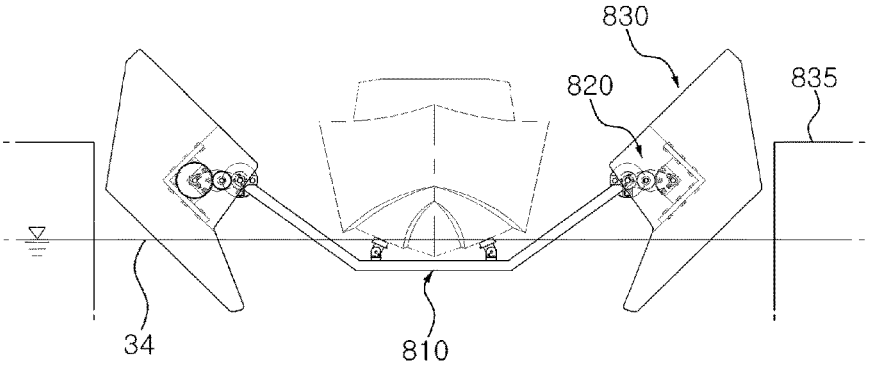

[Fig. 51]
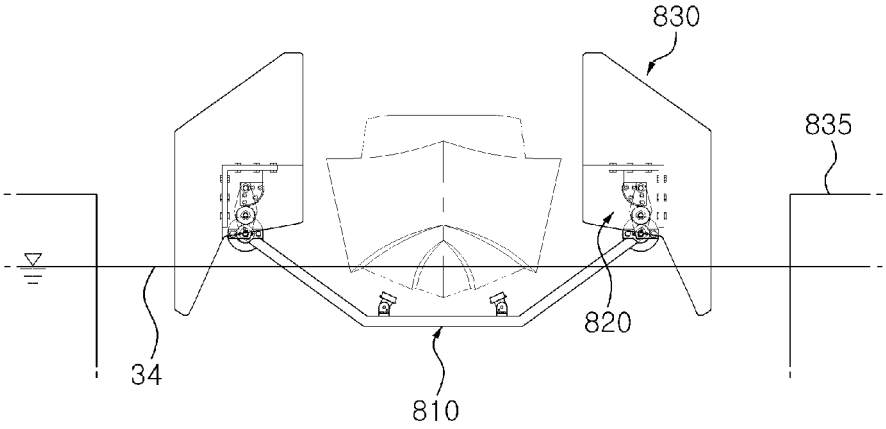

FLOATING BOAT LIFTING APPARATUS FOR RAISING OR LOWERING THE BOAT FROM OR ONTO THE WATER

TECHNICAL FIELD

The present invention relates to a boat lifting apparatus for raising or lowering a watercraft such as motor boat, utility boat, self-assembly rubber boat, fishing craft, cruise yacht, and dinghy yacht from or onto the water.

BACKGROUND ART

Generally, when a watercraft is moored at a berthage, a hull of a watercraft may be subjected to physical damage by wave activity resulting from the wakes of passing watercraft.

Further, when the watercraft is sailed or submerged in water, particularly seawater for long period, about 600 types of marine life including shellfish such as barnacles, mussels and oysters are attached to the submerged hull of the watercraft. Such marine life attached to the hull of the watercraft lower the sailing speed of the watercraft on account of friction between the hull of the watercraft and the water. This may cause a significant problem because more than two times of cost of fuel may be required. In order to protect the hull of the watercraft from the attachment of such marine life the submerged hull of the watercraft was conventionally coated with antifouling paint. However, because most antifouling paint is toxic and causes seawater pollution, its use on the hull of the watercraft is regulated by International Maritime Organization (IMO). Low toxic antifouling paint has been developed in order to address this toxic problem. However, even if the low toxic antifouling paint is coated onto the hull of the watercraft, it may have a short effective life and may bring many problems in connection with the painting work.

The marine life attached to the surface of the hull should be physically removed on a cycle of about two to six months and the removal work entails great expense.

In order to solve or relieve the problems, the watercraft should be raised from the water so that new marine life may not attach to the hull and so that old marine life already attached to the hull may be necrotized, while the watercraft is not sailed and submerged in water for long time. There are many conventional lifting apparatuses to raise the watercraft from the water. However, because most conventional lifting apparatuses are built in platform or under water, they are prone to corrosion. Moreover, most conventional lifting apparatuses cannot adapt to the ebb and flow of the tide.

DISCLOSURE

Technical Problem

U.S. Pat. No. 6,823,809 discloses a conventional floating watercraft lift capable of raising and lowering a watercraft and method thereof. However, a part of the lifting structure is always submerged in water even when the watercraft is fully raised from the water, and thus it is subject to corrosion. Further, the surface portions of the floats that are contacted by the rollers (28) are subject to being worn out on account of repeated contact with the rollers which intensively bear much weight of the watercraft and the lift itself. Accordingly, the durability of the floating watercraft lift is poor. Moreover, the floats shake badly and the movement of the floats is not natural and soft while they rotationally move to raise or lower the watercraft, because the rollers intensively bear much weight of the watercraft, and because the lift itself works only by the lift arm cross beams (32, 33) with the rollers separated from the floats.

Moreover, according to the floating watercraft lift of the prior patent, the hydraulic cylinders (37), the hose connected to the hydraulic cylinders and a part of the lifting structure are always in a submerged state regardless of the lift being in a raised position or lowered position. The submergence of the components of the floating watercraft lift in the water for a prolonged period may lead them to corrosion. Further, the corrosion of the hydraulic cylinder and its hose may cause leakage of the hydraulic oil, and thus pollute the water.

The present inventors have solved the problems, and thus invented a series of novel boat lifting apparatuses.

One object of the invention is to provide a worm gear or hydraulic cylinder-operated floating boat lifting apparatus for raising or lowering the watercraft from or onto the water, wherein no parts of the lifting assembly are submerged in the water when the watercraft is fully raised, the surface portions of the floats are not subjected to wear, and the movement of the floats is natural and soft while they rotationally move to raise or lower the watercraft.

A further object of the present invention is to provide a hydraulic cylinder-operated floating boat lifting apparatus for raising or lowering the watercraft from or onto the water, wherein a radius of rotation of the floats is reduced to make good use of a space and wherein the locking means and the lifting assembly are simplified.

A further object of the present invention is to provide a hydraulic cylinder-operated floating boat lifting apparatus for raising or lowering the watercraft from or onto the water, wherein the floats do not turn to make better use of a space.

A further object of the present invention is to provide a hydraulic cylinder-operated floating boat lifting apparatus for raising or lowering the watercraft from or onto the water, wherein the distance between two floats is greatly reduced to make better use of a space without rotation of the floats and wherein the floats have the rollers to stably guide the watercraft entering and exiting the lifting assembly.

A further object of the present invention is to provide a hydraulic rotor-operated floating boat lifting apparatus for raising or lowering the watercraft from or onto the water, wherein the distance between two floats is constantly maintained when a pair of floats rotationally moved to raise or lower the watercraft even adjacent to an immovable vertical wall or in narrow marina berthing facilities. The utilization of space is optimized like the preceding boat lifting apparatus.

Technical Solution

In accordance with the first embodiment of the present invention, there is provided a watercraft lifting apparatus for raising or lowering the watercraft from or onto the water, comprising the lifting assembly positioned between a pair of floats to receive the watercraft, a pair of U-typed guide structures to guide the floats below or above the water, and a pair of parallel floats longitudinally extended.

In accordance with the first embodiment of the present invention, there is also provided a watercraft lifting apparatus for raising or lowering the watercraft from or onto the water, comprising a lifting assembly positioned between a pair of floats to receive the watercraft, a pair of U-typed guide structures to guide the floats below or above the water, and a pair of parallel floats longitudinally extended, wherein the lifting assembly is inwardly and downwardly configured to receive or support the watercraft and includes a pair of bunks longitudinally extended, a pair of V-typed beams supporting the bunks, a longitudinally extended central beam welded at its edges to the lower part of the V-typed beams, two pairs of arm structure connected to both edges of the V-typed beam through two pairs of the first rotating axle, and two pairs of hydraulic cylinders connected between the second rotating axle positioned below the first rotating axle and the fourth rotating axle of the central beam.

In accordance with the first embodiment of the present invention, there is also provided a watercraft lifting apparatus for raising or lowering the watercraft from or onto the water, wherein the guide structure includes a pair of rollers connected to a brace bolt-united with the float and includes a raised spot in edge of the guide preventing the rollers from leaving the guide structure.

In accordance with the second embodiment of the present invention, there is provided a hydraulic cylinder-operated watercraft lifting apparatus for raising or lowering the watercraft from or onto the water, comprising a lifting assembly positioned between a pair of floats to receive the watercraft, two pairs of hydraulic cylinder assemblies to guide the floats below or above the water, and a pair of parallel floats longitudinally extended.

In accordance with the second embodiment of the present invention, there is also provided a hydraulic cylinder-operated watercraft lifting apparatus for raising or lowering the watercraft from or onto the water, comprising a lifting assembly positioned between a pair of parallel floats to receive the watercraft, two pairs of hydraulic cylinder assemblies to guide the floats below or above the water, and a pair of parallel floats longitudinally extended, wherein each hydraulic cylinder assembly comprises a hydraulic cylinder connected between the third rotating axle which is attached to a protrusion formed on one end of the frame and the first rotating axle which is attached to the top of the floats, the first support which is attached to the bottom of the protrusion of the frame, the second support attached to the top of the floats, the second rotating axle connecting the first support and the second support, and the first rotating axle connecting the second support and the hydraulic cylinder.

In accordance with the second embodiment of the present invention, there is also provided a hydraulic cylinder-operated watercraft lifting apparatus for raising or lowering the watercraft from or onto the water, further comprising a locking means comprising the third support bolt-clamped with one side of the first support of the frame, the fourth support attached to the above of the floats, and a solenoid for locking the third support and the fourth support.

In accordance with the third embodiment of the present invention, there is provided a worm gear-operated watercraft lifting apparatus for raising or lowering the watercraft from or onto the water, comprising a lifting assembly positioned between a pair of parallel floats to receive the watercraft; two pairs of worm gear assemblies to guide the floats below or above the water, and the pair of parallel floats longitudinally extended.

In accordance with the third embodiment of the present invention, there is also provided a worm gear-operated watercraft lifting apparatus for raising or lowering the watercraft from or onto the water, comprising a lifting assembly positioned between a pair of parallel floats to receive the watercraft; two pairs of worm gear assemblies to guide the floats below or above the water, and the pair of parallel floats longitudinally extended, wherein the worm gear assembly comprises a first support which attached to the protrusion formed on both ends of the U-typed frame; a worm wheel connected to the rotating axle in the hole formed on one end of the first support; a worm connected to a saw teeth of the worm wheel; a worm axle; a motor connected to the worm axle; the second support which is connected by the rotating axle of the first support and attached to the above of the floats; and a housing which envelops the worm wheel, the worm and the worm axle, and is attached to the side of the protrusion of the U-typed frame.

In accordance with the third embodiment of the present invention, there is also provided a worm gear-operated watercraft lifting apparatus for raising or lowering the watercraft from or onto the water, further comprising a locking means comprising the third support attached to the protrusion of the both ends of the U-typed frame, the fourth support attached to the above of the floats, and a solenoid for locking or unlocking a third support and a fourth support by a hole formed on one end of the third support and a solenoid pin.

In accordance with the fourth embodiment of the present invention, there is provided a hydraulic cylinder-operated watercraft lifting apparatus for raising or lowering the watercraft from or onto the water, comprising a lifting assembly positioned between a pair of parallel floats to receive the watercraft; two pairs of hydraulic cylinder assemblies to guide the floats below or above the water; and the pair of parallel floats longitudinally extended.

In accordance with the fourth embodiment of the present invention, there is also provided a hydraulic cylinder-operated watercraft lifting apparatus for raising or lowering the watercraft from or onto the water, comprising a lifting assembly positioned between a pair of parallel floats to receive the watercraft; two pairs of hydraulic cylinder assemblies to guide the floats below or above the water; and the pair of parallel floats longitudinally extended, wherein the hydraulic cylinder assembly comprises a hydraulic cylinder, the first support connected to one end of the hydraulic cylinder by the first rotating axle, an arm wherein the one end of the arm is connected to the other end of the hydraulic cylinder by the second rotating axle and the other end of the arm is integrally fixed with the upper part of the floats support, and a second support which has a hole to turn the arm around in and is attached to the U-typed frame.

In accordance with the fourth embodiment of the present invention, there is also provided a hydraulic cylinder-operated watercraft lifting apparatus for raising or lowering the watercraft from or onto the water, wherein the lifting assembly comprises a pair of U-typed frames with their ends being vertically formed, a beam having a pair of cross beams and a pair of longitudinal beams for connecting the U-typed frames to each other, and multiple bunks inwardly and downwardly configured to receive or support the watercraft and being able to be rotated by the hinge pin of the multiple supports which are welded to the pair of cross beams.

In accordance with the fourth embodiment of the present invention, there is also provided a hydraulic cylinder-operated watercraft lifting apparatus for raising or lowering the watercraft from or onto the water, further comprising a solenoid as a locking means which is attached to the middle of the arm and latches the arm to the second support so that the pin of the solenoid may enter the hole of the second support.

In accordance with the fifth embodiment of the present invention, there is provided a nonrotational-float watercraft lifting apparatus for raising or lowering the watercraft from or onto the water, comprising a lifting assembly positioned between a pair of parallel floats to receive the watercraft;

two pairs of hydraulic cylinder assemblies to guide the floats below or above the water; and the pair of parallel floats longitudinally extended.

In accordance with the fifth embodiment of the present invention, there is also provided a nonrotational-float watercraft lifting apparatus for raising or lowering the watercraft from or onto the water, comprising a lifting assembly positioned between a pair of parallel floats to receive the watercraft; two pairs of hydraulic cylinder assemblies to guide the floats below or above the water; and the pair of parallel floats longitudinally extended, wherein the hydraulic cylinder assembly comprises a hydraulic cylinder, a bracket sliding in the inside of the cylindrical pillar and eight sleeves installed on the outside edges for guiding sliding movement of the bracket.

In accordance with the fifth embodiment of the present invention, there is also provided a nonrotational-float watercraft lifting apparatus for raising or lowering the watercraft from or onto the water, wherein a hydraulic cylinder is inserted to a slot formed in the tip of a frame by a connecting member, and is connected to the frame by a pin through a pin hole of the connecting member, a pin hole of the frame, and a pin hole of a bracket.

In accordance with the fifth embodiment of the present invention, there is also provided a nonrotational-float watercraft lifting apparatus for raising or lowering the watercraft from or onto the water, wherein an upper part of a bracket has a groove to receive a tip of a frame, and two protrusions have a pin hole to receive a pin and have bolt holes to bolt-clamp a sleeve.

In accordance with the fifth embodiment of the present invention, there is also provided a nonrotational-float watercraft lifting apparatus for raising or lowering the watercraft from or onto the water, wherein eight sleeves are bolt-clamped to four (4) outside edges of the bracket for guiding the sliding movement of the bracket and coated with PE plastics, ceramics or Teflon to reduce friction and increase durability.

In accordance with the fifth embodiment of the present invention, there is also provided a nonrotational-float watercraft lifting apparatus for raising or lowering the watercraft from or onto the water, wherein an area of an upper surface of the floats is greater than an area of a lower surface, an inward surface of the floats is curved, a rectangular trough is formed to the middle of its height in the float to receive a cylindrical pillar, the float has two cylindrical pillars which each have a slit opened in their upper portions and have bolt holes to install a locking means and to hold a cover, and the cover has a hole through which the hydraulic cylinder penetrates, its lower part being opened, the bolt holes corresponding to the those of the pillar in four side surfaces of the cover, and a limit switch to stop the raising of the frame.

In accordance with the fifth embodiment of the present invention, there is also provided a nonrotational-float watercraft lifting apparatus for raising or lowering the watercraft from or onto the water, wherein the cylindrical pillar is extended and fixed to the bottom the floats.

In accordance with the fifth embodiment of the present invention, there is also provided a nonrotational-float watercraft lifting apparatus for raising or lowering the watercraft from or onto the water, further comprising a pinion gear-typed locking means which is installed in the upper part of the slit of the cylindrical pillar, wherein the locking means comprises the first bracket consisting of a toothed gear, a toothed bar functioning as a safety pin, a rotating axle of the toothed gear, and the motor driving the rotating axle; the second bracket having the holes for inserting the toothed bar; and a limit switch installed on the cover to stop the raising of the frame.

In accordance with the sixth embodiment of the present invention, there is provided a frame-improved hydraulic cylinder-operated watercraft lifting apparatus for raising or lowering the watercraft from or onto the water, comprising the lifting assembly positioned between a pair of parallel floats to receive the watercraft; two pairs of hydraulic cylinder assemblies to guide the floats below or above the water; and the pair of parallel floats longitudinally extended.

In accordance with the sixth embodiment of the present invention, there is also provided a frame-improved hydraulic cylinder-operated watercraft lifting apparatus for raising or lowering the watercraft from or onto the water, comprising a lifting assembly positioned between a pair of parallel floats to receive the watercraft; two pairs of hydraulic cylinder assemblies to guide the floats below or above the water; and the pair of parallel floats longitudinally extended, wherein the hydraulic cylinder assembly comprises a hydraulic cylinder, the first support connected to one end of the hydraulic cylinder through the first rotating axle, arm wherein one end of the arm is connected to the other end of the hydraulic cylinder through the second rotating axle and the other end of the arm is connected to the tip of the float support, and the second support which is attached to the outer surface of the upright upper end of the U-typed frame and a hole for inserting an arm axle through which the arm turns is provided.

In accordance with the sixth embodiment of the present invention, there is also provided a frame-improved hydraulic cylinder-operated watercraft lifting apparatus for raising or lowering the watercraft from or onto the water, wherein the lifting assembly comprises a pair of U-typed frames which is outwardly inclined from the bottom and then upright from the end of the inclined part, a beam consisting of a pair of cross beam and a pair of longitudinal beam for connecting a pair of U-typed frames each other, and multiple bunks inwardly and downwardly configured to receive or support the watercraft and being able to be rotated by the hinge pin of the multiple supports which are melted to a pair of cross beam.

In accordance with the sixth embodiment of the present invention, there is also provided a frame-improved hydraulic cylinder-operated watercraft lifting apparatus for raising or lowering the watercraft from or onto the water, wherein the area of the upper surface of the floats is greater than the area of the lower surface, the inward of the floats is curved, and the float has two supports and a hole is formed in the upper end of the support for inserting an arm axle.

In accordance with the sixth embodiment of the present invention, there is also provided a frame-improved hydraulic cylinder-operated watercraft lifting apparatus for raising or lowering the watercraft from or onto the water, further comprising a solenoid as a locking means which is attached to the middle of the arm and latches the arm to the second support so that the pin of the solenoid may enter the hole of the second support.

In accordance with the seventh embodiment of the present invention, there is provided a nonrotational-float watercraft lifting apparatus for raising or lowering the watercraft from or onto the water, comprising a lifting assembly positioned between a pair of parallel floats to receive the watercraft; two pairs of hydraulic cylinder assemblies to guide the floats below or above the water; and the pair of parallel floats longitudinally extended In accordance with the seventh embodiment of the present invention, there is also provided a nonrotational-float watercraft lifting apparatus for raising or lowering the watercraft from or onto the water, comprising the lifting assembly positioned between a pair of parallel floats to receive the watercraft; two pairs of hydraulic cylinder assemblies to guide the floats below or above the water; and the pair of parallel floats longitudinally extended, wherein the frames are embedded in the floats and the hydraulic cylinder assembly comprises a hydraulic cylinder, a bracket sliding in the inner part of the cylindrical pillar, and he rollers installed on four side surfaces for guiding the sliding movement of the bracket.

In accordance with the seventh embodiment of the present invention, there is also provided a nonrotational-float watercraft lifting apparatus for raising or lowering the watercraft from or onto the water, wherein the hydraulic cylinder is inserted to the hole formed in the tip of the U-typed frame by the connecting member, and is connected to the frame by the pin through the pin hole of the connecting member, the pin hole of the frame, and the pin hole of the bracket.

In accordance with the seventh embodiment of the present invention, there is also provided a nonrotational-float watercraft lifting apparatus for raising or lowering the watercraft from or onto the water, wherein a hole for inserting the tip of the frame and the pin hole for inserting the pin are provided in the lower part of the bracket, and the rollers are installed on four side surfaces for guiding the sliding movement of the bracket.

In accordance with the seventh embodiment of the present invention, there is also provided a nonrotational-float watercraft lifting apparatus for raising or lowering the watercraft from or onto the water, wherein the area of the upper surface of the floats is greater than the area of the lower surface, the inward of the floats is curved, an inclined part and the tip of the U-typed frame are vertically raised or lowered through the cut groove of the float formed to the middle of its height in the float so that the toothed bar may be able to move back and forth, and the cylindrical pillar is installed in the groove.

In accordance with the seventh embodiment of the present invention, there is also provided a nonrotational-float watercraft lifting apparatus for raising or lowering the watercraft from or onto the water, wherein the cylindrical pillar comprises the bolt holes in the middle of the pillar for installing a locking means and a limit switch, the cover covering the top of the pillar has a hole through which the hydraulic cylinder pass and the bolt holes for uniting the cover to the top of the float, and a limit switch is installed above the first locking bracket bolted in the pillar.

In accordance with the seventh embodiment of the present invention, there is also provided a nonrotational-float watercraft lifting apparatus for raising or lowering the watercraft from or onto the water, further comprising a pinion gear-typed locking means installed in the pillar, wherein the locking means comprises the first bracket consisting of a toothed gear, a toothed bar functioning as a safety pin, a rotating axle of the toothed gear, and the motor driving the rotating axle; the second bracket having the holes for inserting the toothed bar; and a limit switch installed in the pillar to stop the raising of the frame.

In accordance with the seventh embodiment of the present invention, there is also provided a nonrotational-float watercraft lifting apparatus for raising or lowering the watercraft from or onto the water, wherein the guiding rollers is installed in the hole positioned below the lower part of the float and above the waterline, and consists of tween rollers wherein an upper roller is smaller than a lower roller and its side surfaces are configured to be inclined, a roller axle wherein one end of the axle includes a hole for inserting the roller pin and the other end of the axle is quadrangle figured for the axle no to be rotated, a spring for accommodating various width of the watercrafts, a housing enclosing the spring and the roller axle, and a fixing member for bolt-clamping the housing to the floats.

In accordance with the eighth embodiment of the present invention, there is provided a hydraulic rotor-operated watercraft lifting apparatus for raising or lowering the watercraft from or onto the water, comprising the lifting assembly positioned between a pair of parallel floats to receive the watercraft; two pairs of hydraulic cylinder assemblies to guide the floats below or above the water; and the pair of parallel floats longitudinally extended.

In accordance with the eighth embodiment of the present invention, there is also provided a hydraulic rotor-operated watercraft lifting apparatus for raising or lowering the watercraft from or onto the water, comprising a lifting assembly positioned between a pair of parallel floats to receive the watercraft; two pairs of hydraulic cylinder assemblies to guide the floats below or above the water; and the pair of parallel floats longitudinally extended, wherein the hydraulic rotor assembly consisting of a hydraulic rotor; a main gear; an idle gear; a fan-shaped gear; a bracket fixed in the groove of the float; and an arm.

In accordance with the eighth embodiment of the present invention, there is also provided a hydraulic rotor-operated watercraft lifting apparatus for raising or lowering the watercraft from or onto the water, wherein the hydraulic rotor comprises a shaft including saw teeth in one end of the shaft and supporting rods spiraled at one end thereof to fix the arm.

In accordance with the eighth embodiment of the present invention, there is also provided a hydraulic rotor-operated watercraft lifting apparatus for raising or lowering the watercraft from or onto the water, wherein the main gear bolt-clamped to the hydraulic rotor through the hole formed in one end of the U-typed frame includes saw teeth in its outer circumference surface, the hole for inserting a pin of the solenoid as a locking means and a center hole for inserting a shaft of the hydraulic rotor, the saw teeth being interconnected with the saw teeth formed in outer circumference surface of the idle gear, and the saw teeth being interconnected with the saw teeth of the fan-shaped gear.

In accordance with the eighth embodiment of the present invention, there is also provided a hydraulic rotor-operated watercraft lifting apparatus for raising or lowering the watercraft from or onto the water, wherein the idle gear includes saw teeth in its outer circumference surface, the rotating axle of the idle gear being inserted in the hole of the arm through the hole, and the rotating axle of the idle gear being inserted in the hole of the arm.

In accordance with the eighth embodiment of the present invention, there is also provided a hydraulic rotor-operated watercraft lifting apparatus for raising or lowering the watercraft from or onto the water, wherein the fan-shaped gear is bolt-clamped to the supporting panel through the holes formed in both idle gear and supporting panel, the rotating axle of the idle gear being inserted through the hole of the fan-shaped gear, the hole of the bracket and the hole of the arm.

In accordance with the eighth embodiment of the present invention, there is also provided a hydraulic rotor-operated watercraft lifting apparatus for raising or lowering the watercraft from or onto the water, wherein the modules of the idle gear and the fan-shaped gear are set so that the fan-shaped gear may turns 45 degree when the idle gear turns 90 degree.

In accordance with the eighth embodiment of the present invention, there is also provided a hydraulic rotor-operated watercraft lifting apparatus for raising or lowering the watercraft from or onto the water, wherein the bracket as ㄴ-shaped panel includes a supporting panel in which multiple holes for inserting the bolts are formed, and is bolt-clamped to the wall of the groove formed in the float.

In accordance with the eighth embodiment of the present invention, there is also provided a hydraulic rotor-operated watercraft lifting apparatus for raising or lowering the watercraft from or onto the water, wherein the arm includes a saw teeth-shaped hole to be interconnected with the saw teeth formed in one end of the shaft, a hole for inserting the rotating axle of the idle gear and a hole for inserting a rotating axle of the fan-shaped gear, and further comprising a solenoid as a locking means.

In accordance with the eighth embodiment of the present invention, there is also provided a hydraulic rotor-operated watercraft lifting apparatus for raising or lowering the watercraft from or onto the water, wherein the area of the upper surface of the floats is greater than the area of the lower surface, the inward of the floats is curved, and two grooves for accommodating the tip of the U-typed frame, bracket and hydraulic rotor assembly are formed in the float.

Advantageous Effects

The lower parts of the lifting assemblies of the boat lifting apparatuses according to the present invention are not submerged when the watercraft is completely raised above the water, the places of the floats on which the load are focused are not subject to wear and thus the durability of the apparatus can be increased, and the movement of the floats is natural and soft while they rotate to raise or lower the watercraft.

Further, in some floats of the boat lifting apparatuses according to the present invention, a radius of orientation may be eliminated by lifting assemblies that are vertically raised or lowered like an elevator without rotation of the floats, and thus making good use of space, and the locking means and the lifting assemblies are simple.

Specifically, the boat lifting apparatus according to the eighth embodiment of the present invention can be configured so that a distance between two floats is fixed and no parts of the float are contacted with a wall of the berth, thus making good use of space.

DESCRIPTION OF DRAWINGS

FIG. 1 is a perspective view of the floating boat lifting apparatus for raising or lowering the boat from or onto the water according to the first embodiment of the present invention, wherein the watercraft is loaded.

FIG. 2 is a perspective view of the floating boat lifting apparatus according to the first embodiment of the present invention, wherein the parts of the apparatus are enlarged.

FIG. 3 is a drawing of the floating boat lifting apparatus according to the first embodiment of the present invention, wherein the floats are fully raised from the water and the watercraft is immersed in the water.

FIG. 4 is a front view of the floating boat lifting apparatus according to the first embodiment of the present invention, wherein the floats are fully immersed in the water and the watercraft is fully raised from the water.

FIG. 5 is a drawing of the floating boat lifting apparatus according to the first embodiment of the present invention, representing the operation state of the apparatus to lower the watercraft onto the water.

FIG. 6 is a drawing of the floating boat lifting apparatus according to the first embodiment of the present invention, wherein the floats are fully raised from the water to immerse the watercraft in the water.

FIG. 7 is a drawing of the hydraulic cylinder-operated floating boat lifting apparatus for raising or lowering the watercraft from or onto the water according to the second embodiment of the present invention, wherein the watercraft is loaded.

FIG. 8 is a perspective view of the hydraulic cylinder-operated floating boat lifting apparatus according to the second embodiment of the present invention, wherein the parts of the apparatus are enlarged.

FIG. 9 is a perspective view of the hydraulic cylinder-operated floating boat lifting apparatus according to the second embodiment of the present invention, representing the state that the floats are fully raised from the water and the watercraft is immersed in the water.

FIG. 10 is a front view of the hydraulic cylinder-operated floating boat lifting apparatus according to the second embodiment of the present invention, representing the state that the floats are fully immersed in the water and the watercraft is fully raised from the water.

FIG. 11 is a drawing of the hydraulic cylinder-operated floating boat lifting apparatus according to the second embodiment of the present invention, representing the state that the floats are partially immersed in the water when the apparatus is operated.

FIG. 12 is a drawing of the hydraulic cylinder-operated floating boat lifting apparatus according to the second embodiment of the present invention, wherein the floats are fully raised from the water to immerse the watercraft in the water.

FIG. 13 is a drawing of the worm gear-operated floating boat lifting apparatus for raising or lowering the watercraft from or onto the water according to the third embodiment of the present invention, wherein the watercraft is loaded.

FIG. 14 is a perspective view of the worm gear-operated floating boat lifting apparatus according to the third embodiment of the present invention, wherein the parts of the apparatus are enlarged.

FIG. 15 is a perspective view of the worm gear-operated floating boat lifting apparatus according to the third embodiment of the present invention, representing the state that the floats are fully raised from the water and the watercraft is immersed in the water.

FIG. 16 is a front view of the worm gear-operated floating boat lifting apparatus according to the third embodiment of the present invention, representing the state that the floats are fully immersed in the water and the watercraft is fully raised from the water.

FIG. 17 is a drawing of the worm gear-operated floating boat lifting apparatus according to the third embodiment of the present invention, representing the state that the floats are partially immersed in the water when the apparatus is operated.

FIG. 18 is a drawing of the worm gear-operated floating boat lifting apparatus according to the third embodiment of the present invention, wherein the floats are fully raised from the water to immerse the watercraft in the water.

FIG. 19 is a drawing of the hydraulic cylinder-operated floating boat lifting apparatus for raising or lowering the boat from or onto the water according to the fourth embodiment of the present invention, wherein the watercraft is loaded.

FIG. 20 is a perspective view of the improved hydraulic cylinder-operated floating boat lifting apparatus according to the fourth embodiment of the present invention, wherein the hydraulic cylinder assemblies are partially enlarged, in the state that the floats are fully immersed in the water.

FIG. 21 is a perspective view of the improved hydraulic cylinder-operated floating boat lifting apparatus according to the fourth embodiment of the present invention, wherein the hydraulic cylinder assemblies are partially enlarged, in the state that the floats are fully raised from the water and the watercraft is immersed in the water.

FIG. 22 is a front view of the improved hydraulic cylinder-operated floating boat lifting apparatus according to the fourth embodiment of the present invention, representing the state that the floats are fully immersed in the water and the watercraft is fully raised from the water, FIG. 23 is a front view of the hydraulic cylinder-operated floating boat lifting apparatus according to the fourth embodiment of the present invention, representing the state that the floats are partially immersed in the water when the apparatus is operated.

FIG. 24 is a front view of the improved hydraulic cylinder-operated floating boat lifting apparatus according to the fourth embodiment of the present invention, representing the state that the floats are fully raised from the water to immerse the watercraft in the water.

FIG. 25 is a drawing of the nonrotational-float boat lifting apparatus for raising or lowering the boat from or onto the water according to the fifth embodiment of the present invention, wherein the watercraft is loaded.

FIG. 26 is a perspective view of the nonrotational-float boat lifting apparatus according to the fifth embodiment of the present invention, wherein the hydraulic cylinder assemblies are partially enlarged, in the state that the watercraft is fully raised from the water.

FIG. 27 is a perspective view of the nonrotational-float boat lifting apparatus according to the fifth embodiment of the present invention, wherein the hydraulic cylinder assemblies are partially enlarged, in the state that the watercraft is fully immersed in the water.

FIG. 28 is an exploded diagram of the hydraulic cylinder assembly of the nonrotational-float boat lifting apparatus according to the fifth embodiment of the present invention.

FIG. 29 is a front view of the nonrotational-float boat lifting apparatus according to the fifth embodiment of the present invention, wherein the floats are fully immersed in the water and the watercraft is fully raised from the water.

FIG. 30 is a front view of the nonrotational-float boat lifting apparatus according to the fifth embodiment of the present invention, wherein the floats are fully raised from the water to immerse the watercraft in the water.

FIG. 31 is a drawing of the frame-improved hydraulic cylinder-operated floating boat lifting apparatus for raising or lowering the boat from or onto the water according to the sixth embodiment of the present invention, wherein the watercraft is loaded.

FIG. 32 is a perspective view of the frame-improved floating boat lifting apparatus according to the sixth embodiment of the present invention, wherein the hydraulic cylinder assemblies are partially enlarged, in the state that the watercraft is fully raised from the water and the floats are fully immersed in the water.

FIG. 33 is a perspective view of the frame-improved hydraulic cylinder-operated floating boat lifting apparatus according to the sixth embodiment of the present invention, wherein the hydraulic cylinder assemblies are partially enlarged, in the state that the floats are fully raised from the water and the watercraft is immersed in the water.

FIG. 34 is an exploded diagram of the float, the hydraulic cylinder assembly and the frame of the frame-improved hydraulic cylinder-operated floating boat lifting apparatus according to the sixth embodiment of the present invention, which represents the connection of them.

FIG. 35 is a front view of the frame-improved hydraulic cylinder-operated floating boat lifting apparatus according to the sixth embodiment of the present invention, wherein the watercraft is fully raised from the water and the floats are fully immersed in the water.

FIG. 36 is a front view of the frame-improved hydraulic cylinder-operated floating boat lifting apparatus according to the sixth embodiment of the present invention, wherein the floats are fully raised from the water to immerse the watercraft in the water.

FIG. 37 is a drawing of the nonrotational-float boat lifting apparatus for raising or lowering the boat from or onto the water according to the seventh embodiment of the present invention, wherein the watercraft is loaded.

FIG. 38 is a perspective view of the floating boat lifting apparatus according to the seventh embodiment of the present invention, wherein the locking means and the guide roller are partially enlarged, in the state that the watercraft is fully raised from the water.

FIG. 39 is a perspective view of the floating boat lifting apparatus according to the seventh embodiment of the present invention, wherein the locking means is partially enlarged, in the state that watercraft is fully immersed in the water.

FIG. 40 is an exploded diagram of the float, the hydraulic cylinder assembly, the locking means and the guide rollers of the floating boat lifting apparatus according to the seventh embodiment of the present invention, which represents the connection of them.

FIG. 41 is a front view of the floating boat lifting apparatus according to the seventh embodiment of the present invention, wherein the watercraft is fully raised from the water and the floats are fully immersed in the water.

FIG. 42 is a front view of the floating boat lifting apparatus according to the seventh embodiment of the present invention, wherein the floats are fully raised from the water to immerse the watercraft in the water.

FIG. 43 is a perspective view of the hydraulic rotor-operated floating boat lifting apparatus for raising or lowering the boat from or onto the water according to the eighth embodiment of the present invention, wherein the watercraft is loaded.

FIG. 44 is a perspective view of the hydraulic rotor-operated floating boat lifting apparatus according to the eighth embodiment of the present invention, wherein the locking means, hydraulic rotor assembly and the lifting assembly are partially enlarged, in the state that the floats are fully raised from the water.

FIG. 45 is a perspective view of the hydraulic rotor-operated floating boat lifting according to the eighth embodiment of the present invention, wherein the locking means, hydraulic rotor assembly and the lifting assembly are partially enlarged, in the state that the watercraft is immersed in the water.

FIG. 46 is a perspective view of the floats of the hydraulic rotor-operated floating boat lifting apparatus according to the eighth embodiment of the present invention, when the watercraft is fully immersed in the water.

FIG. 47 is an exploded diagram of the hydraulic rotor assembly and the locking means of the hydraulic rotor-operated floating boat lifting apparatus according to the eighth embodiment of the present invention.

FIG. 48 is a drawing representing that the hydraulic rotor assembly, U-typed frame and the locking means are laid in the float according to the eighth embodiment of the present invention.

FIG. 49 is a front view of the hydraulic rotor-operated floating boat lifting apparatus according to the eighth embodiment of the present invention, wherein the watercraft is fully raised from the water, the floats are fully immersed in the water and the hydraulic rotor assemblies are laid in the floats.

FIG. 50 is a front view of the hydraulic rotor-operated floating boat lifting apparatus according to the eighth embodiment of the present invention, representing the state that the floats are partially immersed in the water when the apparatus is operated.

FIG. 51 is a front view of the hydraulic rotor-operated floating boat lifting apparatus according to the eighth embodiment of the present invention, wherein the floats are fully raised from the water to immerse the watercraft and the hydraulic rotor assemblies are laid in the floats.

BEST MODE

Reference will now be made in detail to the preferred embodiments of the present invention, examples of which are illustrated in the accompanying drawings.

The first embodiment of the present invention is explained as below.

FIG. 1 is a perspective view of the floating boat lifting apparatus for raising or lowering the boat from or onto the water according to the first embodiment of the present invention, wherein the watercraft is loaded.

FIG. 2 is a perspective view of the floating boat lifting apparatus according to the first embodiment of the present invention, wherein the main parts of the apparatus are enlarged. A floating boat lifting apparatus according to the first embodiment of the present invention mainly comprises the lifting assembly (110) positioned between a pair of parallel floats (130) to receive the watercraft, a pair of U-typed guide structures (120) to guide the floats (130) below or above the water (34), and a pair of parallel floats (130) longitudinally extended.

The lifting assembly (110) is inwardly and downwardly configured to receive or support the watercraft and includes a pair of bunks (111) longitudinally extended, a pair of V-typed beams (112) supporting the bunks (111), the longitudinally extended '⊥ -shaped' central beam (118) welded at its edges to the lower part of the V-typed beams (112), two pairs of arm structures (113) connected to both edges of the V-typed beam (112) through two pairs of the first rotating axles (114), and two pairs of hydraulic cylinders (119) connected between the second rotating axle (115) positioned below the first rotating axle (114) and the fourth rotating axle (117) of the central beam (118).

The U-typed guide structure (120) includes a pair of rollers (122) connected to a brace (131) bolted to the float (130) and a raised spot (not shown in figures) in the edge of the guide (121) to prevent the rollers (122) from leaving the guide structure (120). The rail may be provided instead of the raised spot. The U-typed guide structures (120) present visually prominent features to an operator of the watercraft that may assist the operator in locating the lifting assembly (110) when the watercraft enters the lifting apparatus according to the first embodiment of the present invention.

The floats (130) may be made of light metal materials such as aluminum or plastics such as fiber-reinforced plastics (FRP). The floats (130) may each comprise multiple small floats that are united. The upper part of each float (130) is connected to rollers (122) through a bracket (131), and its lower part is connected to an arm structure (113) through a third rotating axle (116). The inward surface of the float (130) is curved to decrease buoyancy in case of lowering the watercraft. The surface area of the lower part of the floats (130) is larger than that of the upper part to increase the contact area with the water and thereby increasing buoyancy in case of raising the watercraft from the waterline (34).

FIG. 3 shows a state that the floats (130) are fully raised from the water and the watercraft is immersed in the water. The hydraulic cylinder (119) pushes the second rotating axle (115), then the arm structure (113) outwardly turns on the first rotating axle (114). The float (130) outwardly turns on the third rotating axle (116) coupled to the floats (130), and the roller (122) rises along the guide (121). The float (130) is approximately vertical to the waterline (34). The float (130) stably rises, as it moves naturally and softly along the guide (121) by the roller (122).

FIG. 4 shows a state that the floats (130) are fully immersed in the water and the watercraft is fully raised from the waterline (34). The hydraulic cylinder (119) pulls the second rotating axle (115), and then the arm structure (113) inwardly turns on the first rotating axle (114). The float (130) inwardly turns on the third rotating axle (116) coupled to the floats (130), and the roller (122) descends along the guide (121). The float (130) is approximately parallel with the waterline (34). The float (130) also stably is lowered, as it moves naturally and softly along the guide (121) by the roller (122). At this time, only a portion of the lower part of the arm structure (113) is submerged.

Referring to FIG. 4 to FIG. 6, the operation in which the watercraft raised from the waterline (34) is lowered to the water is explained.

FIG. 4 shows that the watercraft is loaded on the floating boat lifting apparatus according to the first embodiment of the present invention and raised from the waterline (34). Electric power (not shown) connected to the hydraulic cylinder (119) should be turned on to lower the watercraft to the water.

The hydraulic cylinder (119) pushes the second rotating axle (115), and then the arm structure (113) outwardly turns on the first rotating axle (14), namely the left arm structure (113) turns clockwise, and the right arm structure (113) turns counter clockwise. The float (130) outwardly turns on the third rotating axle (116) coupled to the lower part of the floats (130). At the same time, the roller (122) connected to the bracket (131) united to the upper part of the float (130) moves along the guide (121) and vertically rises together with the float (130). The roller (122) reaches the top of the guide (121) when the cylinder (119) completely pushes the arm structure (113). The contact area of the float (130) with the waterline (34) decreases as the float (130) rises. Accordingly, the higher the float (130) rises, the less its buoyancy decreases.

Referring to FIGS. 5 and 6, a pair of V-typed beams (112) supporting the watercraft slowly descends toward the waterline (34) as the floats (130) rise. The boat lifting apparatus according the first embodiment of the present invention operates until the watercraft completely floats for itself.

The lifting assembly (110) should be raised above the waterline (34) as soon as the watercraft slips out the boat lifting apparatus. The operation for raising the watercraft above the waterline (34) can be carried out in inverse order of FIG. 4 to FIG. 6.

Referring to FIG. 7 to FIG. 12, the hydraulic cylinder-operated floating boat lifting apparatus according to the second embodiment of the present invention is explained in detail as below.

FIG. 7 shows a state the watercraft is loaded on the hydraulic cylinder-operated floating boat lifting apparatus according to the second embodiment of the present invention and raised from the waterline (34).

FIG. 8 is a perspective view of the hydraulic cylinder-operated floating boat lifting apparatus according to the second embodiment of the present invention, wherein the main parts of the apparatus are enlarged.

The hydraulic cylinder-operated floating boat lifting apparatus according to the second embodiment of the present invention mainly comprises the lifting assembly (210) positioned between a pair of parallel floats (230) to receive the watercraft, two pairs of hydraulic cylinder assembly (220) and the pair of parallel floats longitudinally extended (230).

The lifting assembly (210) comprises a pair of U-typed frames (211), a pair of bunks (211) inwardly and downwardly configured to receive or support the watercraft and longitudinally extended, a pair of V-typed beams (213) supporting the bunks (211), beams (214) welded at their edges to the lower part of the V-typed frame (211), and a longitudinally extended '⊥-shaped' central beam (215) welded to a central lower part of the U-typed frame (211). The U-typed frames (211) present visually prominent features to an operator of the watercraft that may assist the operator in locating the lifting assembly (210) when the watercraft enters the lifting apparatus according to the second embodiment of the present invention.

The hydraulic cylinder assembly (220) comprises a hydraulic cylinder (221) connected between a third rotating axle (226) which is attached to a protrusion (216) formed on one end of the frame (211) and the first rotating axle (223) which is attached to the above of the floats (230), the first support (222) which is attached to the below of the protrusion (216) of the frame (211), the second support (225) attached to the above of the floats (230), the second rotating axle (224) connecting the first support (222) and the second support (225), and the first rotating axle (223) connecting the second support (225) and the hydraulic cylinder (221).

The floats (230) may be made of light metal materials such as aluminum or plastics such as fiber-reinforced plastics (FRP). The floats (230) may each comprise multiple smaller floats that are united. The second support (225) is attached to the top of the float (230) and coupled to the first support (222) by the second rotating axle (224).

The inward of the float (230) is curved to decrease buoyancy in case of lowering the watercraft. The surface area of the low part of the floats (230) is larger than that of the upper part to increase the contact area with the water and thereby increasing buoyancy in case of raising the watercraft from the waterline (34).

The hydraulic cylinder-operated floating boat lifting apparatus according to the second embodiment of the present invention may further comprise a locking means to provide against a disorder of the hydraulic cylinder. The locking means consists of the third support (232) bolt-clamped with one side of the first support (222) of the frame (211), the fourth support (231) attached to the above of the floats (230), and a solenoid (233) for locking the third support (232) and the fourth support (231).

FIG. 9 shows a state that the floats (230) are fully raised from the waterline (34) and the watercraft is immersed in the water. Prior to the raising operation of the hydraulic cylinder-operated floating boat lifting apparatus, the electric power connected to the solenoid (233) is turn on to release the solenoid pin from the third support (232), and then the electric power (not shown) connected to the hydraulic cylinder (221) is turned on.

The hydraulic cylinder (221) pulls the first rotating axle (223), and then the second support (225) outwardly turns on the rotating axle (224). At the same time, the float (230) naturally and softly rises and the float (230) is approximately vertical to the waterline (34). By this operation, the lifting assembly (210) is submerged into the water below the waterline (34).

FIG. 10 shows a state that the watercraft is fully raised from the waterline (34) and the floats (230) are fully immersed in the water. The hydraulic cylinder (221) pushes the first rotating axle (223), and then the second support (225) attached to the float (230) inwardly turns on the second rotating axle (224). At the same time, the floats (230) are naturally and softly submerged into the water and the low surface of the float (230) is approximately parallel with the waterline (34). By this operation, the lifting assembly (210) is completely raised from the water above the waterline (34). Accordingly, no parts of the boat lifting apparatus according to the second embodiment of the present invention except for the floats (230) are submerged in the water.

Referring to FIG. 10 to FIG. 12, the operation in which the watercraft raised from the waterline (34) is lowered to the water is explained.

FIG. 10 shows a state that the watercraft loaded on the hydraulic cylinder-operated floating boat lifting apparatus according to the second embodiment of the present invention is fully raised from the waterline (34). The electric power (not shown) connected to the solenoid (233) is turned on to release the solenoid pin from the third support (232), and then the electric power (not shown) connected to the hydraulic cylinder (221) is turn on.

The hydraulic cylinder (221) pulls the first rotating axle (223), and then the second rotating axle (224) outwardly turns on the second rotating axle (224). At the same time, the float (230) naturally and softly rises above the waterline (34) with the buoyancy decreased. As the float (230) rises, its contact area with the water decreased on account of the curved portion thereof, and thus the buoyancy is decreased.

As shown in FIG. 11 and FIG. 12, as the floats (230) rise, a pair of V-typed beams (213) supporting the watercraft descend toward the waterline (34). The hydraulic cylinder (221) operates until the watercraft completely floats for itself.

The lifting assembly (210) should be raised above the waterline (34) as soon as the watercraft slips out the boat lifting apparatus. The operation for raising the watercraft above the waterline (34) can be carried out in inverse order of FIG. 10 to FIG. 12.

The greatest feature of the boat lifting apparatus according to the second embodiment of the present invention is that the lifting assembly (210) is always above the water except for a few minutes when a part of the lifting assembly (210) is submerged at the time of lowering the watercraft. Accordingly, the apparatus except for the floats (230) and a part of the lifting assembly (210) is almost always above the water, and thus the corrosion of the apparatus is delayed, and the durability of the apparatus can be increased.

Referring to FIG. 13 to FIG. 18, the worm gear-operated floating boat lifting apparatus according to the third embodiment of the present invention is explained in detail as below.

FIG. 13 shows that the watercraft is loaded on the worm gear-operated floating boat lifting apparatus according to the third embodiment of the present invention and raised from the waterline (34).

FIG. 14 is a perspective view of the worm gear-operated floating boat lifting apparatus according to the third embodiment of the present invention, wherein the main parts of the apparatus are enlarged. A worm gear-operated floating boat lifting apparatus according to the third embodiment of the present invention mainly comprises the lifting assembly (310) positioned between a pair of parallel floats (330) to receive the watercraft, the worm gear assembly (320) to guide the floats (330) below or above the water (34) and the pair of parallel floats (330) longitudinally extended.

The lifting assembly (310) comprises a pair of U-typed frame (311), a pair of bunks (312) longitudinally extended and inwardly and downwardly configured to receive or support the watercraft, a pair of V-typed beams (313) supporting the bunks (312), and the beams (314) welded at its edges and the lower part of the V-typed beams (313), '⊥-shaped' central beam (315) the longitudinally extended and welded at its edges to the lower part of the V-typed beams (313). The U-typed frames (311) present visually prominent features to an operator of the watercraft that may assist the operator in locating the lifting assembly (310) when the watercraft enters the lifting apparatus according to the third embodiment of the present invention.

The worm gear assembly (320) comprises a first support (322) attached to the protrusion (316) formed on both ends of the U-typed frame (311); a worm wheel (327) connected to the rotating axle (321) in the hole formed on one end of the first support (322); a worm (324) connected to a saw teeth of the worm wheel (327); a worm axle (323); a motor (326) connected to the worm axle (323); the second support (325) which is connected by the rotating axle (321) of the first support (322) and attached to the above of the floats (330); and a housing (328) which envelops the worm wheel (327), the worm (324) and the worm axle (323), and is attached to the side of the protrusion (316) of the U-typed frame (311).

The floats (330) may be made of light metal materials such as aluminum or plastics such as fiber-reinforced plastics (FRP). The floats (330) may also comprise multiple small floats that are united. The second support (325) attached to the floats (330) is connected to the first support (322) on the rotating axle (321).

The inward of the float (330) is curved to decrease buoyancy in case of lowering the watercraft. The surface area of the low part of the floats (330) is larger than that of the upper part to increase the contact area with the water and thereby increasing buoyancy in case of raising the watercraft from the waterline (34).

The worm gear-operated floating boat lifting apparatus according to the third embodiment of the present invention may further comprise a locking means to provide against a disorder of the worm gear. The locking means comprises the third support (332) of the U-typed frame (311), the fourth support (331) attached to the top of the float (330), the hole (329) (refer to FIG. 15) formed at the tip of the third support (332), and the solenoid (333) wherein the solenoid pin locks or unlocks the third and fourth supports (331,332).

FIG. 15 shows a state that the watercraft is submerged and the floats (330) are fully raised from the waterline (34). Prior to the raising operation of the worm gear-operated floating boat lifting apparatus, the electric power connected to the solenoid (333) is turned on to release the solenoid pin from the third support (332) and the fourth support (331), and then the electric power (not shown) connected to the motor (326) is turned on. The left worm wheel (327) turns clockwise and the right worm wheel (327) turns counterclockwise. And then the second support (325) outwardly turns on the first rotating axle (321). At the same time, the floats (330) outwardly turn and naturally and softly rise. At this time, the bottom surface of the floats (330) are approximately parallel to the waterline (34) and the lifting assembly (310) is slowly submerged below the waterline (34).

FIG. 16 shows a state that the watercraft loaded on the boat lifting apparatus according to the third embodiment of the present invention is fully raised from the waterline (34) and the floats (330) are fully submerged into the water. In order to completely raise the watercraft above the waterline (34), the left worm wheel (327) turns counter clockwise and the right worm wheel (327) turns clockwise by the motor (326). And then the second support (325) attached to the fourth support (331) of the float (330) inwardly turns on the first rotating axle (321). At the same time, the floats (330) naturally and softly go into the water. At this time, the bottom surface of the floats (330) are approximately vertical to the waterline (34) and the lifting assembly (310) is slowly raised above the waterline (34). Accordingly, no parts of the boat lifting apparatus according to the third embodiment of the present invention except for the floats (330) are submerged in the water.

Referring to FIG. 16 to FIG. 18, the operation in which the watercraft raised from the waterline (34) is lowered to the water is explained.

FIG. 16 shows a state that the watercraft loaded on the hydraulic cylinder-operated floating boat lifting apparatus according to the third embodiment of the present invention is fully raised from the waterline (34). In order to lower again the watercraft from the apparatus, the electric power (not shown) connected to the solenoid (333) is turned on to release the solenoid pin from the third support (332), and then the electric power (not shown) connected to the motor (326) is turned on to operate the apparatus.

The left worm wheel (327) turns clockwise by the motor (326), and the right worm wheel (327) turns counter clockwise. And then the second support (325) attached to the floats (330) on the rotating axle (321) outwardly turns. At the same time, the float (330) naturally and softly rises above the waterline (34) with the buoyancy decreased. As the float (330) rises, its contact area with the water is decreased on account of the curved portion thereof, and thus the buoyancy is decreased.

As shown in FIG. 11 and FIG. 12, as the floats (330) rise, a pair of V-typed beams (313) supporting the watercraft descend toward the waterline (34). The worm gear operates until the watercraft completely floats for itself.

The lifting assembly (310) should be raised above the waterline (34) as soon as the watercraft slips out the boat lifting apparatus. The operation for raising the watercraft above the waterline (34) can be carried out in inverse order of FIG. 16 to FIG. 18.

The greatest feature of the boat lifting apparatus according to the third embodiment of the present invention is that the lifting assembly (310) is always above the water except for a few minutes when a part of the lifting assembly (310) is submerged while lowering the watercraft. Accordingly, the apparatus except for the floats (330) and a part of the lifting assembly (310) is almost above the water, and thus the corrosion of the apparatus is reduced, and the durability of the apparatus is increased.

Referring to FIG. 19 through FIG. 24, the hydraulic cylinder-operated floating boat lifting apparatus according to the fourth embodiment of the present invention operation is explained in detail below.

FIG. 19 shows that the watercraft is loaded on the hydraulic cylinder-operated floating boat lifting apparatus according to the fourth embodiment of the present invention and raised from the waterline (34).

FIG. 20 is a perspective view of the hydraulic cylinder-operated floating boat lifting apparatus according to the fourth embodiment of the present invention in a case that the watercraft is fully raised from the waterline (34) and the floats (430) are fully immersed in the water, wherein the hydraulic cylinder assembly (420) of the apparatus is enlarged. A hydraulic cylinder-operated floating boat lifting apparatus according to the fourth embodiment of the present invention mainly comprises the lifting assembly (410) positioned between a pair of parallel floats (430) to receive the watercraft; two pairs of hydraulic cylinder assemblies (420) to guide the floats (430) below or above the water (34); and the pair of parallel floats (430) longitudinally extended.

The lifting assembly (410) comprises a pair of U-typed frames (411) with their ends (416) being vertically formed, a beam (415) having a pair of cross beams (415*a*) and a pair of longitudinal beams (415*b*) for connecting the U-typed frames (411) with each other, and multiple bunks (412) inwardly and downwardly configured to receive or support the watercraft and being able to be rotated by the hinge pins (414) of the multiple supports (413) which are welded to a pair of cross beams (415*a*). In the drawings according to the fourth embodiment of the present invention, the number of the bunks (412) is six (6), but this number may be increased, if necessary. The U-typed frames (411) present visually prominent features to an operator of the watercraft that may assist the operator in locating the lifting assembly (410) when the watercraft enters the lifting apparatus according to the fourth embodiment of the present invention.

The hydraulic cylinder assemblies (420) which are installed in both ends of the frame (411) can reduce a radius of rotation of the float (430) by moving a rotation axle of the support (425) connected to one end of the hydraulic cylinder (421) inside the frame (411). The hydraulic cylinder assembly (420) comprises a hydraulic cylinder (421), the first support (422) connected to one end of the hydraulic cylinder (421) by the first rotating axle (423), the arm (426) wherein the one end of the arm (426) is connected to the other end of the hydraulic cylinder (421) by the second rotating axle (424) and the other end of the arm (426) is integrally fixed with the upper part of the floats support (431), and the second support (425) which has a hole (not shown in Figures) to turn the arm (426) around the pin (427) and is attached to the U-typed frame (411).

The floats (430) may be made of light metal materials such as aluminum or plastics such as fiber-reinforced plastics (FRP). The floats (430) may comprise of multiple separate small floats that are united. Two pairs of the float supports (431) are uprightly installed on the upper surface of the floats (430) and the arm (426) is integrally united to the supports (431).

The inward surface of the float (430) is curved to decrease buoyancy in case of lowering the watercraft. The surface area of the lower part of the floats (430) is larger than that of the upper part to increase the contact area with the water and thereby increasing buoyancy in case of raising the watercraft from the waterline (34).

The boat lifting apparatus according to the fourth embodiment of the present invention may further comprise a locking means to provide against a disorder of the hydraulic cylinder (421). The solenoid (433) as a locking means is attached to the middle of the arm (426) and locks the arm (426) to the second support (425) by inserting the pin of the solenoid (433) into the hole (428) of the second support (425).

Referring to FIG. 20 through FIG. 24, the operation in which the watercraft raised from the waterline (34) is lowered to the water and vise versa are explained.

FIG. 20 shows the boat lifting apparatus according to the fourth embodiment of the present invention in case that the watercraft is fully raised from the waterline (34) and the floats (430) are fully submerged into the water. Prior to the raising operation of the boat lifting apparatus, the electric power (not shown) connected to the solenoid (433) is turned on to release the solenoid pin from the second support (432), and then the electric power (not shown) connected to the hydraulic cylinder (421) is turned on. The hydraulic cylinder (421) pushes the arm (426), and then the float support (431) integrally formed with the arm (426) outwardly turns. At the same time, the floats (430) naturally and softly rise from the waterline (34), with the buoyancy of the floats (430) decreased. Since the contact area of the float (430) with the waterline (34) decreases on account of the curved part of the float (430) as the float (430) raises, the buoyancy of the float (430) decreases. At the same time, the lifting assembly (410) slowly descends toward the waterline (34) as the floats (430) rise. The hydraulic cylinder (421) operates until the watercraft completely floats for itself.

FIG. 21 shows the boat lifting apparatus according to the fourth embodiment of the present invention in case that the watercraft is submerged into the water and the floats (430) are fully raised from the waterline (34). In order to completely raise the watercraft above the waterline (34), the watercraft is positioned above the lifting assembly (410) submerged in the water. The hydraulic cylinder (421) pulls the arm (426) on the second rotating axle (424), and then the float support (431) integrally formed with the arm and attached to the float (430) inwardly turns. At the same time, the floats (430) naturally and softly go into the water. At this time, the bottom surface of the floats (430) are approximately parallel to the waterline (34) and the lifting assembly (410) is slowly raised above the waterline (34). Accordingly, no parts of the boat lifting apparatus according to the fourth embodiment of the present invention except for the floats (430) are submerged in the water.

The greatest feature of the boat lifting apparatus according to the fourth embodiment of the present invention is that the hydraulic cylinder assemblies (420) are installed in both ends of the U-typed frame (411), the rotation axle of the float support (425) connected to one end of the hydraulic cylinder (421) is inwardly moved, thereby reducing a radius of rotation of the float (430) and making good use of a space; that the solenoid (433) as locking means is installed in the second support (425) connected to the float support (431) and the arm (426) without an additional support means; and that the lifting assembly (410) comprises the cross beam (415*a*), the longitudinal beam (415*b*), and rotational multiple bunks only.

Referring to FIG. 25 through FIG. 30, the nonrotational-float boat lifting apparatus according to the fifth embodiment of the present invention operation is explained in detail as below.

FIG. 25 shows that the watercraft is loaded on the hydraulic cylinder-operated floating boat lifting apparatus according to the fifth embodiment of the present invention and raised from the waterline (34).

FIG. 26 is a perspective view of the hydraulic cylinder-operated floating boat lifting apparatus according to the fifth embodiment of the present invention in case that the watercraft is fully raised from the waterline (34) and the floats (530) are fully immersed in the water, wherein the hydraulic cylinder assemblies (520) of the apparatus are enlarged. The nonrotational-float boat lifting apparatus according to the fifth embodiment of the present invention comprises the lifting assembly (510) positioned between a pair of parallel floats (530) to receive the watercraft; two pairs of hydraulic cylinder assemblies (520) to guide the floats (530) below or above the water (34); and the pair of parallel floats (530) longitudinally extended.

The lifting assembly (510) comprises a pair of U-typed frame (511) with their ends (516) being vertically formed, a beam (515) having a pair of cross beams (515*a*) and a pair of longitudinal beams (515*b*) for connecting the U-typed frames (511) to each other, and multiple bunks (512) inwardly and downwardly configured to receive or support the watercraft and being able to be rotated by the hinge pins (514) of the multiple supports (513) which are welded to a pair of cross beams (515*a*). The U-typed frames (511) present visually prominent features to an operator of the watercraft that may assist the operator in locating the lifting assembly (510) when the watercraft enters the lifting apparatus according to the fifth embodiment of the present invention.

The hydraulic cylinder assembly (520) comprises a hydraulic cylinder (521), a bracket (524) sliding in the inside of the cylindrical pillar and eight sleeves (525) installed on the outside edges for guiding sliding movement of the bracket (524). The hydraulic cylinder assembly (520) comprises a hydraulic cylinder (521), a bracket (524) sliding in the inside of the cylindrical pillar and eight sleeves (525) installed on the outside edges for guiding sliding movement of the bracket (524). The hydraulic cylinder (521) is inserted to the slot formed in the tip (516) of the frame (511) by the connecting member (522), and is connected to the frame (511) by the pin (526) through the pin holes (523*a*, 523*b*, 523*c*) of the connecting member.

The upper part of the bracket (524) has a groove to receive the tip (516) of the frame (511), and two protrusions have the pin hole (523*c*) to receive the pin (526) and the bolt holes to bolt-clamp the sleeve (525). Eight sleeves (525) are bolt-clamped to four (4) outside edges of the bracket (524) for guiding the sliding movement of the bracket (524) and coated with PE plastics, ceramics or Teflon to reduce friction and increase durability.

The tip (516) of the frame (511) is inserted to the groove formed at the bracket (524) including eight sleeves (525) bolt-clamped to four (4) outside edges thereof. The connecting member (522) of the hydraulic cylinder (521) is inserted in the slot (517) formed at the tip (516) of the frame (511), and the pin (516) is inserted through the pin hole (523*a*) of the connecting member, the pin hole (523*b*) formed at the tip (516) of the frame (511) and the pin hole (524*c*) of the bracket (524). The hydraulic cylinder (521), the frame (511) and the bracket (524) are connected each other by the above mentioned connection.

The floats (530) may be made of light metal materials such as aluminum or plastics such as fiber-reinforced plastics (FRP). The floats (530) may also comprise multiple small floats that are united. Two cylindrical pillars (531) are inserted in the rectangular trough (535) to the middle of its height of the float (530). The cylindrical pillar (531) is opened in its upper portion, and has the slit (532) opened in its upper portion. The bolt holes for installing the locking means (540) and the cover (533) are provided at the top of the pillar (531). The cover (533) covering the top of the pillar (531) has the hole through which the hydraulic cylinder (521) is penetrated, its lower part being opened. The bolt holes corresponding to those of the pillar (531) are formed in four side surfaces of the cover (533), and the limit switch (546) for stopping the raising of the frame (511) is provided at one side of the cover (533).

The inward surface of the float (530) is curved to decrease buoyancy in case of lowering the watercraft. The surface area of the lower part of the floats (130) is larger than that of the upper part. As shown in FIG. 28, the rectangular trough (535) is formed in the float (530) and extended to the middle of its height to receive the cylindrical pillar (531).

The boat lifting apparatus according to the fifth embodiment of the present invention may further comprise a pinion gear-typed locking means to provide against a disorder of the hydraulic cylinder (521). The slit (not shown in Figure) is formed in the middle of the pinion gear-typed locking means (540), and the locking means (540) is installed at the top of the slit. The locking means (540) comprises the first bracket (541) consisting of a toothed gear (543), a toothed bar (544) functioning as a safety pin, a rotating axle (542) of the toothed gear (543), and the motor (545) driving the rotating axle (542); the second bracket (541*a*) having the holes for inserting the toothed bar (544); and a limit switch (546) installed on the cover (533) to stop the raising of the frame (511).

The limit switch (546) is installed in the pillar (531) to be consistent with the height the tip (516) of the frame (511) reaches when the lifting assembly (510) loading the watercraft is completely raised by the hydraulic cylinder (521). The tip (516) of the frame (511) in the lifting assembly (510) touches the limit switch (546) when it rises, and then the motor (545) is operated by electric power (not shown in Figure), and then the toothed bar (544) is escaped. In case that the hydraulic pressure is released on account of the disorder of the hydraulic cylinder (521), the tip (516) of the frame (511) is caught by the toothed bar (544) and the motor (545) and the toothed bar (544) are not operated. More specifically, when the tip (516) of the frame (511) is caught by the toothed bar (544), the motor (545) is not operated. In order to lower the lifting assembly (510) so as to float the watercraft, the hydraulic cylinder (521) is pulled upward, and then the tip of the frame touches the limit switch (546), and then the toothed bar (544) get into the locking means (540)

Referring to FIG. 25 to FIG. 30, the operation in which the watercraft raised from the waterline (34) is lowered to the water and vise versa are explained.

FIG. 26 shows the boat lifting apparatus according to the fifth embodiment of the present invention in case that the watercraft is fully raised from the waterline (34) and the floats (430) are fully submerged into the water. Prior to the raising operation of the boat lifting apparatus, the electric power (not shown) connected to the hydraulic cylinder (521) is turn on, and then it is pulled above a little. The limit switch (546) is touched by the tip of the frame (511), and then the motor (545) begins to work. At this time, the toothed bar of the pinion gear returns to its original position to unlock the locking means (540). Next, the hydraulic cylinder (521) pushes the tip (516) of the frame joined with the connecting member (522) of the cylinder assembly (521) and the bracket (524). At the same time, the bracket (524) descends through the slit (532) inside the cylindrical pillar (531). At this time, the hydraulic cylinder (521) is continuously operated until the watercraft completely floats in the water for itself.

FIG. 27 shows a state that the watercraft loaded on the boat lifting apparatus according to the fifth embodiment of the present invention is fully raised from the waterline (34). In order to completely raise the watercraft above the waterline (34), the watercraft is positioned above the lifting assembly (510) submerged in the water and then electric power (not shown in Figure) connected to the hydraulic cylinder (521) is turned on. At this time, the lifting assembly (510) begins to rise from the waterline (34). The tip (516) of the frame (511) touches the limit switch (546), and the toothed bar (544) functioning as a safety pinion enters the holes of the bracket (541, 541*a*) and supports the low surface of the tip (516) of the frame (511). Accordingly, no parts of the boat lifting apparatus according to the fifth embodiment of the present invention except for the floats (530) are submerged in the water.

The greatest feature of the boat lifting apparatus according to the fifth embodiment of the present invention is that the lifting assembly (510) loaded by the watercraft rises or descends without rotation of the floats (530) to significantly make good use of a space at the berthage where the watercraft is moored, and that the safety pinion gear-typed locking means (540) is provided.

Referring to FIG. 31 through FIG. 36, the hydraulic cylinder-operated floating boat lifting apparatus according to the sixth embodiment of the present invention operation is explained in detail as below.

FIG. 31 shows that the watercraft is loaded on the frame-improved and hydraulic cylinder-operated floating boat lifting apparatus according to the sixth embodiment of the present invention and raised from the waterline (34).

FIG. 32 is a perspective view of the frame-improved hydraulic cylinder-operated floating boat lifting apparatus according to the sixth embodiment of the present invention in case that the watercraft is fully raised from the waterline (34) and the floats (630) are fully immersed in the water, wherein the connection portion of the tip of the frame (611) and the hydraulic cylinder assembly (620) of the apparatus are enlarged. The frame-improved hydraulic cylinder-operated floating boat lifting apparatus according to the sixth embodiment of the present invention comprises the lifting assembly (610) positioned between a pair of parallel floats (630) to receive the watercraft; two pairs of hydraulic cylinder assemblies (620) to guide the floats (630) below or above the water (34); and the pair of parallel floats (630) longitudinally extended.

The lifting assembly (610) comprises a pair of U-typed frames (611) which are outwardly inclined from the bottom and then upright from the end of the inclined part, a beam (615) consisting of a pair of cross beams (615*a*) and a pair of longitudinal beams (615*b*) for connecting a pair of U-typed frames (611) to each other, and multiple bunks (612) inwardly and downwardly configured to receive or support the watercraft and being able to be rotated by the hinge pins (614) of the multiple supports (613) which are welded to a pair of cross beams (615*a*). In the drawings of the sixth embodiment of the present invention, the number of the bunks (612) is only four (4), but it may be increased, if necessary. The U-typed frames (611) present visually prominent features to an operator of the watercraft that may assist the operator in locating the lifting assembly (610) when the watercraft enters the lifting apparatus according to the sixth embodiment of the present invention.

The hydraulic cylinder assembly (620) according to the sixth embodiment of the present invention reduces a radius of rotation of the floats (630), since one end of the hydraulic cylinder (621) is coupled to the first support (622) attached to the inclined outside surface of the frame (611), the other end of the hydraulic cylinder (621) is coupled to the arm (626) connected to the second support (625) which is attached to the upright outside surface of the U-typed frame (611), and the rotation axle of the float (630) is coincided with the upright tip of the frame (611).

The hydraulic cylinder assembly (620) comprises a hydraulic cylinder (621), the first support (622) connected to one end of the hydraulic cylinder (621) through the first rotating axle (623), an arm (626) wherein one end of the arm (626) is connected to the other end of the hydraulic cylinder (621) through the second rotating axle (624) and the other end of the arm (626) is connected to the tip of the float support (631), and the second support (625) which is attached to the outer surface of the upright upper end of the U-typed frame (611) and a hole for inserting arm axle (627) through which the arm turns is provided.

FIG. 34 is an exploded diagram of the float, the hydraulic cylinder assembly and the frame of the frame-improved hydraulic cylinder-operated floating boat lifting apparatus according to the sixth embodiment of the present invention, which represents the connection of them. One end of the hydraulic cylinder (621) is coupled to the first support (622) attached to the inclined outside surface of the frame (611) by the first rotating axle (623) which functions as a pin. The other end of the hydraulic cylinder (621) is coupled to a second rotating axle (624) through holes of the first arm (626*a*) and the second arm (626*b*), where a second support (625) is disposed between the first arm (626*a*) and the second arm (626*b*). The second rotating axle (624) is inserted through the hole formed at the lower part of the arm (626). As shown in FIG. 34, the float support (631), arm (626) and the second support (625) are connected each other by inserting the arm axle (627) having a protrusion at its one end through the hole of the float support (631), the upper hole of the first arm (626*a*), the center hole of the second support (625) and the upper hole of the second arm (626*b*). The upper hole of the second arm (626*b*) includes a groove in which a protrusion of the arm axle (626*a*) is inserted. The socket (628) positioned between the first arm (626*a*) and the second support (625) is coupled to the second support (625) by four bolts. A groove is formed at the top inside the first arm (626*a*) so as to receive the socket (628). As a result, the driving force of the hydraulic cylinder (621) is transferred to the float support (631). The cover (629) is provided to cover the end of the arm axle (627) which is protruded through the hole of the second arm (626*b*).

The floats (630) may be made of light metal materials such as aluminum or plastics such as fiber-reinforced plastics (FRP). The floats (630) may also be consists of multiple small ones so that they may be united. The inward of the floats (630) is curved, and the float (630) has two supports (631) and a hole is formed in the upper end of the support (631) for inserting an arm axle (627).

The inward surface of the float (630) is curved to decrease buoyancy in case of lowering the watercraft. The surface area of the lower part of the floats (630) is larger than that of the upper part to increase the contact area with the water and thereby increasing buoyancy in case of raising the watercraft from the waterline (34).

The boat lifting apparatus according to the sixth embodiment of the present invention may further comprise a locking means to provide against a failure of the hydraulic cylinder. The solenoid (633) as locking means is installed in the middle of the first arm (626*a*), and couples the first arm (626*a*) and the second arm (626*b*) to the second support (625) so that the pin of the solenoid (633) may be inserted through the hole of the second support (625) and the middle hole of the second arm (626*b*).

Referring to FIG. 32 through FIG. 36, the operation in which the watercraft raised from the waterline (34) is lowered to the water and vise versa are explained.

FIG. 32 shows the boat lifting apparatus according to the sixth embodiment of the present invention in case that the watercraft is fully raised from the waterline (34) and the floats (430) are fully submerged into the water. Prior to the raising operation of the boat lifting apparatus, the electric power (not shown in Figure) connected to the solenoid (633) is turned on to release the solenoid pin from the second support (625), and then the electric power (not shown in Figure) connected to the hydraulic cylinder (621) is turned on. The hydraulic cylinder (621) pushes the arm (626), and then the float support (631) coupled with the arm axle (627) outwardly turns. At the same time, the floats (630) naturally and softly rise from the waterline (34), with the buoyancy of the floats (630) decreased. Since the contact area of the float (630) with the waterline (34) decreases on account of the curved part of the float (630) as the float (630) rises, the buoyancy of the float (630) decreases. At the same time, the lifting assembly (610) slowly descends toward the waterline (34) as the floats (630) rise. The hydraulic cylinder (621) operates until the watercraft completely floats for itself.

FIG. 33 shows the boat lifting apparatus according to the sixth embodiment of the present invention in case that the watercraft is submerged into the water and the floats (630) are fully raised from the waterline (34).

In order to completely raise the watercraft above the waterline (34), the watercraft is positioned above the lifting assembly (610) submerged in the water. The hydraulic cylinder (621) pulls the arm (626) on the second rotating axle (624), and then the float support (631) coupled to the arm axle (627) inwardly turns. At the same time, the floats (630) naturally and softly go into the water. At this time, the bottom surface of the floats (630) is approximately parallel to the waterline (34) and the lifting assembly (610) is slowly raised above the waterline (34).

The greatest feature of the boat lifting apparatus according to the sixth embodiment of the present invention is that the U-typed frame (611) is figured to be sloped and then upright at both sides, that one end of the hydraulic cylinder (621) is coupled to the first support (622) attached to the inclined outside surface of the frame (611) and the other end of the hydraulic cylinder (621) is coupled to the arm (626) connected to the second support (625) which is attached to the upright outside surface of the U-typed frame (611), thereby reducing a radius of rotation of the floats (630), avoiding obstacles due to the longitudinally extended tip of the frame and thus making better use of space at a berthage.

Referring FIG. 37 to FIG. 42, the nonrotational-float boat lifting apparatus according to the seventh embodiment of the present invention operation is explained in detail as below.

FIG. 37 shows a state where the watercraft is loaded on the hydraulic cylinder-operated floating boat lifting apparatus according to the seventh embodiment of the present invention and raised from the waterline (34), wherein the frame (711) is embedded in the float (730).

FIG. 38 is a perspective view of the nonrotational-float boat lifting apparatus according to the seventh embodiment of the present invention in case that the watercraft is fully raised from the waterline (34) and the floats (730) are fully immersed in the water, wherein the connection portion of the frame (711) and the hydraulic cylinder assembly (720) and the part of the guiding rollers (750) are enlarged. The nonrotational-float boat lifting apparatus according to the seventh embodiment of the present invention mainly consists of the lifting assembly (710) positioned between a pair of parallel floats (730) to receive the watercraft; two pairs of hydraulic cylinder assemblies (720) to guide the floats (730) below or above the water (34); and the pair of parallel floats (730) longitudinally extended.

The lifting assembly (710) comprises a pair of U-typed frames (711) with their ends (716) being vertically formed, a beam (715) having a pair of cross beams (715*a*) and a pair of longitudinal beams (715*b*) for connecting the U-typed frames (711) to each other, and multiple bunks (712) inwardly and downwardly configured to receive or support the watercraft and being able to be rotated by the hinge pins (714) of the multiple supports (713) which are welded to a pair of cross beams (715*a*). In the drawings according to the seventh embodiment of the present invention, the number of the bunks (712) is four (4), but it is increased, if necessary. The U-typed frames (711) present visually prominent features to an operator of the watercraft that may assist the operator in locating the lifting assembly (710) when the watercraft enters the lifting apparatus according to the seventh embodiment of the present invention.

As shown in FIG. 40, the hydraulic cylinder assembly (720) comprises a hydraulic cylinder (721), a bracket (724) sliding in the inner part of the cylindrical pillar (731), and the rollers (725) installed on four side surfaces for guiding the sliding movement of the bracket (724). Four rollers (725) are installed on each side of the bracket (724). The hydraulic cylinder (721) is inserted to the hole (717) formed in the tip (716) of the U-typed frame (711) by the connecting member (722), and is connected to the frame (711) by the pin (726) through the pin holes (23*a*, 723*b*, 723*c*).

The tip (716) of the frame (711) is inserted to the groove (727) formed at the bracket (724) including the rollers (725). The connecting member (722) of the hydraulic cylinder (721) is inserted in the slot (717) formed at the tip (716) of the frame (711), and the pin (726) is inserted through the pin hole (723*a*) of the connecting member (722), the pin hole (723*b*) formed at the tip (716) of the frame (511) and the pin hole (724*c*) of the bracket (724). The hydraulic cylinder (721), the frame (711) and the bracket (724) are connected each other by the above mentioned connection.

Viewing the float (730) from the front, the surface area of the lower part of the floats (730) is larger than that of the upper part and the inward surface of the float (730) is curved. The floats (730) may be made of light metal materials such as aluminum or plastics such as fiber-reinforced plastics (FRP). The floats (730) may comprise multiple small floats that are united. As shown in FIG. 38 to FIG. 40, the cut groove (735) is formed to the middle of its height inside the float (730) so that the inclined part and the tip (716) of the U-typed frame (711) may be vertically raised or lowered. The toothed bar (744) of the locking means (740) can be also move back and forth in the cut groove (735). Further, the cylindrical pillar (731) is installed in the groove (735). The cylindrical pillar (731) is positioned in the center of the floats (730) so as to stably support the load of the boat lifting apparatus in a balance way. The bolt holes are formed in the middle of the pillar (731) for installing a locking means (740) and a limit switch (746). The cover (733) covers the top of the pillar (731). The hydraulic cylinder (721) pass through the hole formed in the center of the cover (733). The bolt holes for uniting the cover (733) are formed at both sides of the top of the float (730), and a limit switch (746) is installed above the first locking bracket (741) bolted in the pillar (731).

The boat lifting apparatus according to the seventh embodiment of the present invention may further comprise a pinion gear-typed locking means (740) to provide against a disorder of the hydraulic cylinder (721). A slit is formed in the middle of the pinion gear-typed locking means (740). The locking means (740) comprises a toothed gear (743), a toothed bar (744) functioning as a safety pin, the first bracket (741) including the motor (745) so as to drive the rotating axle of the toothed gear (743); the second bracket (741*a*) having the holes for inserting the toothed bar (744); and a limit switch (746) for stopping the raising of the frame (711).

The limit switch (746) is installed in the pillar (731) to be consistent with the height the tip (716) of the frame (711) reaches when the lifting assembly (710) loading the watercraft is completely raised by the hydraulic cylinder (521). The tip (716) of the frame (711) in the lifting assembly (710) touches the limit switch (746) when it rises, and then the motor (745) is operated by electric power (not shown in Figure), and then the toothed bar (744) is escaped. In case that the hydraulic pressure is released on account of the disorder of the hydraulic cylinder (721), the tip (716) of the frame (711) is caught by the toothed bar (744) and the motor (745) and the toothed bar (744) are not operated. More specifically, when the tip (716) of the frame (711) is caught by the toothed bar (744), the motor (745) is not operated. In order to lower the lifting assembly (710) so as to float the watercraft, the hydraulic cylinder (721) is pulled upward, and then the tip of the frame (711) touches the limit switch (746), and then the toothed bar (744) goes into the locking means (740).

Further, multiple guiding rollers (750) are installed at the inside lower part of the float (730) so that the float (730) is prevented from a friction loss due to a direct contact of the float (730) with the watercraft when the watercraft enters or exit the boat lifting apparatus according to the seventh embodiment of the present invention, and thus the watercraft can be smoothly guided to the lifting assembly (710). However, the guiding rollers (750) should be installed so as to be positioned above the waterline (34) regardless of loading the watercraft.

The guiding rollers (750) are installed in the hole (757) positioned below the lower part of the float (730), and consists of tween rollers (754) wherein an upper roller is smaller than a lower roller and its side surfaces are configured to be inclined, a roller axle (753) wherein one end of the axle includes a hole for inserting the roller pin (755) and the other end of the axle is quadrangle figured for the axle (753) not to be rotated, a spring (752) for accommodating various width of the watercrafts, a housing (751) enclosing the spring (752) and the roller axle (753), and a fixing member (756) for bolt-clamping the housing (751) to the floats (730).

Referring to FIG. 38 through FIG. 42, the operation in which the watercraft raised from the waterline (34) is lowered to the water and vise versa are explained.

FIG. 38 shows that the watercraft is fully raised from the waterline (34) and the floats (730) are fully immersed in the water. Prior to the raising operation of the boat lifting apparatus, the electric power (not shown) connected to the hydraulic cylinder (721) is turned on, and then it is pulled above a little. The limit switch (746) is touched by the tip of the frame (711), and then the motor (745) begins to work. At this time, the toothed bar (744) of the pinion gear returns to its original position to unlock the locking means (740). Next, the hydraulic cylinder (721) pushes the tip (716) of the frame (711) joined with the connecting member (722) of the cylinder assembly (721) and the bracket (724). At the same time, the bracket (724) descends inside the cylindrical pillar (731), and the inclined part and the tip of the frame (711) pass through the cut groove (735) of the float (730). At this time, the hydraulic cylinder (721) is continuously operated until the watercraft completely floats in the water for itself. Next, the watercraft smoothly escapes the boat lifting apparatus according to the seventh embodiment of the present invention by the guiding rollers (750).

FIG. 39 shows a state that the watercraft loaded on the boat lifting apparatus according to the seventh embodiment of the present invention is fully raised from the waterline (34). In order to completely raise the watercraft above the waterline (34), the watercraft is positioned above the lifting assembly (710) submerged in the water and then electric power (not shown in Figure) connected to the hydraulic cylinder (721) is turn on. At this time, the lifting assembly (710) begins to rise from the waterline (34). The tip (716) of the frame (711) touches the limit switch (746), and the toothed bar (744) functioning as a safety pin enters the holes of the bracket (741, 741*a*) and supports the lower surface of the tip (716) of the frame (711). Accordingly, no parts of the boat lifting apparatus according to the seventh embodiment of the present invention except for the floats (730) are submerged in the water.

The boat lifting apparatus according to the seventh embodiment of the present invention may further comprise an alarm means and an infrared sensor to represent the completion of the entrance of the watercraft.

The greatest feature of the boat lifting apparatus according to the seventh embodiment of the present invention is that the lifting assembly (710) loaded by the watercraft rises or descends without rotation of the floats (730) to significantly make good use of a space at the berthage a watercraft is moored, that the inclined part and the tip (716) of the U-typed frame rises and descends in the interior of the float (730) to make good use of a space at the berthage, and that multiple guiding rollers (750) are installed at the inside lower part of the float (730) so that the float (730) is prevented from a friction loss due to a direct contact of the float (730) with the watercraft when the watercraft enters or exit the boat lifting apparatus according to the seventh embodiment of the present invention.

Referring FIG. 43 to FIG. 51, the hydraulic rotor-operated floating boat lifting apparatus according to the eighth embodiment of the present invention operation is explained in detail as below.

FIG. 43 shows that the watercraft is loaded on the hydraulic rotor-operated floating boat lifting apparatus according to the eight embodiment of the present invention raised from the waterline (34). In accordance with the eighth embodiment of the invention, an air pressure rotor, a water pressure rotor, actuator or electrical rotor may be used instead of a hydraulic rotor (821).

FIG. 44 is a perspective view of the boat lifting apparatus according to the eighth embodiment of the present invention, showing a state that the watercraft are fully raised from the water and the floats (830) are fully immersed in the water wherein the frame (811) coupled to the hydraulic rotor assembly (820) is embedded in the float (830). The hydraulic rotor-operated floating boat lifting apparatus according to the eighth embodiment of the present invention comprises the lifting assembly (810) positioned between a pair of parallel floats (830) to receive the watercraft; two pairs of hydraulic cylinder assemblies (820) to guide the floats (830) below or above the water (34); and the pair of parallel floats (830) longitudinally extended.

The lifting assembly (810) comprises a pair of U-typed frames (811), a beam (815) for connecting the U-typed frames (811) comprising of a pair of cross beams (815*a*) and multiple longitudinal beams (815*b*), and multiple bunks (812) inwardly and downwardly configured to receive or support the watercraft and being able to be rotated by the hinge pins (814) of the multiple supports (813) which are welded to a pair of cross beams (815*a*). In the drawings according to the eighth embodiment of the present invention, the number of the bunks (812) is four (4), but it is increased, if necessary. The U-typed frames (811) present visually prominent features to an operator of the watercraft that may assist the operator in locating the lifting assembly (810) when the watercraft enters the lifting apparatus according to the eighth embodiment of the present invention.

As shown in FIG. 47, the hydraulic rotor assembly (820) comprises a hydraulic rotor (821); a main gear (822); an idle gear (823); a fan-shaped gear (824); a bracket (825) fixed in the groove (831) of the float (830); and an arm (826). The hydraulic rotor assembly (820) comprises a hydraulic rotor (821); a main gear (822); an idle gear (823); a fan-shaped gear (824); a bracket (825)); and an arm (826). The hydraulic rotor (821) comprises a shaft (821*a*) including saw teeth in one end of the shaft (821) and supporting rods (821*b*) spiraled at one end thereof so as to fix the arm (826) through the hole of tip of the U-typed frame (811) and the hole of the main gear (822). The shaft (821*a*) includes saw teeth in one end thereof, and is inserted in the hole (826*c*) so as to couple the arm (826) through the hole of the tip of the U-typed frame (811) and the hole of the main gear (822).

The hydraulic rotor (821) is coupled through the holes formed at the tip of the U-typed frame (811) and the main gear, and then bolt-clamped. The main gear (822) includes saw teeth on the outer circumference surface, and the hole (822*a*) to insert solenoid (840) as a locking means. The shaft (821*a*) is inserted in the center hole of the main gear (822). The saw teeth formed in outer circumference surface of the main gear (822) are interconnected with the saw teeth formed in outer circumference surface of the idle gear (823), and the saw teeth formed in outer circumference surface of the idle gear (823) are interconnected with the saw teeth of the fan-shaped gear (824). Accordingly, the rotation orientations of the main gear (822) and the idle gear (823) are in opposition to each other, and the rotation orientations of the main gear (822) and the fan-shaped gear (824) are identical to each other.

The idle gear (823) includes saw teeth in its outer circumference surface and its rotating axle of is inserted in the hole (826*a*) of the arm (826). The rotating axle of the idle gear (823) is inserted in the hole (826*a*) of the arm (826).

The fan-shaped gear (824) including multiple holes is bolt-clamped through the holes of the bracket (825). And the number of the holes formed in the fan-shaped gear (824) corresponds to that of the bracket (825). The rotating axle of the idle gear (825) is inserted through the hole (824*a*) of the fan-shaped gear (824), the hole (825*a*) of the bracket (825) and the hole (826*b*) of the arm (826).

A groove for inserting a stopper is formed at the tip of the shaft (821*a*) of the hydraulic rotor (821) for the shaft (821*a*) not to be left from the arm (826). Likewise, the grooves for inserting stoppers are formed at the tips of the rotating axles of the idle gear (823) and the fan-shaped gear (824) for the axles not to be left from the arm (826). Bushes may be inserted to the rotating axles between the idle gear (823) and the arm (826), and between the fan-shaped gear (824) and the arm (826) to reduce the contact surface area.

The diameter of main gear (822) may or may not be identical to that of the idle gear (823). But, a gear module (diameter of the gear/the number of saw teeth) of the idle gear 9822) and the fan-shaped gear (823) should be set-up so that in case that the arm (826) turns 90 degrees, the fan-shaped gear (824) may turn 45 degrees when the idle gear (823) turns 90 degrees.

The bracket (825) as ㄴ-shaped panel includes a supporting panel (825*b*) in which multiple holes for inserting the bolts are formed. And the bracket (825) is bolt-clamped to the wall of the groove (831) formed in the float (830).

The arm (826) includes a saw teeth-shaped hole (826*c*) to be interconnected with the saw teeth formed in one end of the shaft (821*a*), a hole (826*a*) for inserting the rotating axle of the idle gear (823) and a hole (826*b*) for inserting a rotating axle of the fan-shaped gear (824), and further comprising a solenoid (840) as a locking means.

Viewing the float (830) from the front, the surface area of the low part of the floats (830) is larger than that of the upper part and the inward of the float (830) is curved. The floats (830) may be made of light metal materials such as aluminum or plastics such as fiber-reinforced plastics (FRP). The floats (830) may comprise multiple small floats that are united. As shown in FIG. 43 to FIG. 48, two grooves (831) for accommodating the tip of the U-typed frame (811), bracket (825) and hydraulic rotor assembly (820) are formed in the float (830).

The boat lifting apparatus according to the eight embodiment of the present invention may further comprise a solenoid (840) as a locking means to provide against a disorder of the hydraulic rotor (821) or hold for a long time the state in which the apparatus is lifted with the watercraft loaded.

Referring to FIG. 44 to FIG. 51, the operation in which the watercraft raised from the waterline (34) is lowered to the water and vise versa is explained particularly for the left float (830).

FIG. 44 shows the boat lifting apparatus according to the eighth embodiment of the present invention in case that the watercraft is fully raised from the waterline (34) and the floats (430) are fully submerged into the water. Prior to the raising operation of the boat lifting apparatus, the electric power (not shown in figures) connected to the hydraulic rotor (821) is turned on, and then it is turn a little. Next, the electric power (not shown in figures) connected to the solenoid is turned on to unlock the locking means (840). The hydraulic rotor (821) turns the arm (826) clockwise (refer to FIG. 47), and then the turning force is transferred to the idle gear (823) and the fan-shaped gear (824) through the main gear (822). As a result, the float (830) is raised above the waterline (34). If the idle gear (823) turns 90 degree, the fan-shaped gear (824) is configured to turn 45 degree. At this time, the float (830) is raised above the waterline (34) by the rotating axle inserted through the hole (825*a*) of the bracket (825) and the hole (826*b*) of the arm (826) on the shaft (821*a*). The hydraulic rotor (821) is continuously operated until the watercraft completely floats in the water for itself and the arm (826) rotates 180 degree (refer to FIG. 51). Next, the watercraft smoothly escapes the boat lifting apparatus according to the eighth embodiment of the present invention.

The operation in which the watercraft immersed in the water is fully raised from the waterline (34) is explained. In order to completely raise the watercraft above the waterline (34), the watercraft is positioned above the lifting assembly (810) submerged in the water and then electric power (not shown in Figure) connected to the hydraulic rotor (821) is turned on. The hydraulic rotor (821) is turn in the opposite direction to the above mentioned direction. At this time, the lifting assembly (810) begins to rise from the waterline (34). The operation of the boat lifting apparatus for completely raising the watercraft above the waterline (34) is opposite to the operation for lowering the boat to the water. After the watercraft is completely raised from the waterline, the electric power connected to the solenoid (840) is turned off, and then the solenoid pin functioning as the safety pin enters the hole of the main gear (822) by the spring of the solenoid (840)

In case that the watercraft is raised or lowered by the boat lifting apparatus according to the eighth embodiment of the present invention, it can be configured so that no parts of the float (830) are contacted with the wall of the berth (835).

According to the present inventions, an actuator, a water-pressure cylinder or an air-pressure cylinder may be used instead of the hydraulic cylinder.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

The invention claimed is:

1. A watercraft lifting apparatus for raising or lowering the watercraft from or onto water, comprising:

a lifting assembly positioned between a pair of parallel floats to receive the watercraft; and a pair of U-typed guide structures to guide the parallel floats below or above the water, wherein the pair of parallel floats is longitudinally extended, and wherein the lifting assembly is inwardly and downwardly configured to receive or support the watercraft and includes:

a pair of bunks longitudinally extended, a pair of V-typed beams supporting the bunks, a longitudinally extended central beam welded at its edges to the lower part of the pair of V-typed beams, two pairs of arm structures each connected to both edges of each of the pair of V-typed beams through two pairs of first rotating axles respectively, and two pairs of hydraulic cylinders, each cylinder being connected between a second rotating axle positioned below the first rotating axle and a fourth rotating axle of the central beam.

2. The watercraft lifting apparatus for raising or lowering the watercraft from or onto the water according to claim 1, wherein the guide structure includes a pair of rollers connected to a brace bolted to the float and a raised spot in edge of the guide for the rollers not to leave the guide structure.

3. A hydraulic cylinder-operated watercraft lifting apparatus for raising or lowering the watercraft from or onto water, comprising:

a lifting assembly positioned between a pair of parallel floats to receive the watercraft; and two pairs of hydraulic cylinder assemblies to guide the parallel floats below or above the water, wherein the pair of parallel floats is longitudinally extended, and wherein each hydraulic cylinder assembly comprises:

a hydraulic cylinder connected between a third rotating axle which is attached to a protrusion formed on one end of a frame and a first rotating axle which is attached to an upper surface of the floats, a first support which is attached to a lower surface of the protrusion of the frame, a second support attached to the upper surface of the floats, a second rotating axle connecting the first support and the second support, and the first rotating axle connecting the second support and the hydraulic cylinder.

4. The hydraulic cylinder-operated watercraft lifting apparatus for raising or lowering the watercraft from or onto the water according to claim 3, further comprising:

a locking means comprising a third support bolt-clamped with one side of the first support of the frame, a fourth support attached to the upper surface of the floats, and a solenoid for locking the third support and the fourth support.

5. A worm gear-operated watercraft lifting apparatus for raising or lowering the watercraft from or onto water, comprising:

a lifting assembly positioned between a pair of parallel floats to receive the watercraft; and two pairs of worm gear assemblies to guide the parallel floats below or above the water, wherein the pair of parallel floats is longitudinally extended, and wherein each worm gear assembly comprises:

a first support attached to the protrusion formed on both ends of a U-typed frame;

a worm wheel connected to a rotating axle in a hole formed on one end of the first support;

a worm connected to a saw teeth of the worm wheel;

a worm axle;

a motor connected to the worm axle;

a second support connected by the rotating axle of the first support and attached to an upper surface of the floats; and a housing enveloping the worm wheel, the worm and the worm axle, and attached to a side of the protrusion of the U-typed frame.

6. The worm gear-operated watercraft lifting apparatus for raising or lowering the watercraft from or onto the water according to claim 5, further comprising:

a locking means comprising a third support attached to the protrusion of an end of the U-typed frame, a fourth support attached to the upper surface of the parallel floats, and a solenoid for locking or unlocking the third support and the fourth support by a hole formed on one end of the third support and a solenoid pin.

7. A nonrotational-float watercraft lifting apparatus for raising or lowering the watercraft from or onto water, comprising:

a lifting assembly positioned between a pair of parallel floats to receive the watercraft; and two pairs of hydraulic cylinder assemblies to guide the floats below or above the water, wherein the pair of parallel floats is longitudinally extended, and wherein the hydraulic cylinder assembly comprises a hydraulic cylinder, a bracket sliding in an inside of a cylindrical pillar, and eight sleeves installed on outside edges of the bracket for guiding a sliding movement of the bracket.

8. The nonrotational-float watercraft lifting apparatus for raising or lowering the watercraft from or onto the water according to claim 7, wherein the hydraulic cylinder is inserted to a slot formed in a tip of a frame by a connecting member, and is connected to the frame by a pin through a pin hole of a connecting member, a pin hole of the frame, and a pin hole of the bracket.

9. The nonrotational-float watercraft lifting apparatus for raising or lowering the watercraft from or onto the water according to claim 7, wherein an upper part of the bracket has a groove to receive a tip of a frame, and has two protrusions having a pin hole to receive a pin and having bolt holes to bolt-clamp the sleeves.

10. The nonrotational-float watercraft lifting apparatus for raising or lowering the watercraft from or onto the water according to claim 9, wherein the eight sleeves are bolt-clamped to four outside edges of the bracket for guiding the sliding movement of the bracket and coated with PE plastics, or ceramics or Teflon to reduce friction and increase durability.

11. The nonrotational-float watercraft lifting apparatus for raising or lowering the watercraft from or onto the water according to claim 7, wherein:

an area of a lower surface of the floats is greater than an area of an upper surface of the floats, an inward surface of the floats is curved, a rectangular trough is formed to a middle of its height in the float to receive a cylindrical pillar, the float has two cylindrical pillars which have a slit opened in its upper portion and bolt holes to install a locking means and to hold a cover, and the cover has a hole through which the hydraulic cylinder penetrates, its lower part being opened, and has bolt holes corresponding to those of the pillar in four side surfaces of the cover, and the apparatus further comprising a limit switch to stop a raising of the frame.

12. The nonrotational-float watercraft lifting apparatus for raising or lowering the watercraft from or onto the water according to claim 11, wherein the cylindrical pillar is extended and fixed to a bottom of the floats.

13. The nonrotational-float watercraft lifting apparatus for raising or lowering the watercraft from or onto the water according to claim 7, further comprising:

a pinion gear-typed locking means installed in an upper part of a slit of a cylindrical pillar, wherein the gear-typed locking means comprises:

a first bracket, a toothed gear, a toothed bar functioning as a safety pin, a rotating axle associated with the toothed gear, a motor driving the rotating axle;

a second bracket having a hole for receiving the toothed bar; and a limit switch installed on a cover to stop a raising of the frame.

14. A frame-improved hydraulic cylinder-operated watercraft lifting apparatus for raising or lowering the watercraft from or onto water, comprising:

a lifting assembly positioned between a pair of parallel floats to receive the watercraft; and two pairs of hydraulic cylinder assemblies to guide the floats below or above the water, wherein the pair of parallel floats is longitudinally extended, and wherein the hydraulic cylinder assembly comprises:

a hydraulic cylinder, a first support connected to one end of the hydraulic cylinder through a first rotating axle, an arm wherein one end of the arm is connected to the other end of the hydraulic cylinder through a second rotating axle, and wherein the other end of the arm is connected to a tip of a float support, and a second support attached to an outer surface of an upright upper end of a U-typed frame, and a hole for receiving an arm axle through which arm turns are received.

15. The frame-improved hydraulic cylinder-operated watercraft lifting apparatus for raising or lowering the watercraft from or onto the water according to claim 14, wherein the lifting assembly comprises:

a pair of U-typed frames outwardly inclined from the bottom and then upright from the end of the inclined part, a beam comprising a pair of cross beams and a pair of longitudinal beams for connecting a pair of U-typed frames to each other, and multiple bunks inwardly and downwardly configured to receive or support the watercraft and being able to be rotated about hinge pins of multiple supports that are welded to the pair of cross beams.

16. The frame-improved hydraulic cylinder-operated watercraft lifting apparatus for raising or lowering the watercraft from or onto the water according to claim 14, wherein:

an area of a lower surface of the floats is greater than an area of an upper surface of the floats, the inward surface of the floats is curved, each float has two supports, and a hole is formed in an upper end of each support for inserting an arm axle.

17. The frame-improved hydraulic cylinder-operated watercraft lifting apparatus for raising or lowering the watercraft from or onto the water according to claim 14, further comprising:

a solenoid as a locking means which is attached to a middle of the arm and latches the arm to the second support so that a pin of the solenoid may enter a hole of the second support.

18. A nonrotational-float watercraft lifting apparatus for raising or lowering the watercraft from or onto water, comprising:

a lifting assembly positioned between a pair of parallel floats to receive the watercraft; and two pairs of hydraulic cylinder assemblies to guide the floats below or above the water, wherein the pair of parallel floats is longitudinally extended, wherein a U-typed frame is embedded in the floats, and wherein each hydraulic cylinder assembly comprises:

a hydraulic cylinder, a bracket sliding in an inner part of a cylindrical pillar, and rollers installed on four side surfaces for guiding a sliding movement of the bracket.

19. The nonrotational-float watercraft lifting apparatus for raising or lowering the watercraft from or onto the water according to claim 18, wherein the hydraulic cylinder is inserted to a hole formed in a tip of the U-typed frame by a connecting member, and is connected to the U-typed frame by a pin through a pin hole of the connecting member, a pin hole of the U-typed frame, and a pin hole of the bracket.

20. The nonrotational-float watercraft lifting apparatus for raising or lowering the watercraft from or onto the water according to claim 18, wherein a hole for inserting a tip of the frame and a pin hole for inserting the pin are provided in a lower part of the bracket, and the rollers are installed on four side surfaces for guiding the sliding movement of the bracket.

21. The nonrotational-float watercraft lifting apparatus for raising or lowering the watercraft from or onto the water according to claim 18, wherein:

an area of a lower surface of the floats is greater than an area of an upper surface of the floats, an inward surface of the floats is curved, an inclined part and a tip of the U-typed frame are vertically raised or lowered through a cut groove of the float formed to the middle of its height in the float so that a toothed bar may be able to move back and forth, and the cylindrical pillar is installed in a groove.

22. The nonrotational-float watercraft lifting apparatus for raising or lowering the watercraft from or onto the water according to claim 21, wherein the cylindrical pillar comprises:

bolt holes disposed in a middle of the pillar for installing a locking means and a limit switch, a cover covering a top of the pillar, having a hole through which the hydraulic cylinder passes, and having bolt holes for uniting the cover to a top of the float, and a limit switch installed above a first locking bracket and bolted in the pillar.

23. The nonrotational-float watercraft lifting apparatus for raising or lowering the watercraft from or onto the water according to claim 18, further comprising:

a pinion gear-typed locking means installed in the pillar, wherein the locking means comprises a first bracket and a toothed gear, a toothed bar functioning as a safety pin, a rotating axle of the toothed gear, a motor driving the rotating axle, a second bracket having holes for inserting a toothed bar; and a limit switch installed in the pillar to stop the raising of the frame.

24. The nonrotational-float watercraft lifting apparatus for raising or lowering the watercraft from or onto the water according to claim 21, wherein:

guiding rollers are installed in a hole positioned below a lower part of the float and above the waterline, and comprising tween rollers wherein an upper roller is smaller than a lower roller and its side surfaces are configured to be inclined, a roller axle wherein one end of the axle includes a hole for inserting the roller pin and the other end of the axle is quadrangle figured for the axle no to be rotated, a spring for accommodating various width of the watercrafts, a housing enclosing the spring and the roller axle, and a fixing member for bolt-clamping the housing to the floats.

25. A hydraulic rotor-operated watercraft lifting apparatus for raising or lowering the watercraft from or onto water, comprising:

a lifting assembly positioned between a pair of parallel floats to receive the watercraft; and two pairs of hydraulic cylinder assemblies to guide the floats below or above the water, wherein the pair of parallel floats is longitudinally extended, and wherein each hydraulic rotor assembly comprises:

a hydraulic rotor;

a main gear;

an idle gear;

a fan-shaped gear;

a bracket fixed in a groove of the float; and an arm.

26. The hydraulic rotor-operated watercraft lifting apparatus for raising or lowering the watercraft from or onto the water according to claim 25, wherein the hydraulic rotor comprises:

a shaft including saw teeth in one end of the shaft, and supporting rods spiraled at one end thereof to fix the arm.

27. The hydraulic rotor-operated watercraft lifting apparatus for raising or lowering the watercraft from or onto the water according to claim 25, wherein the main gear is bolt-clamped to the hydraulic rotor through a hole formed in one end of a U-typed frame and includes saw teeth in its outer circumference surface, a hole for inserting a pin of a solenoid as a locking means and a center hole for inserting a shaft of the hydraulic rotor, the saw teeth of the main gear being interconnected with saw teeth formed in an outer circumference surface of the idle gear, and wherein the saw teeth of the idle gear are interconnected with saw teeth of the fan-shaped gear.

28. The hydraulic rotor-operated watercraft lifting apparatus for raising or lowering the watercraft from or onto the water according to claim 25, wherein the idle gear includes saw teeth in its outer circumference surface, and wherein a rotating axle of the idle gear is inserted in a hole of the arm through a hole, and a rotating axle of the idle gear is inserted in the hole of the arm.

29. The hydraulic rotor-operated watercraft lifting apparatus for raising or lowering the watercraft from or onto the water according to claim 25, wherein the fan-shaped gear is bolt-clamped to a supporting panel through holes formed in both idle gear and supporting panel, a rotating axle of the idle gear is inserted through a hole of the fan-shaped gear, a hole of the bracket and a hole of the arm.

30. The hydraulic rotor-operated watercraft lifting apparatus for raising or lowering the watercraft from or onto the water according to claim 25, wherein modules of the idle gear and the fan-shaped gear are set so that the fan-shaped gear may turn 45 degrees when the idle gear turns 90 degrees.

31. The hydraulic rotor-operated watercraft lifting apparatus for raising or lowering the watercraft from or onto the water according to claim 25, wherein the bracket is a ㄴ-shaped panel including a supporting panel in which multiple holes for inserting bolts are formed, and which is bolt-clamped to a wall of a groove formed in the float.

32. The hydraulic rotor-operated watercraft lifting apparatus for raising or lowering the watercraft from or onto the water according to claim 25, wherein the arm includes:

a saw teeth-shaped hole to be interconnected with saw teeth formed in one end of a shaft, a hole for inserting a rotating axle of the idle gear and a hole for inserting a rotating axle of the fan-shaped gear, and further comprising a solenoid functioning as a locking means.

33. The hydraulic rotor-operated watercraft lifting apparatus for raising or lowering the watercraft from or onto the water according to claim 25, wherein:

an area of a lower surface of the floats is greater than an area of an upper surface of the floats, the inward of the floats is curved, and two grooves for accommodating a tip of the U-typed frame are formed, and wherein the bracket and hydraulic rotor assembly are formed in the float.

34. The hydraulic rotor-operated watercraft lifting apparatus for raising or lowering the watercraft from or onto the water according to claim 25, an actuator, a water-pressure rotor, an air-pressure rotor or an electrical rotor is used instead of the hydraulic rotor.

35. The hydraulic cylinder-operated watercraft lifting apparatus for raising or lowering the watercraft from or onto the water according to claim 1, wherein a water-pressure cylinder, an air-pressure cylinder or an actuator is used instead of the hydraulic cylinder.

* * * * *